US011162284B2

(12) United States Patent
Ottino et al.

(10) Patent No.: US 11,162,284 B2
(45) Date of Patent: Nov. 2, 2021

(54) ONE MOTOR LATCH ASSEMBLY WITH POWER CINCH AND POWER RELEASE HAVING SOFT OPENING FUNCTION

(71) Applicant: Magna Closures S.p.A., Guasticce (IT)

(72) Inventors: Franco Giovanni Ottino, S. Giuliano Terme (IT); Francesco Cumbo, Pisa (IT); Marco Taurasi, Leghorn (IT); Enrico Margheritti, Lucca (IT)

(73) Assignee: MAGNA CLOSURES S.P.A., Guasticce (IT)

( * ) Notice: Subject to any disclaimer, the term of this patent is extended or adjusted under 35 U.S.C. 154(b) by 1190 days.

(21) Appl. No.: 15/276,926

(22) Filed: Sep. 27, 2016

(65) Prior Publication Data

US 2017/0089103 A1 Mar. 30, 2017

Related U.S. Application Data

(60) Provisional application No. 62/234,260, filed on Sep. 29, 2015.

(51) Int. Cl.
*E05B 81/20* (2014.01)
*E05B 77/04* (2014.01)
(Continued)

(52) U.S. Cl.
CPC ..... *E05B 81/20* (2013.01); *E05B 77/04* (2013.01); *E05B 81/06* (2013.01); *E05B 81/16* (2013.01);
(Continued)

(58) Field of Classification Search
CPC ..... E05B 81/06; E05B 81/14; E05B 81/16; E05B 81/18; E05B 81/20; E05B 81/34;
(Continued)

(56) References Cited

U.S. PATENT DOCUMENTS 4,892,339 A * 1/1990 Kleefeldt ..... E05B 81/20 292/201
5,288,115 A * 2/1994 Inoue ..... E05B 81/20 292/201
(Continued)

FOREIGN PATENT DOCUMENTS

CA 2382487 A1 * 3/2001 ..... E05B 77/26
DE 102013008415 A1 * 11/2014 ..... E05B 81/56
(Continued)

OTHER PUBLICATIONS

Machine Translation of DE 102014002580, 2020, pp. 1-15 (Year: 2020).*
(Continued)

*Primary Examiner* — Christine M Mills
(74) *Attorney, Agent, or Firm* — Dickinson Wright PLLC

(57) ABSTRACT

A power latch assembly for a motor vehicle closure system configured to provide a power cinching feature and a power release feature. The power cinching feature is configured to retain the ratchet in a cinched striker capture position with the pawl engaged from the ratchet. The power release feature is configured to move the ratchet from its cinched striker capture position to a cinch release striker capture position for unloading the seals prior to release of the ratchet to its striker release position.

21 Claims, 59 Drawing Sheets

(51) Int. Cl.
*E05B 81/06* (2014.01)
*E05B 81/16* (2014.01)
*E05B 81/34* (2014.01)
*E05B 81/36* (2014.01)
*E05B 85/26* (2014.01)

(52) U.S. Cl.
CPC ..... *E05B 81/34* (2013.01); *E05B 81/36* (2013.01); *E05B 85/26* (2013.01)

(58) Field of Classification Search
CPC ..... E05B 81/36; E05B 85/26; E05B 77/04; Y10T 292/1082; Y10T 292/1047; Y10T 292/1079; Y10S 292/23
USPC ..... 292/201, 216, DIG. 23, 199
See application file for complete search history.

(56) References Cited

U.S. PATENT DOCUMENTS 5,423,582 A * 6/1995 Kleefeldt ..... E05B 81/20 292/201
5,433,496 A * 7/1995 Zimmermann ..... E05B 81/20 292/201
5,639,130 A * 6/1997 Rogers, Jr. ..... E05B 81/20 292/199
5,769,468 A * 6/1998 Armbruster ..... E05B 81/20 292/201
5,899,508 A * 5/1999 Cetnar ..... E05B 81/16 292/216
5,918,917 A * 7/1999 Elton ..... E05B 81/20 292/201
5,941,579 A * 8/1999 Baniak ..... E05B 85/26 292/201
6,053,542 A * 4/2000 Ostrowski ..... E05B 81/20 292/201
6,341,448 B1 * 1/2002 Murray ..... E05B 81/20 49/280
6,439,623 B1 * 8/2002 Lohfeld ..... E05B 81/20 292/201
6,540,270 B1 * 4/2003 Reddmann ..... E05B 81/22 292/201
6,550,825 B2 * 4/2003 Ostrowski ..... E05B 81/20 292/199
6,557,910 B2 * 5/2003 Amano ..... E05B 81/14 292/201
6,764,113 B1 * 7/2004 Cetnar ..... E05B 81/06 292/201
7,175,212 B2 * 2/2007 Cetnar ..... E05B 81/20 292/201
7,261,336 B2 * 8/2007 Zillert ..... E05B 81/20 292/201
10,246,911 B2 * 4/2019 Marasco ..... E05B 81/28
10,280,653 B2 * 5/2019 Estrada ..... E05B 81/28
10,309,130 B2 * 6/2019 Schiffer ..... E05B 81/20
10,329,806 B2 * 6/2019 Scholz ..... E05B 77/08
10,378,252 B2 * 8/2019 Ottino ..... E05B 85/243
10,472,869 B2 * 11/2019 Fannon ..... E05B 81/20
2016/0186468 A1 * 6/2016 Ilea ..... E05B 79/04 292/201
2017/0089105 A1 3/2017 Margheritti
2018/0087298 A1 * 3/2018 Strole ..... E05B 81/16
2018/0100331 A1 * 4/2018 Cumbo ..... E05B 81/20
2018/0163439 A1 * 6/2018 Patane ..... E05B 81/20
2018/0171677 A1 * 6/2018 Im ..... E05B 81/14
2018/0171679 A1 * 6/2018 Im ..... E05B 81/34
2018/0347239 A1 * 12/2018 Im ..... E05B 81/20
2019/0017301 A1 * 1/2019 Cumbo ..... E05B 81/66
2019/0063117 A1 * 2/2019 Mozola ..... E05B 81/22
2019/0136590 A1 * 5/2019 Patane ..... E05B 81/14
2019/0145135 A1 * 5/2019 Lebsak ..... E05B 81/16 292/229
2019/0226247 A1 * 7/2019 Johann ..... E05B 81/06
2019/0249467 A1 * 8/2019 Patane ..... E05B 81/76
2019/0271179 A1 * 9/2019 Patane ..... E05B 81/64
2019/0301212 A1 * 10/2019 Digel ..... E05B 81/20
2020/0024872 A1 * 1/2020 Ney ..... E05B 79/08

FOREIGN PATENT DOCUMENTS

DE 102014002580 A1 * 8/2015 ..... E05B 81/64
DE 202014103819 U1 * 11/2015 ..... E05B 81/20
EP 0978609 A1 2/2000
EP 1176273 A2 1/2002
WO 2003071064 A1 8/2003
WO WO-2018030556 A2 * 2/2018 ..... E05B 81/06

OTHER PUBLICATIONS

Machine Translation of DE 102013008415 A1, 2021, pp. 1-13 (Year: 2021).*

* cited by examiner

FIG. 15A
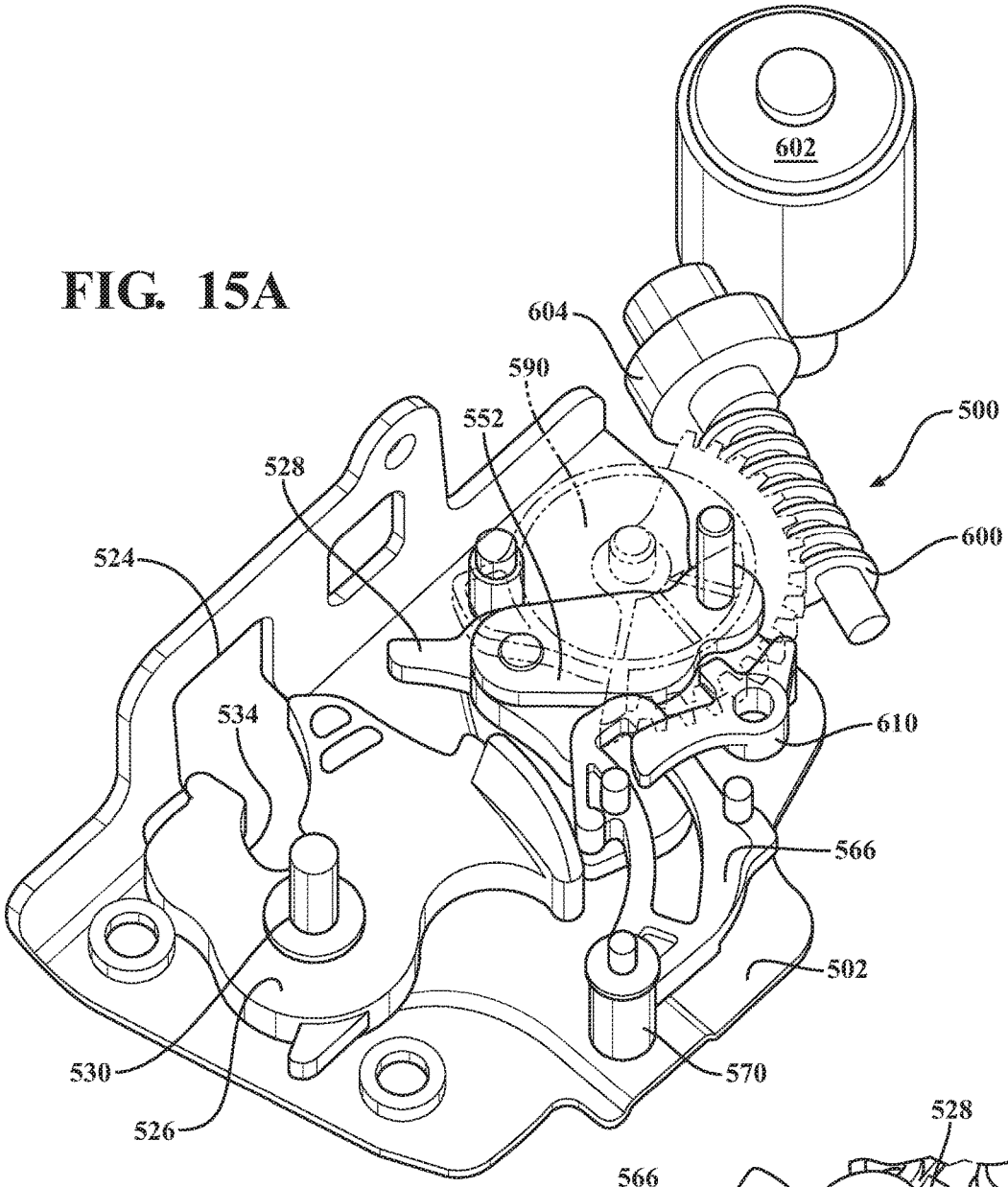
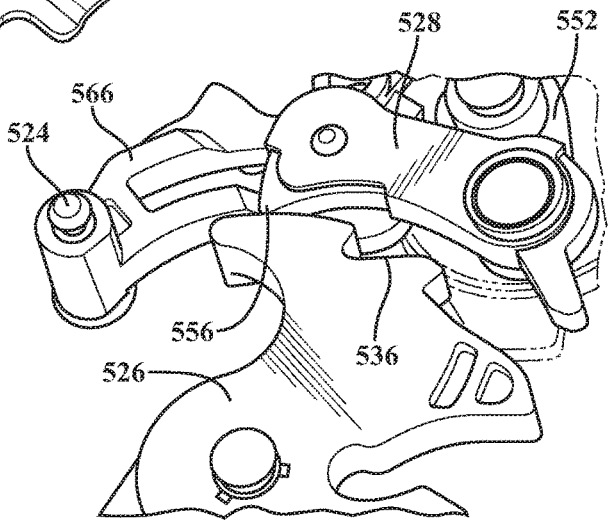
FIG. 15B

FIG. 20A
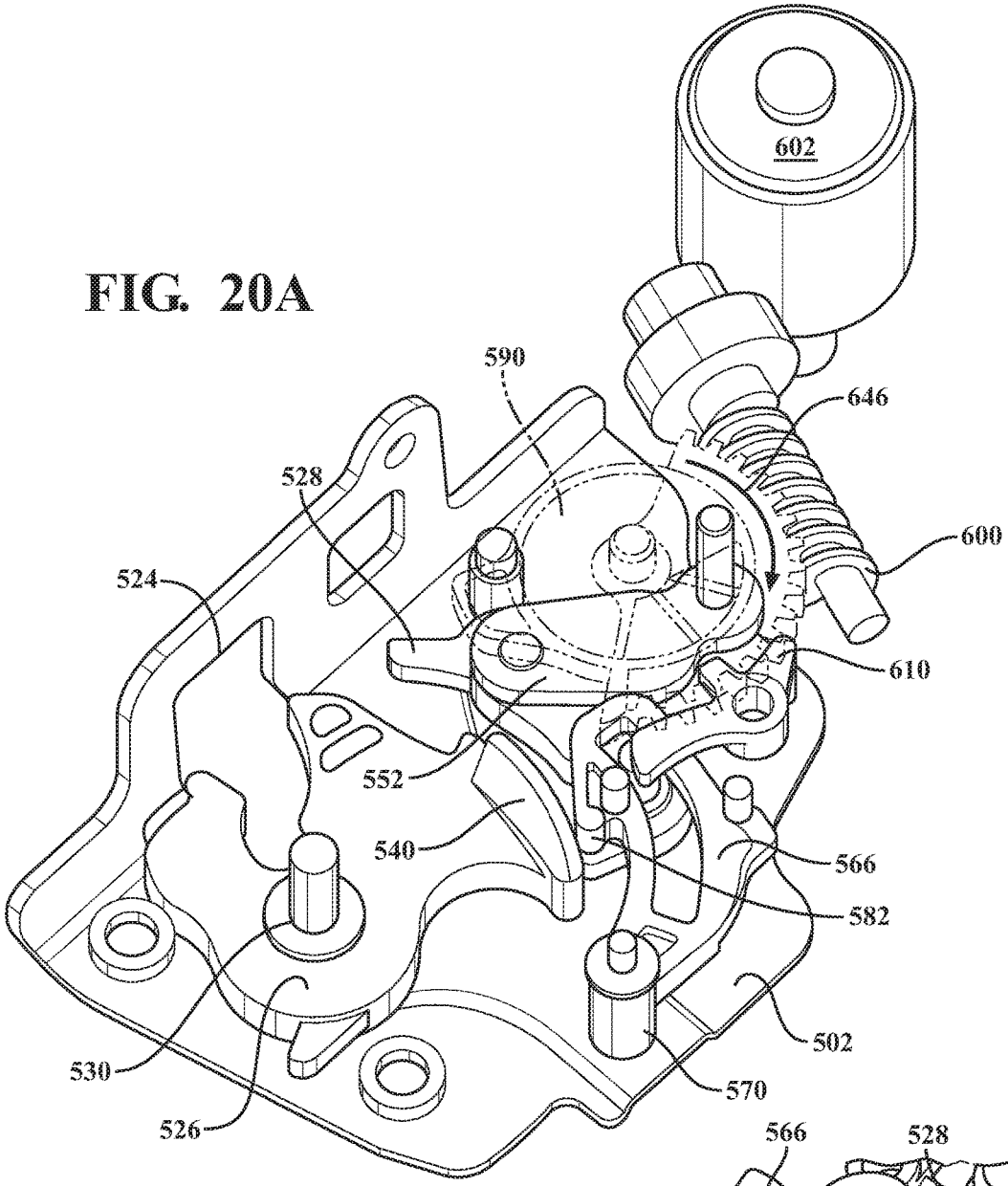
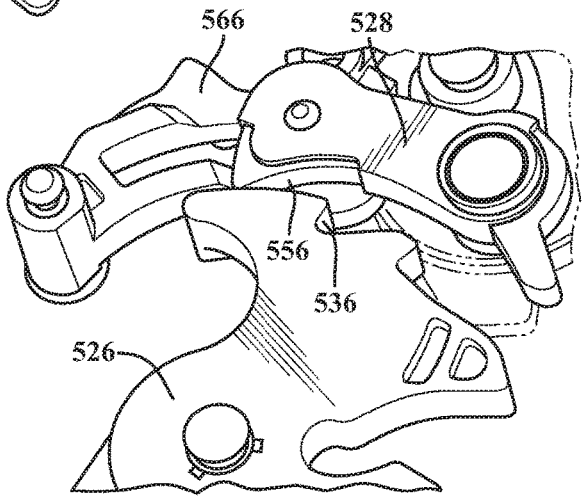
FIG. 20B

ONE MOTOR LATCH ASSEMBLY WITH POWER CINCH AND POWER RELEASE HAVING SOFT OPENING FUNCTION

CROSS-REFERENCE TO RELATED APPLICATIONS

This application claims the benefit of U.S. Provisional Application No. 62/234,260, filed on Sep. 29, 2015. The entire disclosure of the above application is incorporated herein by reference.

FIELD OF THE INVENTION

The present disclosure relates generally to a closure latch for a vehicle closure panel and, more particularly, to a power latch assembly providing at least one of a power cinching feature and a power release feature having a soft opening function.

BACKGROUND OF THE INVENTION

This section provides background information related to the present disclosure which is not necessarily prior art.

In view of increased consumer demand for motor vehicles equipped with advanced comfort and convenience features, many modern motor vehicles are now provided with passive entry systems to permit locking and release of closure panels (i.e., doors, tailgates, liftgates and decklids) without use of a traditional key-type entry system. In this regard, some popular features now available with vehicle latch systems include power locking/unlocking, power release and power cinching. These "powered" features are provided by a latch assembly mounted to the closure panel and which includes a ratchet and pawl type of latching mechanism controlled via at least one electric actuator. Typically, the closure panel is held in a closed position by virtue of the ratchet being positioned in a striker capture position to releaseably retain a striker that is mounted to a structural portion of the vehicle. The ratchet is held in its striker capture position by the pawl engaging the ratchet in a ratchet holding position. In most ratchet and pawl type of latching mechanisms, the pawl is operable in its ratchet holding position to retain the ratchet in one of an initial or soft close striker capture position and a primary or hard close striker capture position. Latch assemblies providing a power cinching feature are typically equipped with a cinching mechanism operated by an electric actuator. Commonly, the cinching mechanism is directly connected to the ratchet and, when actuated, is operable for moving the ratchet from its initial striker capture position into its primary striker capture position, thereby cinching the closure panel in its fully closed position. To subsequently release the closure panel from its closed position, a release mechanism is actuated for moving the pawl from its ratchet holding position into a ratchet release position, whereby a ratchet biasing arrangement and the sealing loads acting on the striker act to forcibly pivot the ratchet from its primary striker capture position into a striker release position so as to release the striker. In latch assemblies providing a power release feature, the release mechanism is controlled by an electric actuator. A common electric actuator or separate electric actuators can be used in associated with the power release and power cinching features. However, the power release feature is typically independent from the power cinch feature. As an alternative, it is also known to employ a double pawl type of latching mechanism to reduce the release effort required for the electric actuator to release the latching mechanism.

In most latch assemblies equipped with a power cinching feature, the cinching mechanism is normally maintained in a non-actuated or "stand-by" condition and is only shifted into an actuated condition once the sensors indicate that the ratchet is located in its initial striker capture position. Following completion of the cinching operation, when the sensors indicate that the ratchet is located in its primary striker capture position, the cinching mechanism must be "reset", that is returned to its stand-by condition, to permit subsequent uninhibited movement of the ratchet to its striker release position via actuation of the release mechanism. If the closure panel is initially closed with a sufficient closing force to locate the ratchet in its primary striker capture position, then the cinching operation is bypassed and the cinching mechanism is retained in its stand-by condition. One example of a power cinching latch assembly is disclosed in U.S. Pat. No. 6,341,448 as having a cable-type cinching mechanism.

To ensure that precipitation and road debris do not enter the vehicle, virtually all vehicle closure panels are equipped with weather seals around their peripheral edge and which are configured to seal against a mating surface of the vehicle body surrounding the closure opening. These weather seals also function to reduce wind noise. The seals are typically made from an elastomeric material and are configured to compress upon closing the closure panel by virtue of the latch assembly. As is recognized, increasing the compressive clamping force applied to the weather seals provides improved noise reduction within the passenger compartment. As will be appreciated, with the weather seals held in a highly compressed condition, they tend to force the closure panel toward its open position and this "opening" force is resisted by the pawl and ratchet latching mechanism of the power latch assembly. Because the seal loads exerted on the latching mechanism are increased, the forces required to release the latching mechanism are also increased which, in turn, impacts the size and power requirements of the electric actuator. Further, an audible "pop" sound is sometimes generated following actuation of the electric actuator during a power release operation due to the quick release of the seal loads while the ratchet of the latching mechanism is forcibly driven from its primary striker capture position into its striker release position.

To address this dichotomy between high seal loads and low release efforts, it is known to provide an arrangement for controllably releasing the seal loading in coordination with release of the latching mechanism. For example, European Publication No. EP1176273 discloses a single ratchet/double pawl type of power-operated latching mechanism that is configured to provide a progressive releasing of the ratchet for reducing noise associated with its release. In addition, European Publication EP0978609 utilizes an eccentric mechanism in association with a single pawl latching mechanism to reduce seal loads prior to release of the ratchet.

While current power latch assemblies are sufficient to meet regulatory requirements and provide enhanced comfort and convenience, a need still exists to advance the technology and provide alternative power latch assemblies and arrangements that address and overcome at least some of the known shortcomings.

SUMMARY OF THE INVENTION

This section provides a general summary of the disclosure and is not intended to be a comprehensive disclosure of all features, advantages, aspects and objectives associated with the inventive concepts described and illustrated in the detailed description provided herein.

It is an aspect of the present disclosure to provide a power latch assembly for a motor vehicle closure system configured to provide at least one of a power cinching feature and a soft opening power release feature.

It is a related aspect of the present disclosure to provide the power latch assembly with a power-operated latch cinch mechanism operable to cinch a striker retained by a ratchet of a ratchet and pawl latch mechanism by moving the ratchet from one of a soft close striker capture position and a hard close striker capture position into a cinched striker capture position.

It is another related aspect of the present disclosure to utilize the power-operated latch cinch mechanism to establish a first or Cinch mode and a second or Uncinch/Release mode. The Cinch mode is established when the power-operated latch cinch mechanism engages and forcibly drives the ratchet to move from one of its soft close and hard close striker capture positions into its cinched striker capture position. The Uncinch/Release mode is established when the power-operated latch cinch mechanism initially moves the ratchet from its cinched striker capture position to a cinch release striker capture position and subsequently permits the ratchet to move from its cinch release striker capture position to a ratchet released position.

It is yet another related aspect of the present disclosure to provide the power latch assembly with a power-operated latch release mechanism operable, in cooperation with the latch cinch mechanism, to permit movement of the ratchet from its cinched striker capture position into its cinch release striker capture position for uncinching the striker prior to permitting movement of the ratchet from its ratchet release position to a striker release position so as to provide the soft opening power release feature.

It is another aspect of the present disclosure to provide the power latch assembly with an actuation mechanism operable to coordinate the power cinching feature and the soft opening power release feature. In one embodiment of the power latch assembly, a one-motor actuation mechanism is utilized to provide both the power cinching and power release features.

It is another aspect of the present disclosure to provide a power latch assembly with a power-operated latch cinch mechanism operable to cinch a striker retained by a ratchet of a ratchet and pawl type of latch mechanism by moving the pawl from a cinch start pawl position into a cinch stop pawl position for causing corresponding movement of the ratchet from a primary striker capture position into a cinched striker capture position.

It is a related aspect of the present disclosure to utilize the power-operated latch cinch mechanism to establish a Cinch mode and an Uncinch/Release mode. The Cinch mode is established when the power-operated latch cinch mechanism causes the pawl to engage and forcibly drive the ratchet to move from its primary striker capture position into its cinched striker capture position. The Uncinch/Release mode is established when the power-operated latch cinch mechanism initially moves the ratchet from its cinched striker capture position to an uncinched striker capture position and subsequently permits a power-operated latch release mechanism to disengage the pawl from the ratchet so as to permit the ratchet to move from its uncinched striker capture position to a ratchet released position. It is another feature of the power latch assembly that a single power-operated actuation mechanism is used to operate the latch cinch mechanism and the latch release mechanism.

It is another related aspect of the present disclosure to utilize the pawl of the pawl and ratchet type latch mechanism to mechanically rotate and hold the ratchet in both of its primary and cinched striker capture positions during the power cinching operation as well as to move the ratchet from its cinched striker capture position to its uncinched striker capture position during the power releasing operation.

In accordance with these aspects, a latch assembly for a motor vehicle is provided which comprises a ratchet moveable between a striker release position whereat the ratchet is positioned to release a striker and at least two distinct striker capture positions whereat the ratchet is positioned to retain the striker wherein the striker capture positions include a primary striker capture position and a cinched striker capture positions; a ratchet biasing member for normally biasing the ratchet toward its striker release position; a pawl moveable between a ratchet checking position whereat the pawl engages and holds the ratchet in one of its primary and cinched striker capture positions and a ratchet release position whereat the pawl is released from engagement with the ratchet so as to permit movement of the ratchet to its striker release position; a latch cinch mechanism having a cinch lever pivotably coupled to the pawl; and an actuation mechanism operably moveable in a cinching direction from a cinch start position to a cinch stop position to provide a power cinching operation initiated when the ratchet is rotated by the striker into its primary strike capture position and the pawl is located in its ratchet checking position, wherein movement of the actuation mechanism from its cinch start position to its cinch stop position causes pivotal movement of the cinch lever which causes the pawl to forcibly rotate the ratchet from its primary striker capture position into its cinched striker capture position, wherein the movement of the actuation mechanism from its cinch start position to its cinch stop position causes the cinch lever to pivot from an uncinched position to a cinched position, wherein movement of the cinch lever from its uncinched position to its cinched position causes the pawl to move from a first pawl position to a second pawl position while being maintained in its ratchet checking position, and wherein the movement of the pawl from its first pawl position to its second pawl position causes the ratchet to move from its primary striker capture position into its cinched striker capture position.

In accordance with the latch assembly noted above, the latch cinch mechanism further includes a pawl lever moveable relative to the ratchet between an Open pawl lever position when the ratchet is positioned in its striker release position and a Closed pawl lever position when the ratchet is positioned in one of its primary and cinched striker capture positions, and a biasing spring for normally biasing the pawl lever toward its Closed pawl lever position, wherein the pawl lever includes a guide slot retaining a follower pin that is fixed to the pawl, the guide slot configured to guide movement of the pawl between its first and second pawl positions while the pawl lever is positioned in its Closed pawl lever position. The latch assembly is further configured such that the ratchet includes a closing notch and the pawl includes an engagement flange adapted to engage the closing notch when the pawl is located in its ratchet checking position and which is also adapted to disengage the closing notch when the pawl is located in its ratchet release position, wherein the engagement flange on the pawl maintains engagement with the closing notch on the ratchet during movement of the pawl from its first pawl position to its second pawl position, and wherein movement of the pawl lever from its Closed pawl lever position to its Open pawl lever position causes the pawl to move from its ratchet checking position to its ratchet release position.

In accordance with the latch assembly noted above, a power releasing function is provided by moving the actuation mechanism in a releasing direction from its cinch stop position toward its cinch start position which causes the pawl lever to move from its Closed pawl lever position to its Open pawl lever position for releasing the engagement flange from the closing notch, whereby the ratchet is permitted to rotate to its striker release position. The power releasing function includes a soft opening feature operable for uncinching the ratchet prior to release of the pawl engagement flange from the ratchet closing notch, the soft opening feature provided by moving the actuation mechanism in the releasing direction from its cinch stop position toward its cinch start position for moving the ratchet from its cinched striker capture position into an uncinched striker capture position before the pawl is permitted to move into its ratchet release position. In addition, a latch release mechanism is provided for moving the pawl lever from its Closed pawl lever position to its Open pawl lever position upon rotation of the ratchet to its uncinched striker capture position, wherein movement of the pawl lever to its Open pawl lever position causes the pawl to move from its ratchet checking position into its ratchet release position for disengaging the pawl engagement flange from the ratchet closing notch. The latch release mechanism includes a release lever configured to move from a Rest position into a Release position in response to movement of the actuation mechanism in the releasing direction from the cinch stop position to a cinch release position, wherein movement of the release lever to its Release position causes the pawl lever to move from its Closed pawl lever position to its Open pawl lever position.

Further areas of applicability will become apparent from the detailed description provided herein. The description and specific examples in this summary are intended for purposes of illustration only and are not intended to limit the scope of the present disclosure.

DRAWINGS

The drawings described herein are for illustrative purposes only of selected embodiments and not all possible implementations such that the drawings are not intended to limit the scope of the present disclosure.

Figure 2A:
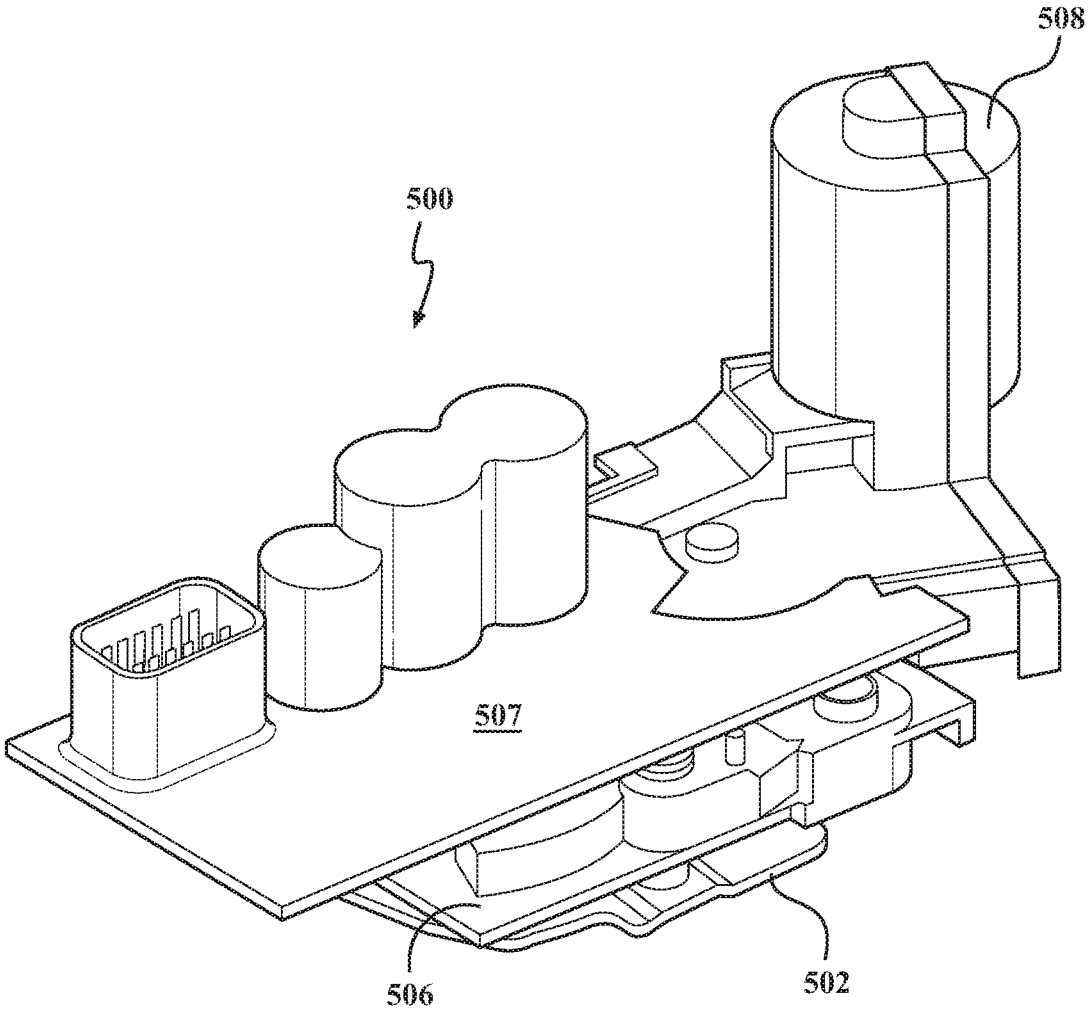
FIGS. 2A and 2B are exploded pictorial views of a one-motor power latch assembly constructed in accordance with an embodiment of the present disclosure.
Figure 2B:
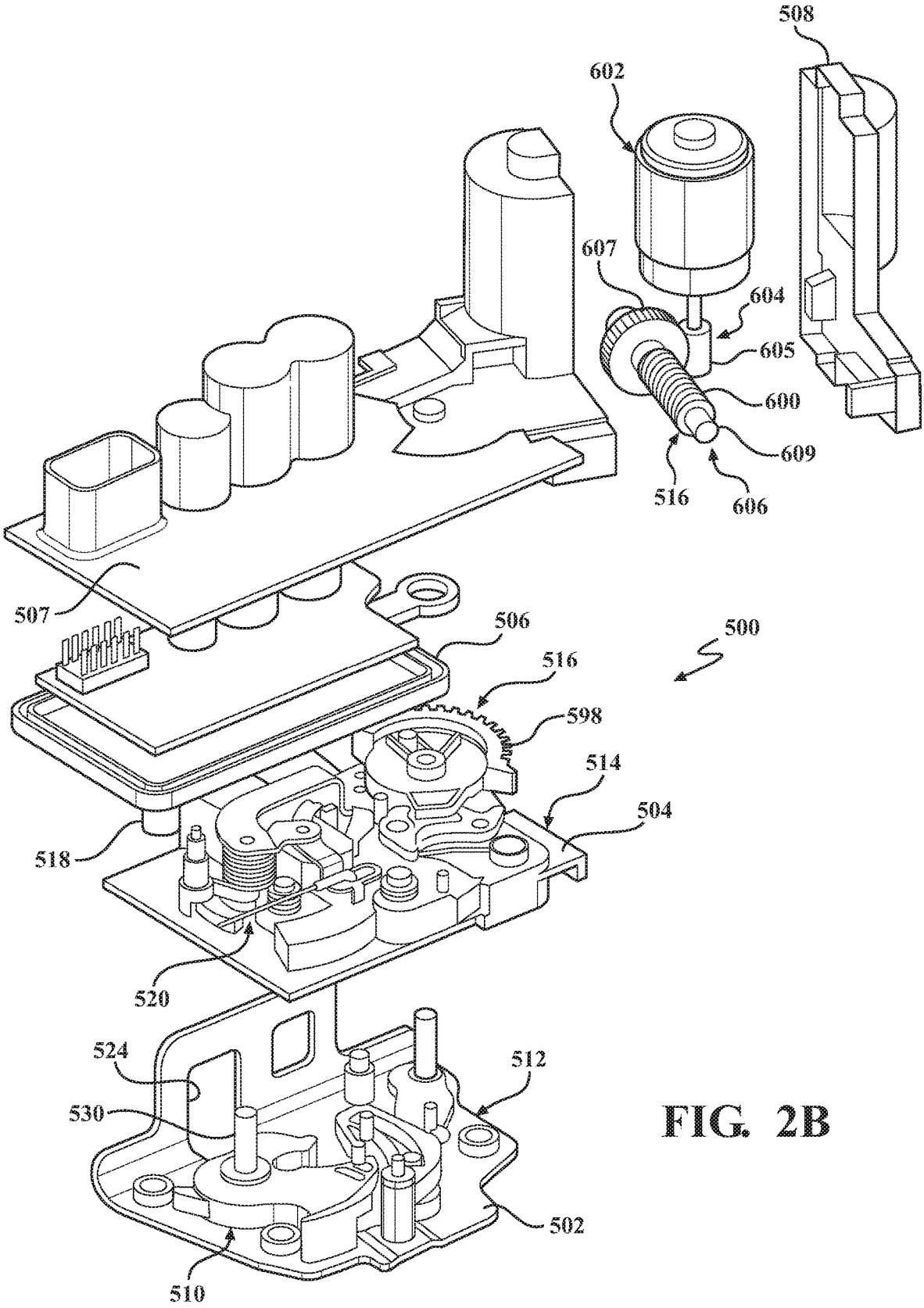
Figure 3A:
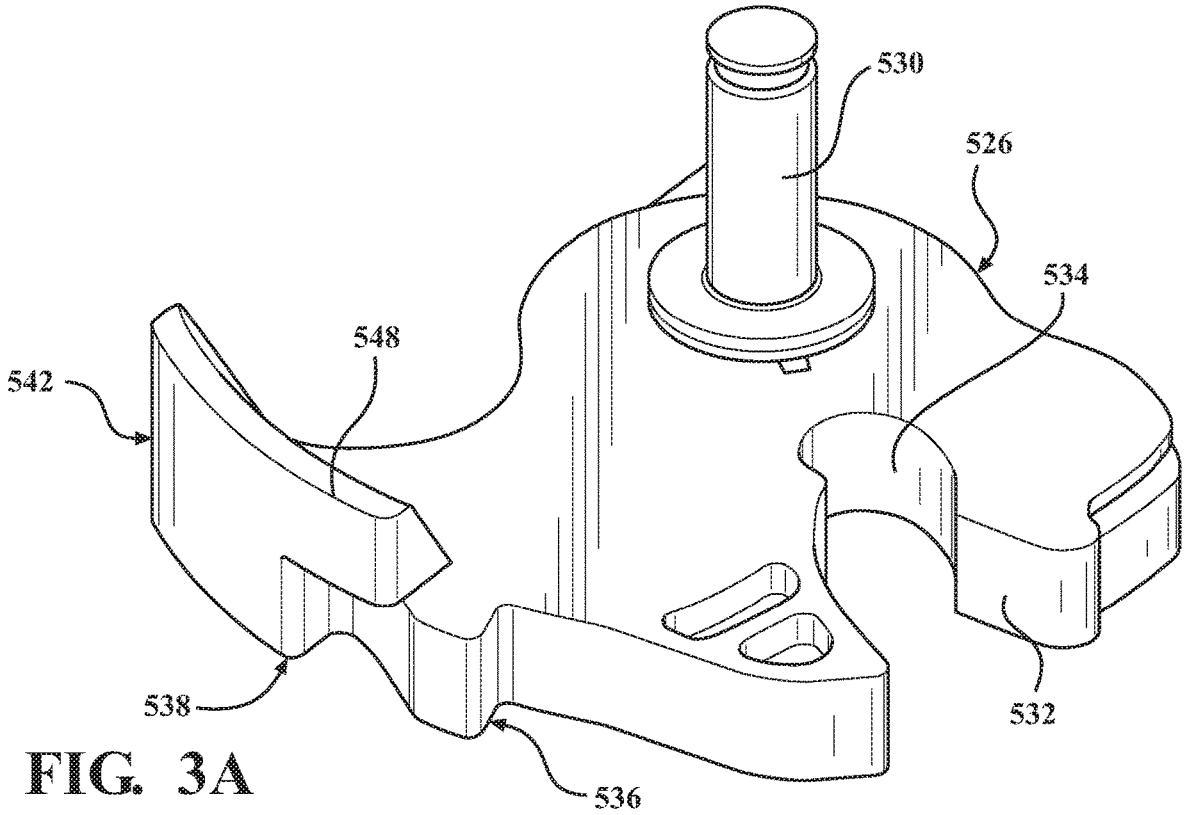
FIGS. 3A through 3C illustrate a ratchet associated with a latch mechanism used in the one-motor power latch assembly shown in FIGS. 2A and 2B.
Figure 3B:
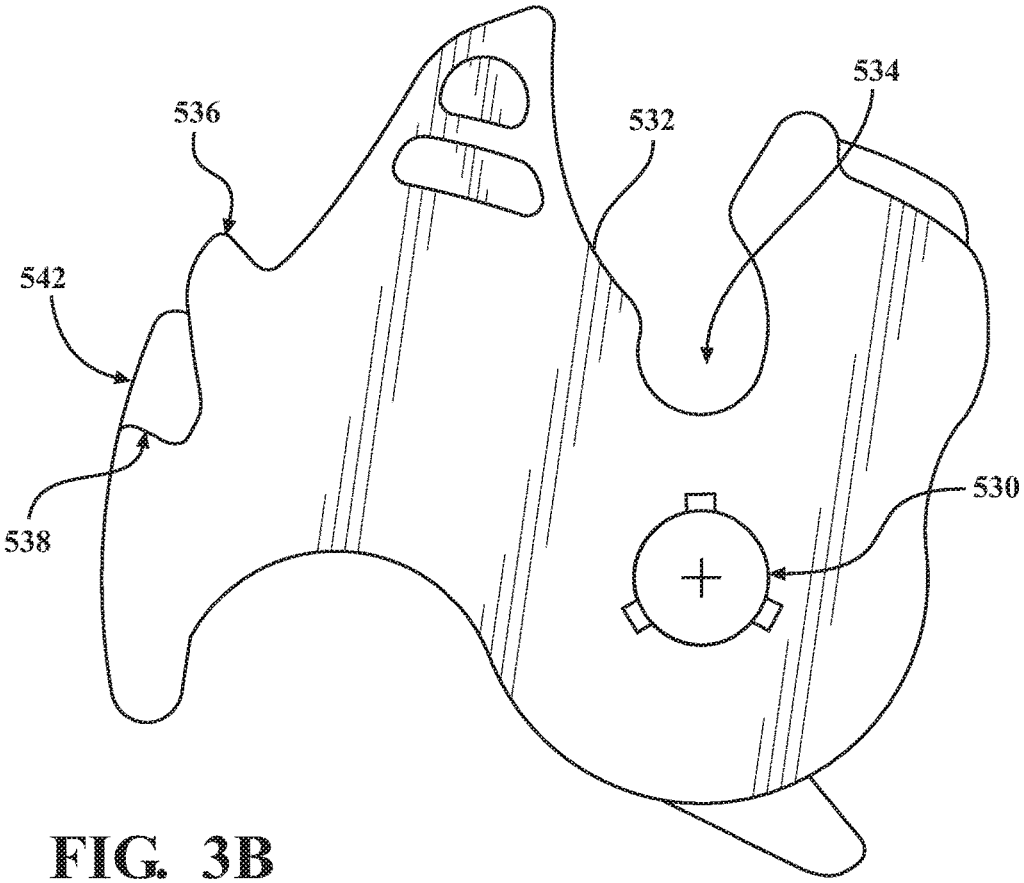
Figure 3C:
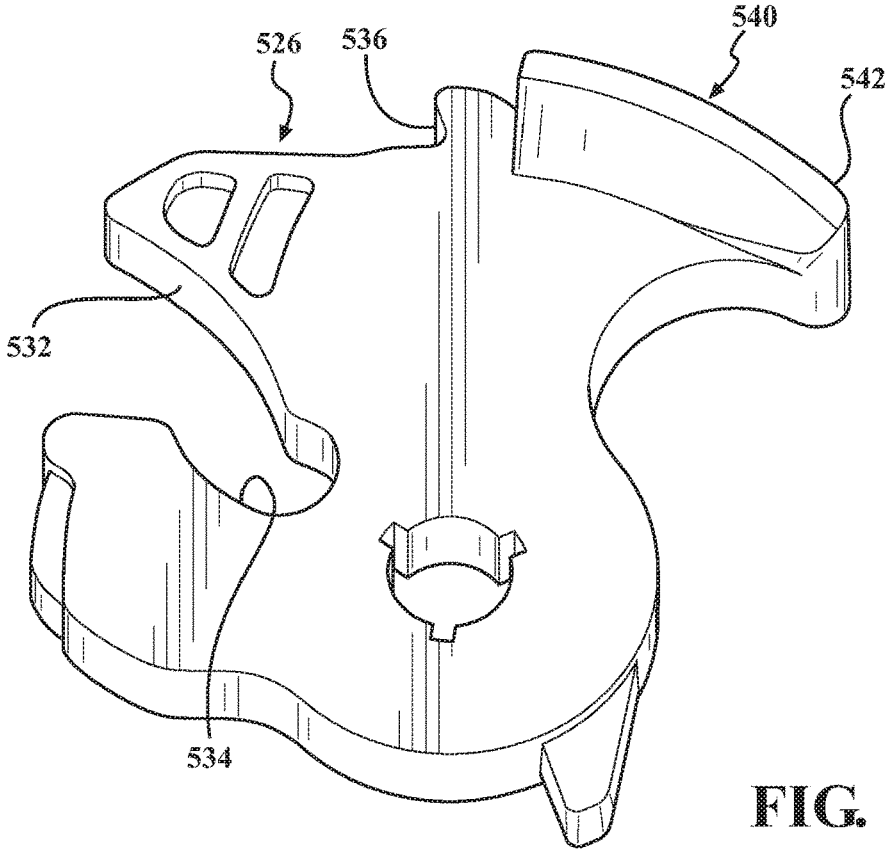
Figure 8A:
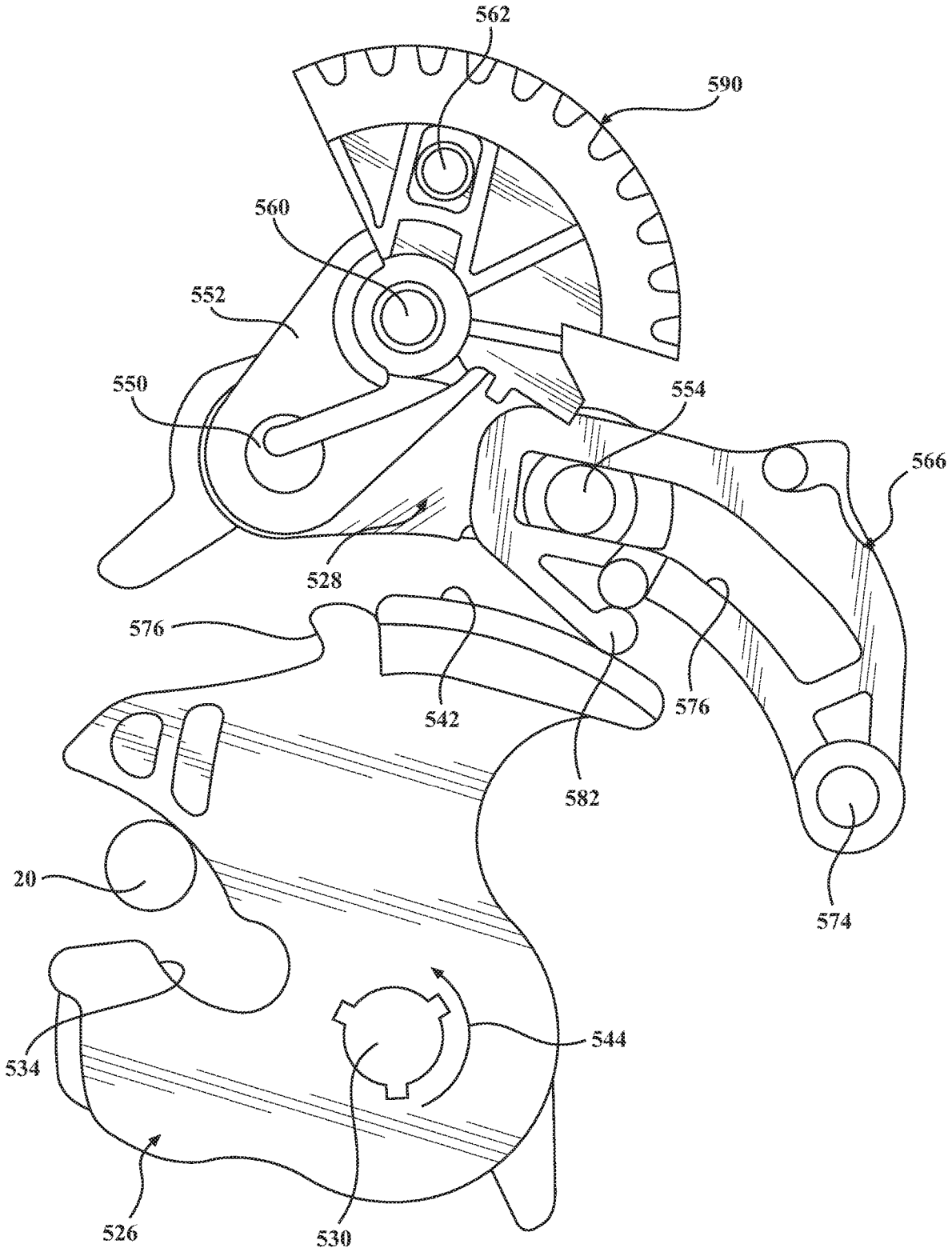
Figure 8B:
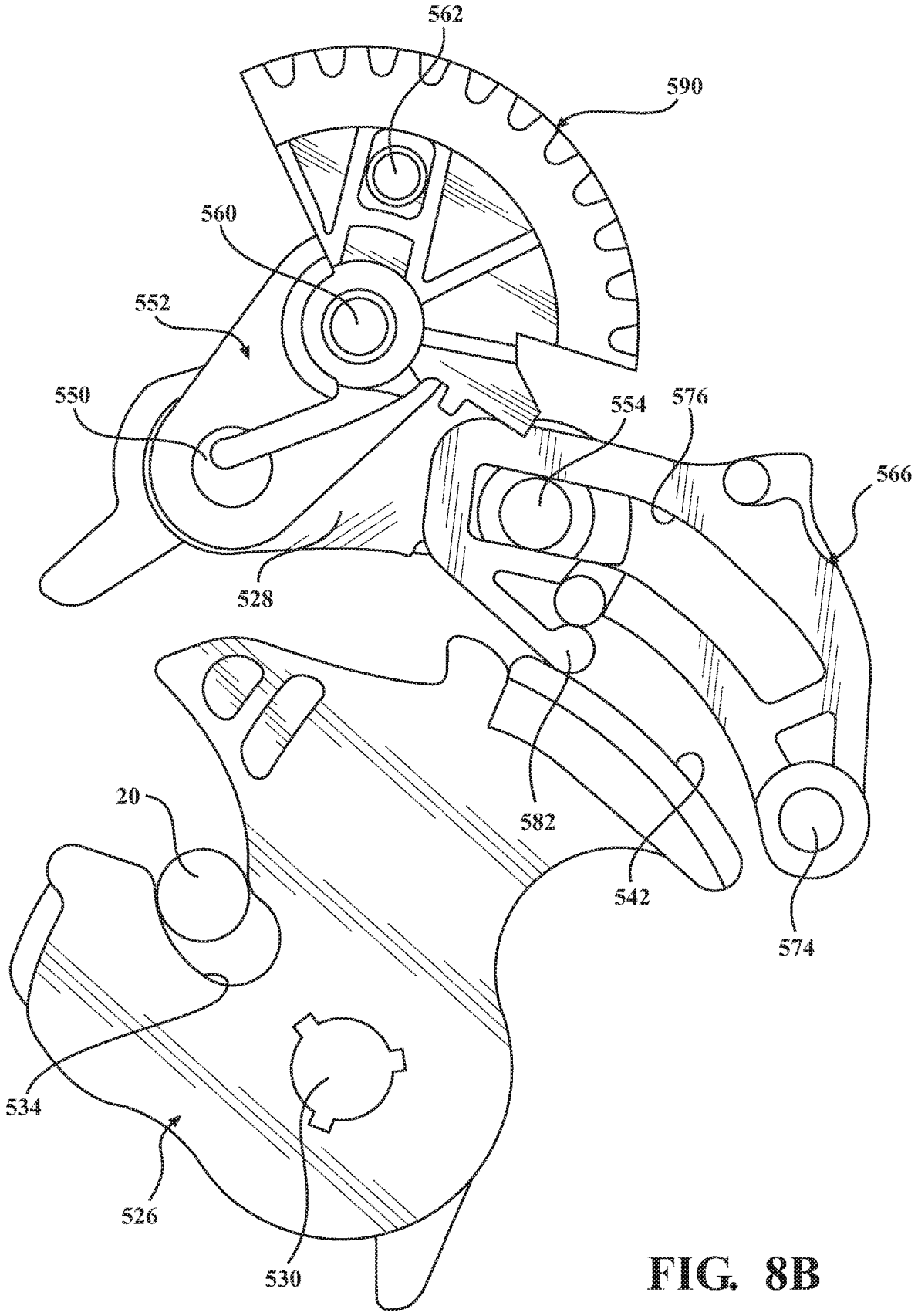
Figure 8C:
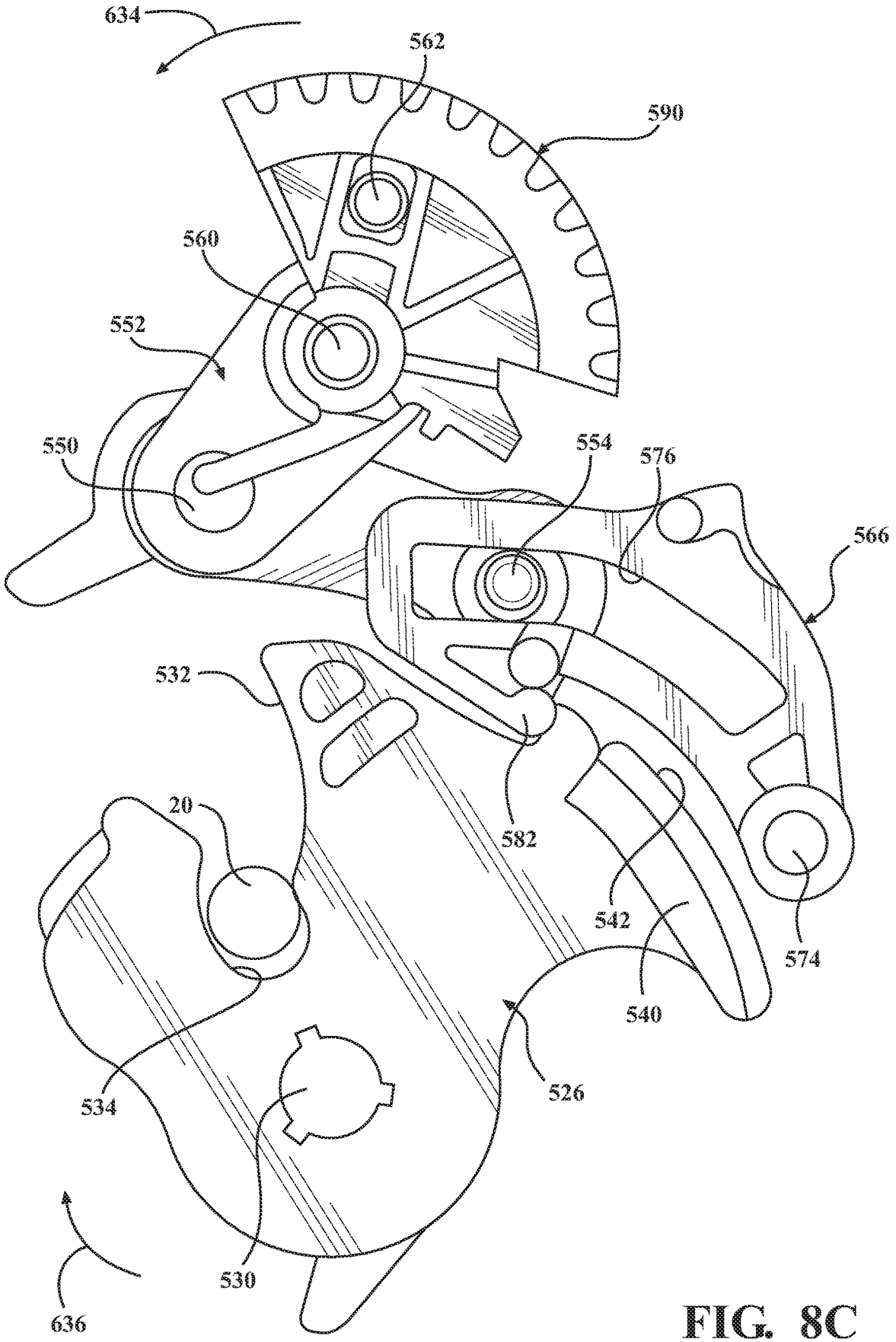
Figure 8D:
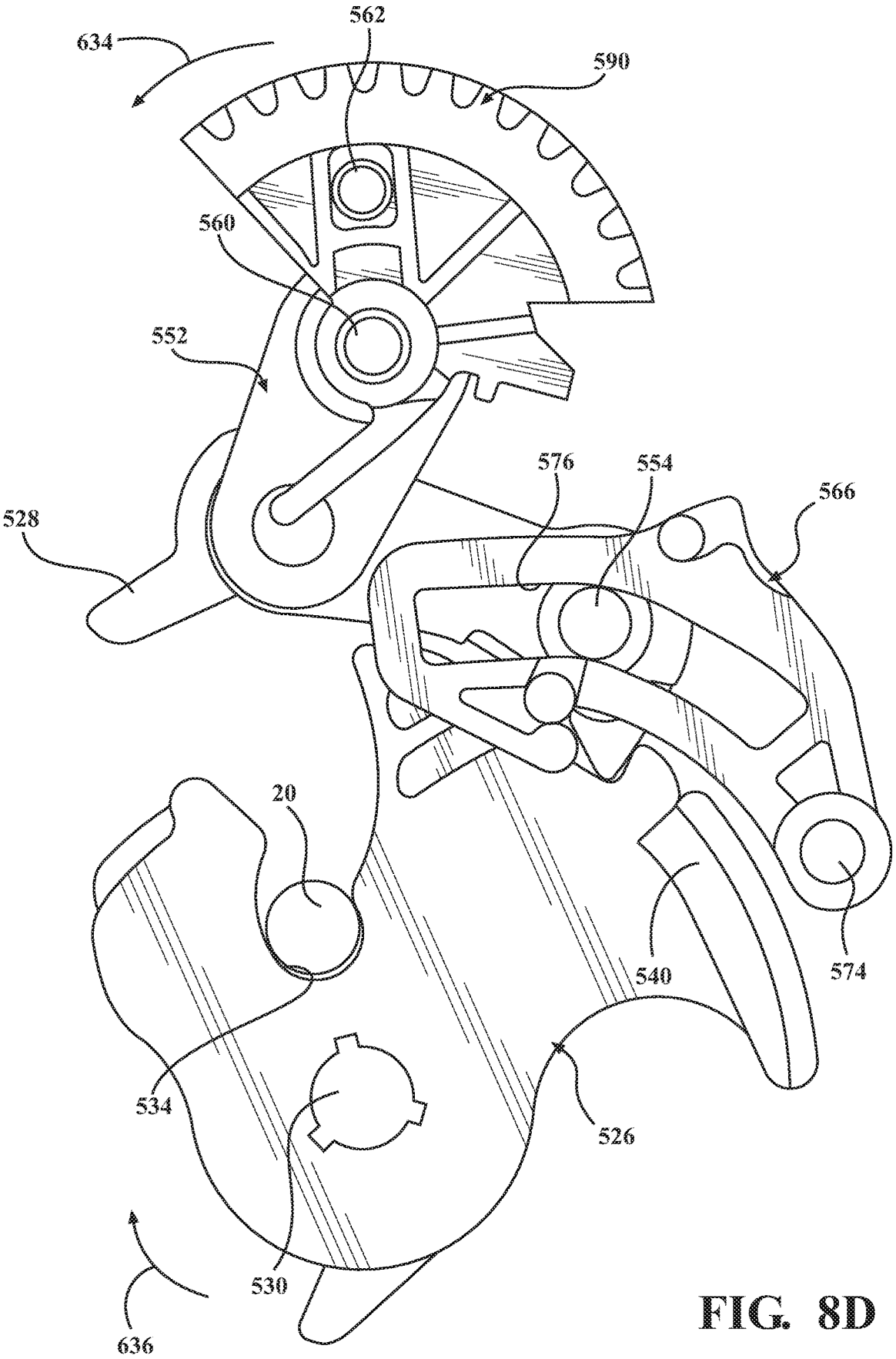
Figure 8E:
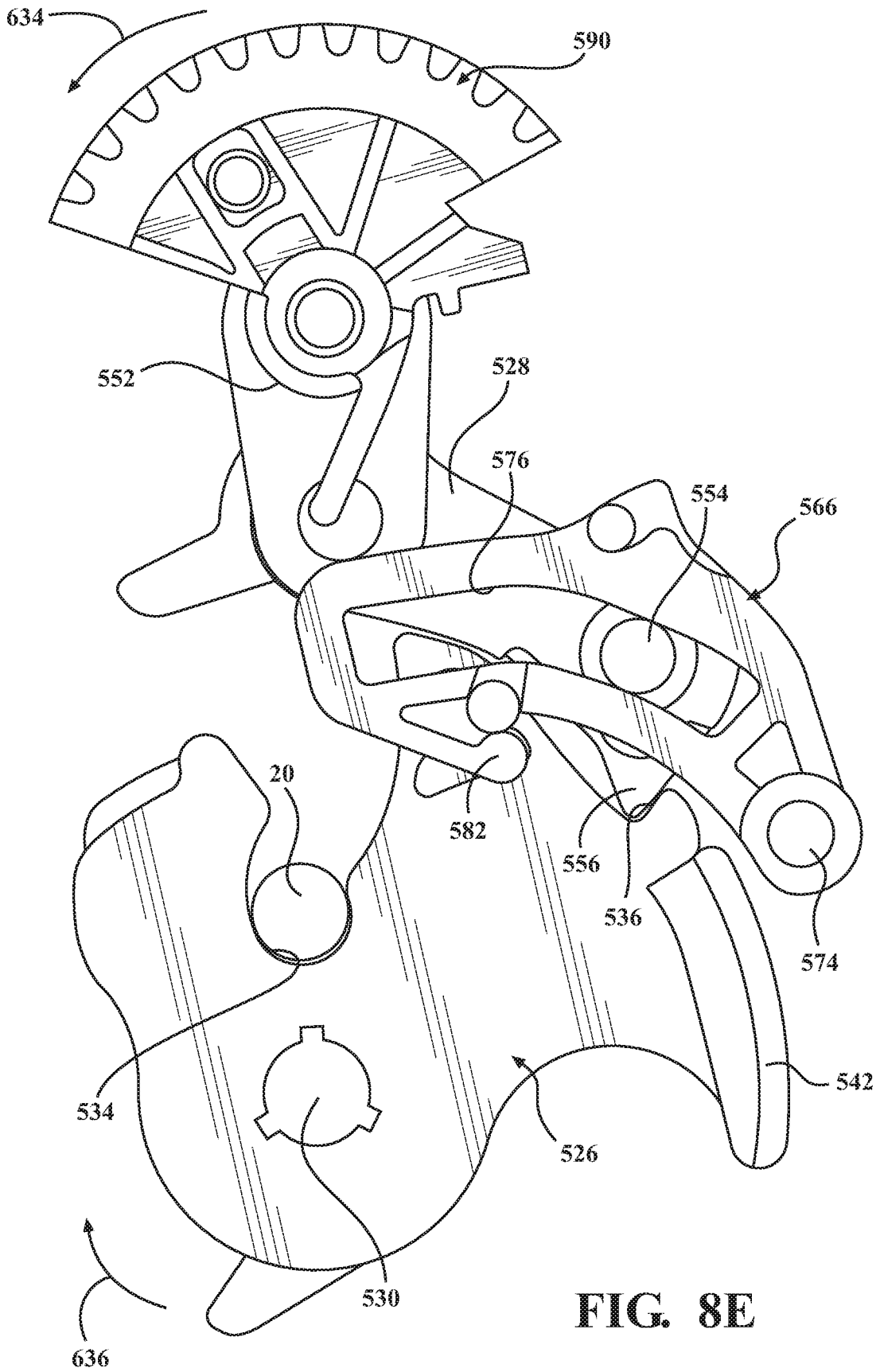
Figure 8F:
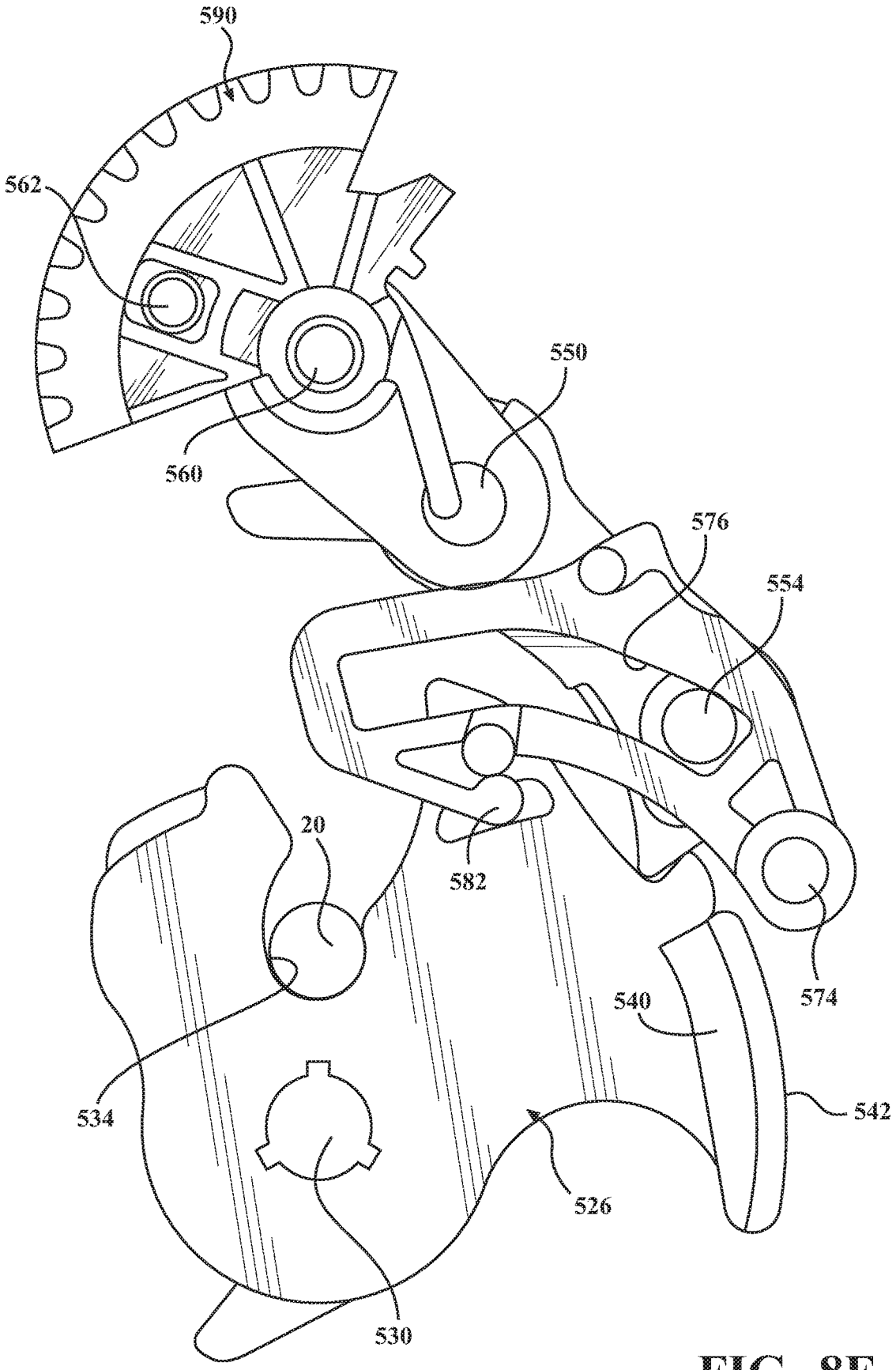
Figure 10A:
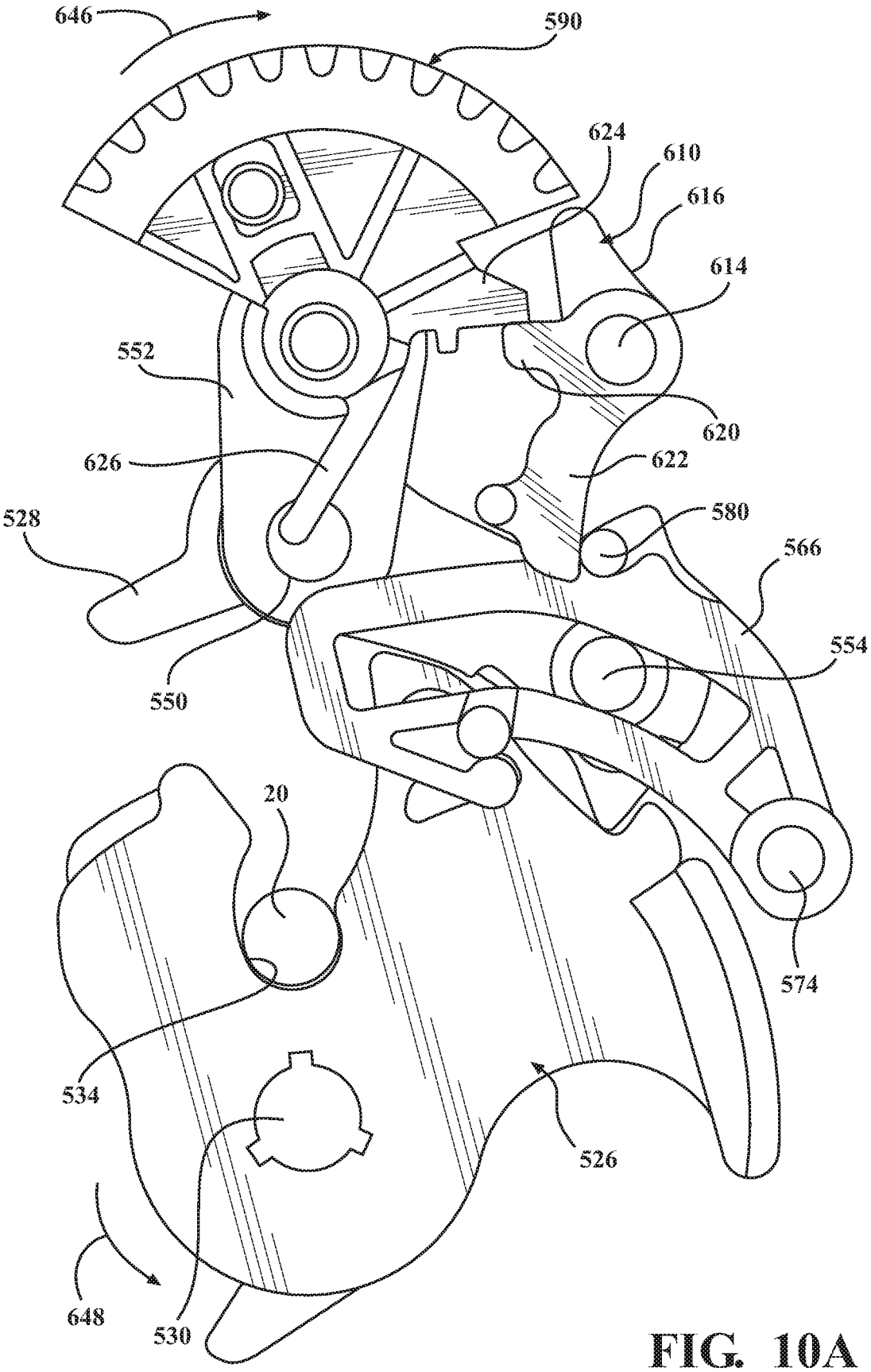
Figure 10B:
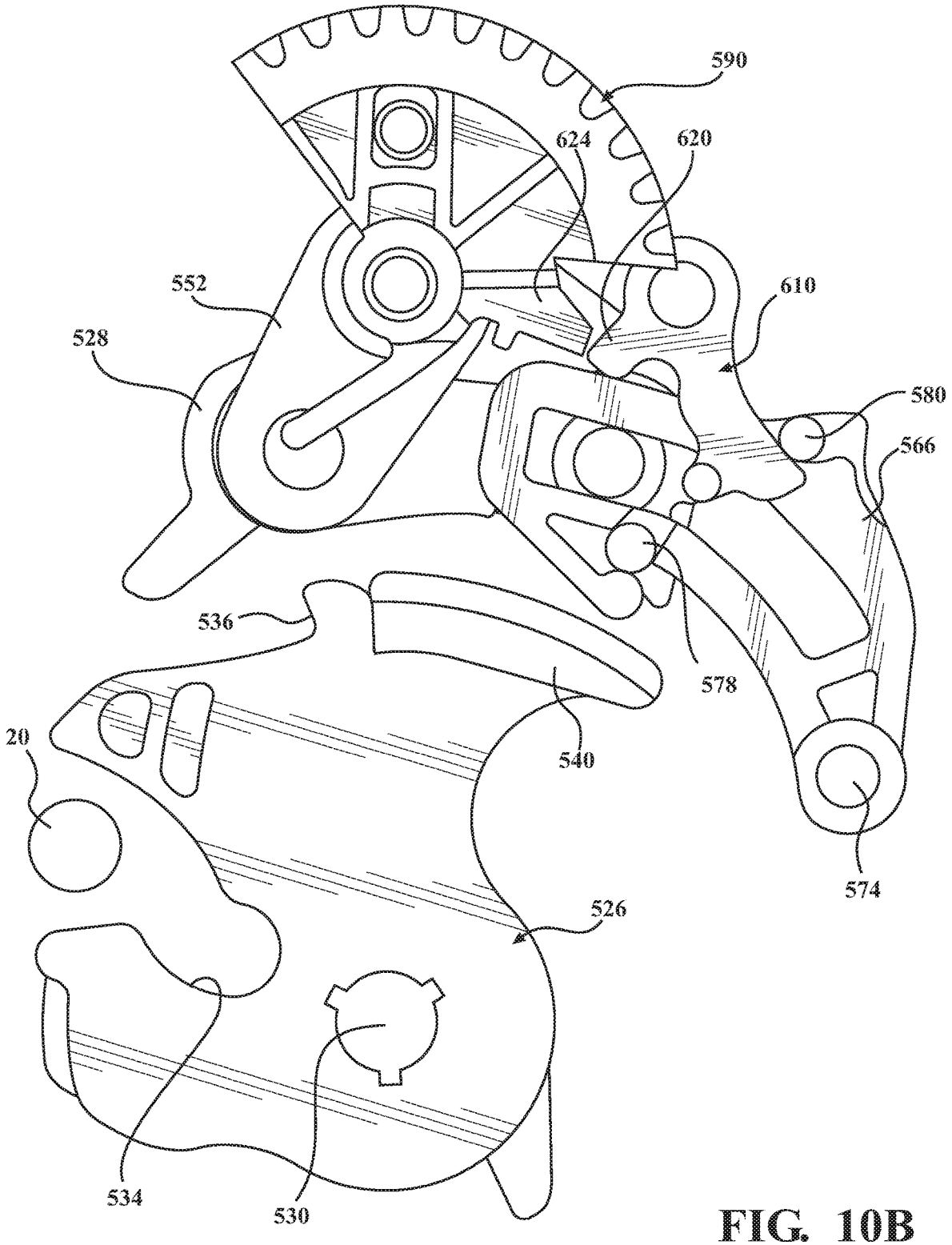
Figure 11A:
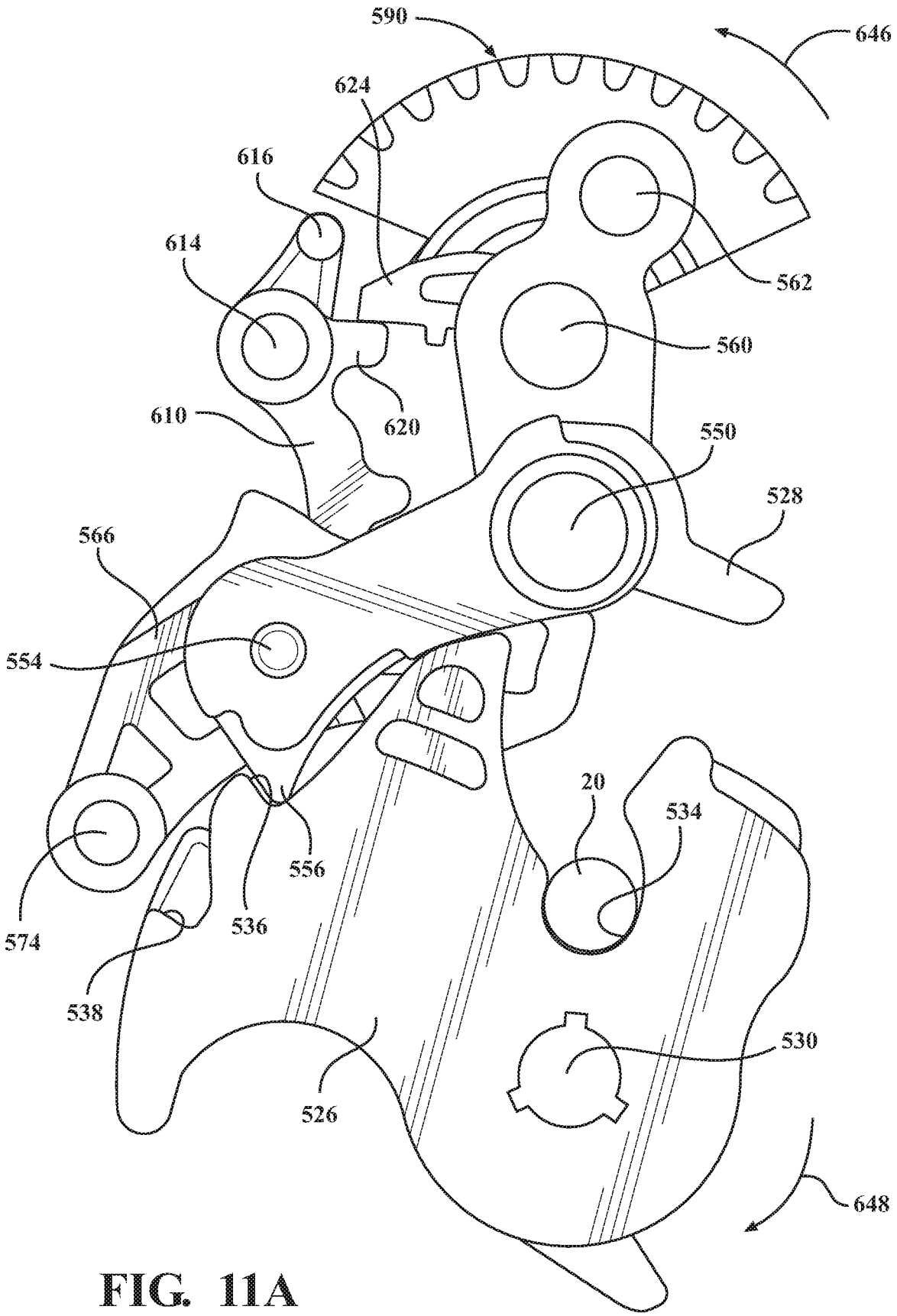
Figure 11B:
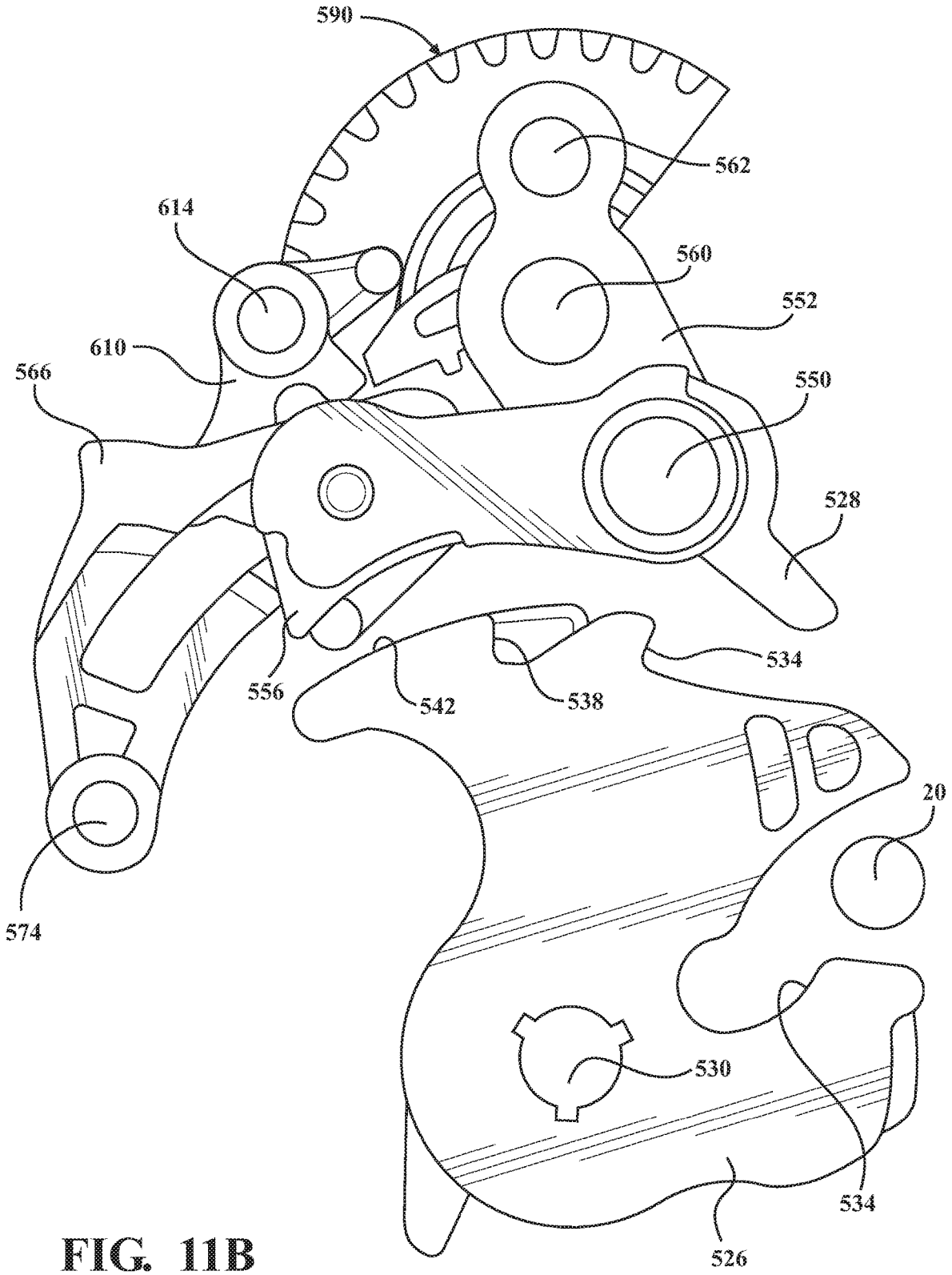
Figure 12A:
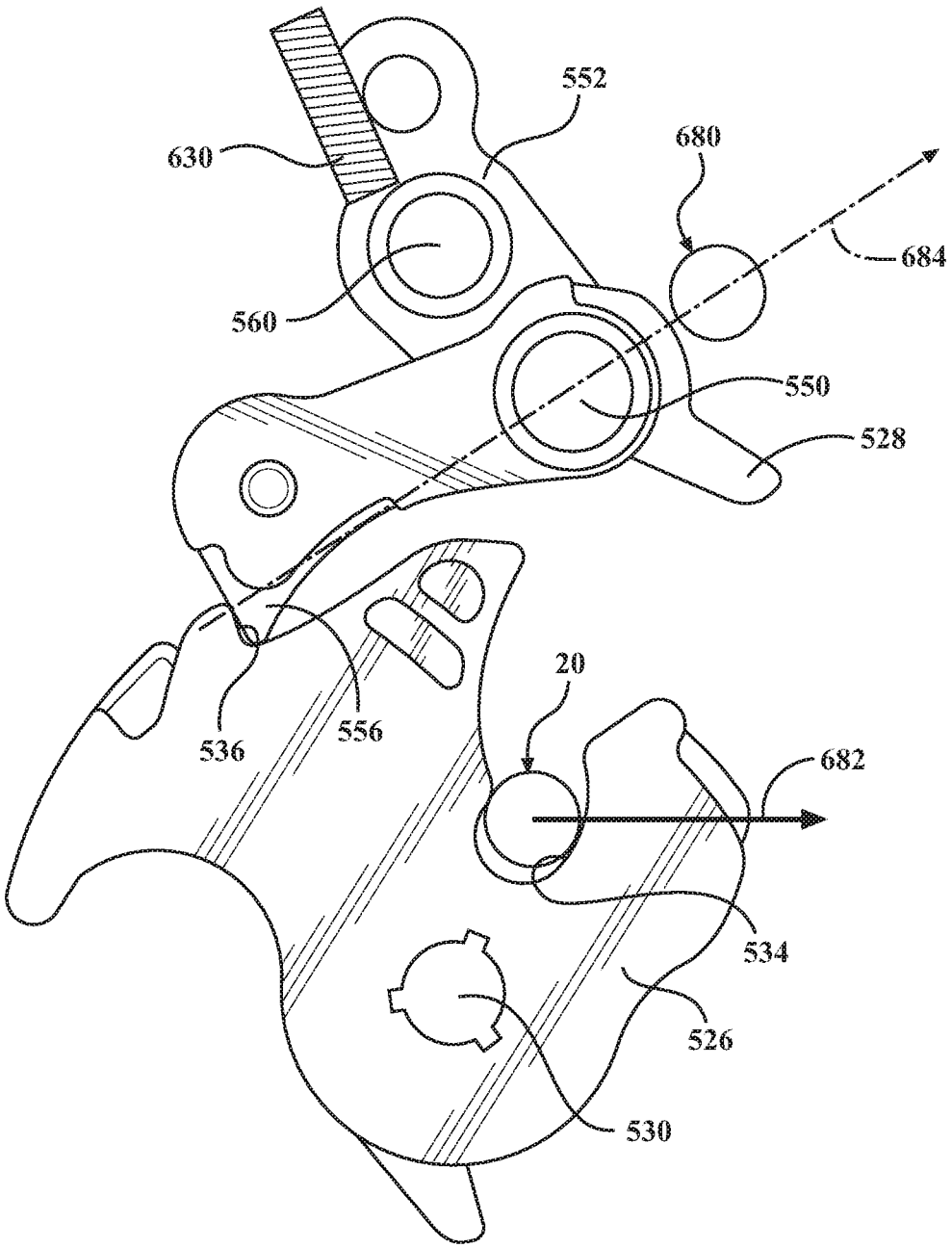
Figure 12B:
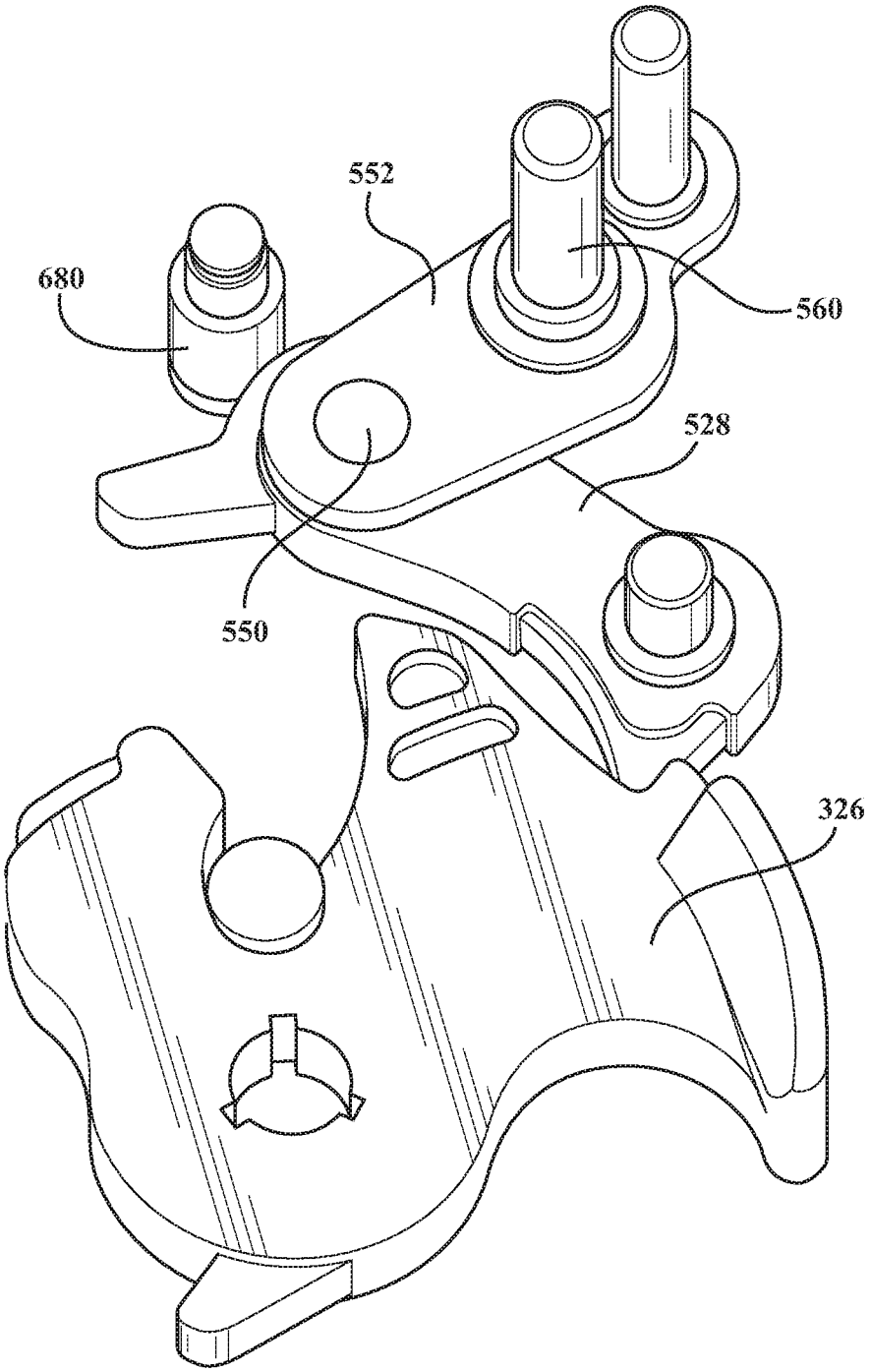
Figure 13:
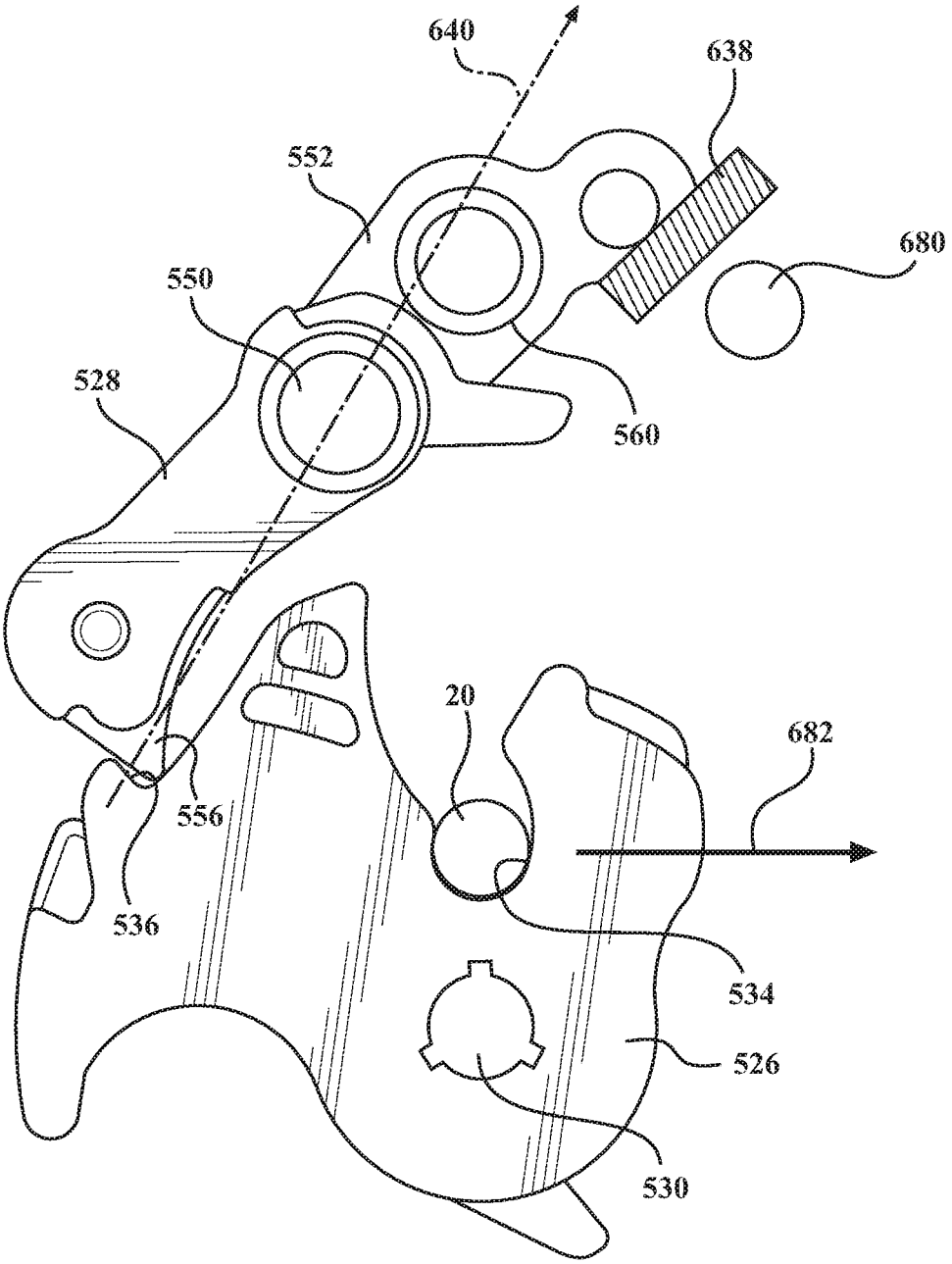
Figure 14A:
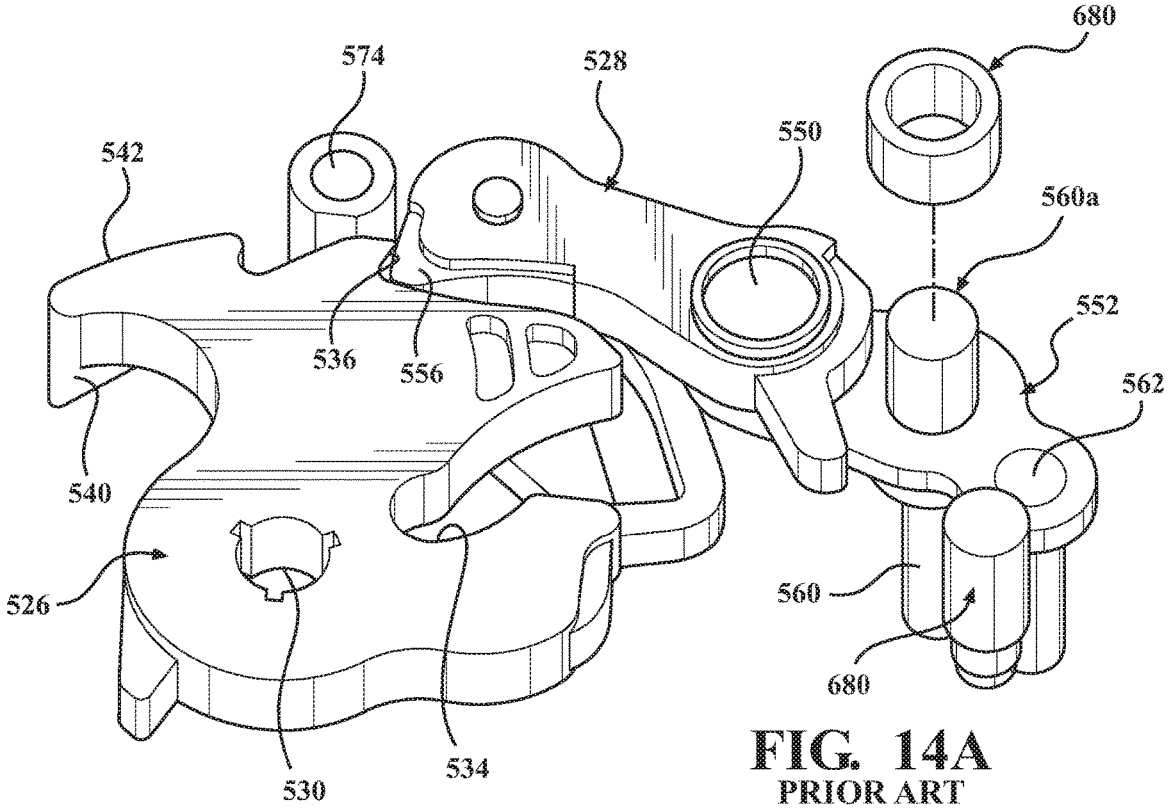
FIG. 14A PRIOR ART
Figure 14B:
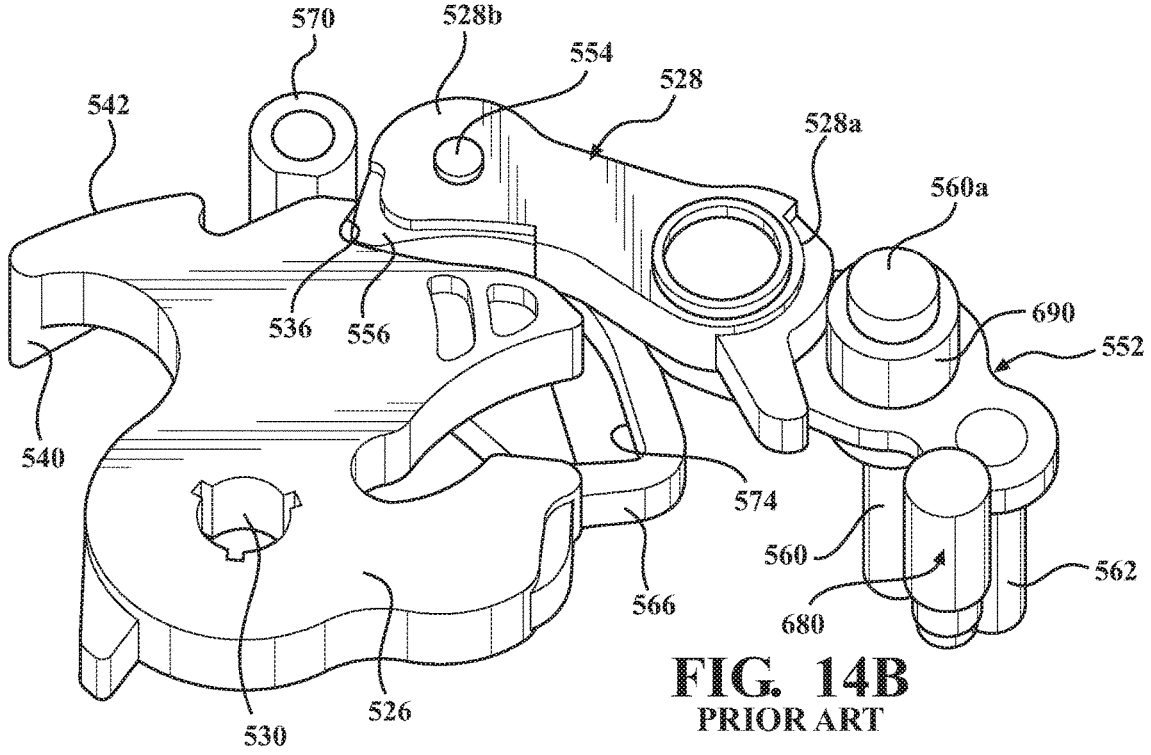
FIG. 14B PRIOR ART
Figure 15C:
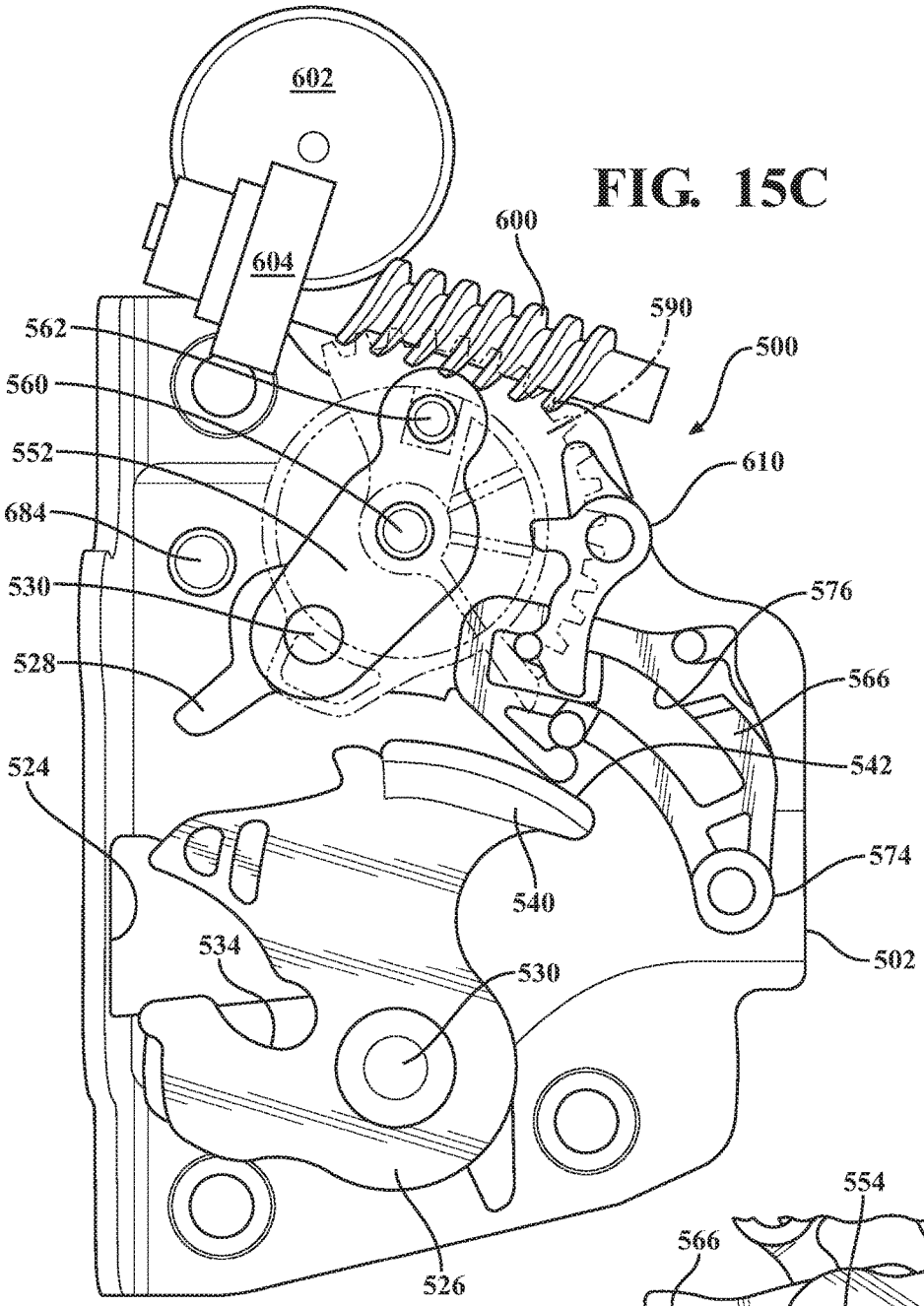
Figure 15D:
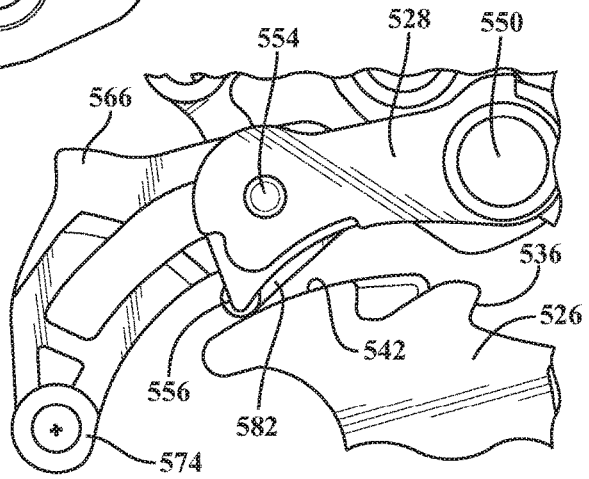
Figure 16A:
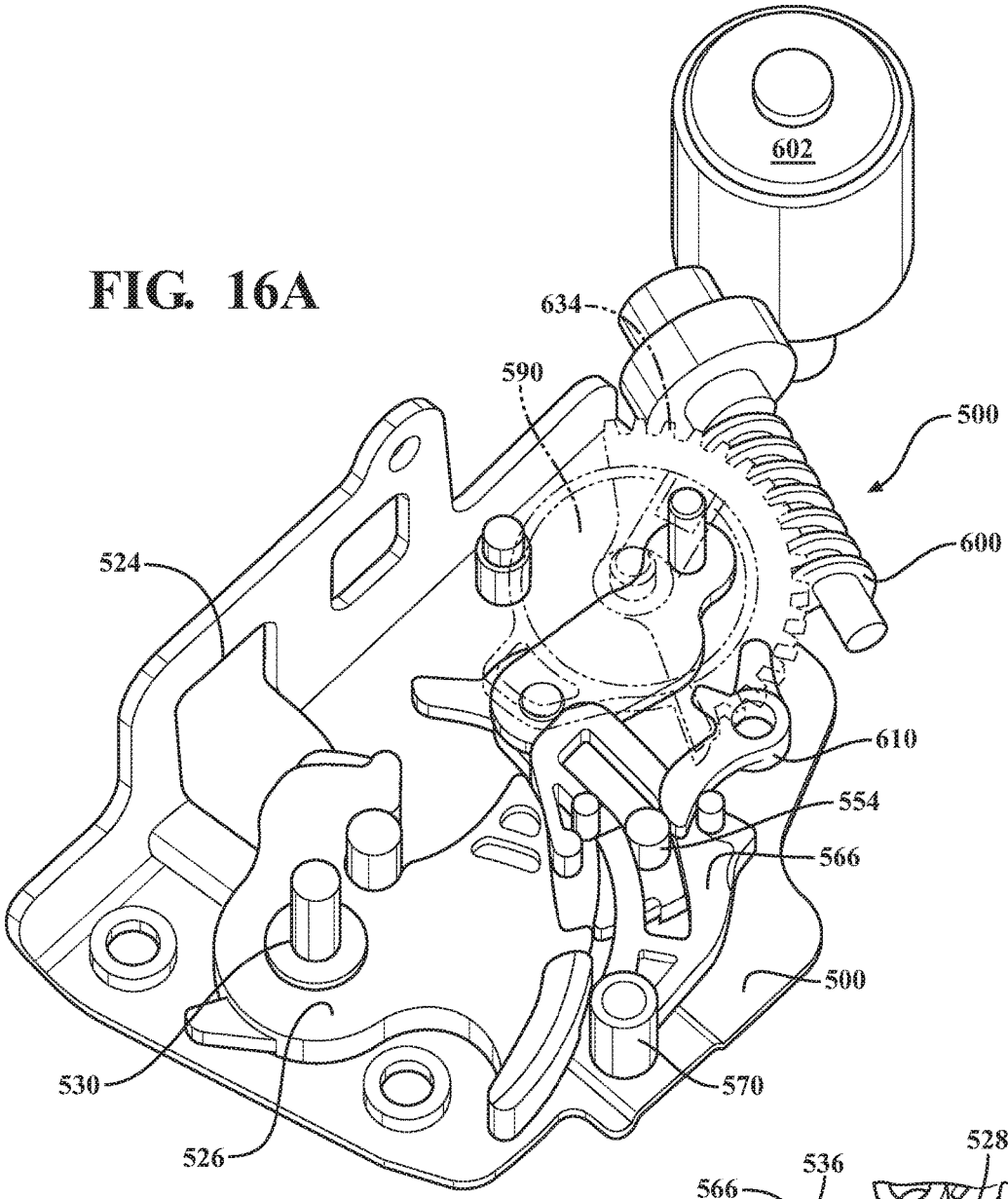
Figure 16B:
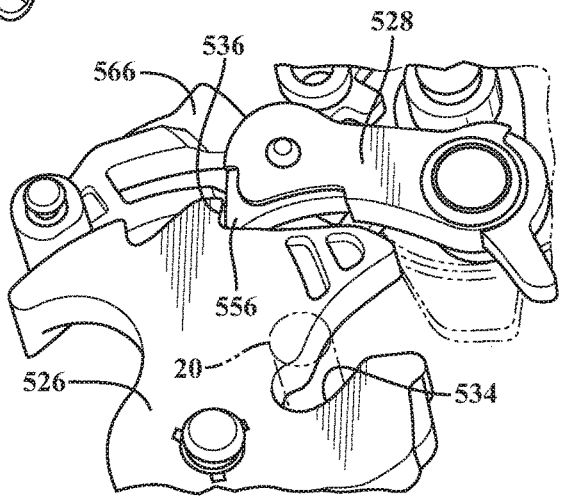
Figure 16C:
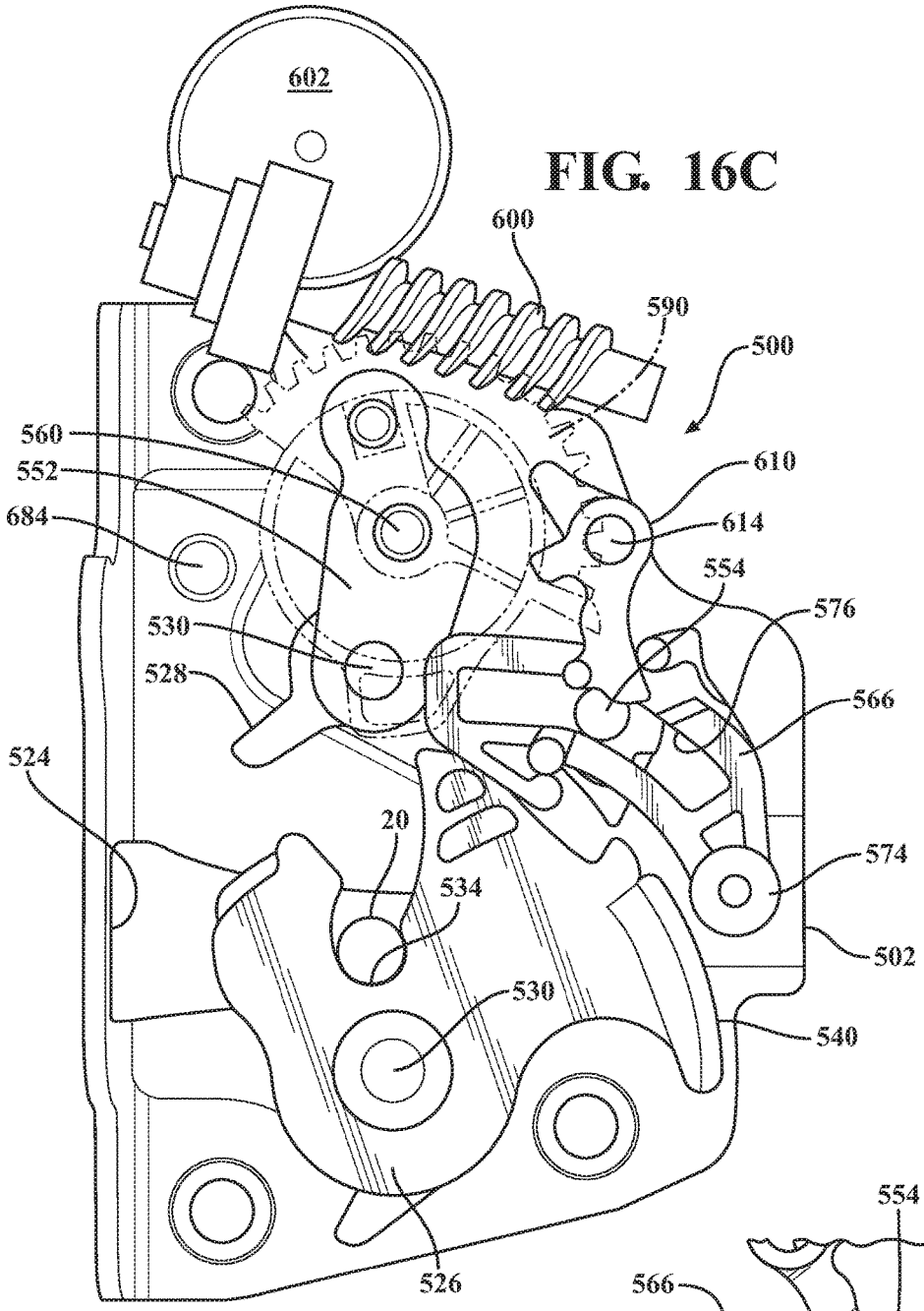
Figure 16D:
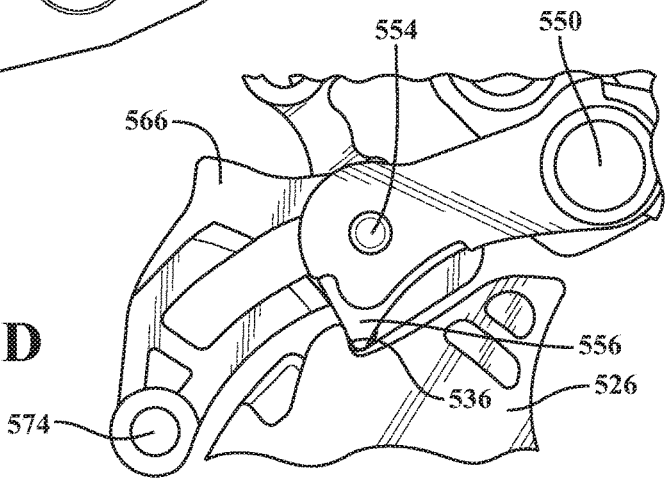
Figure 21A:
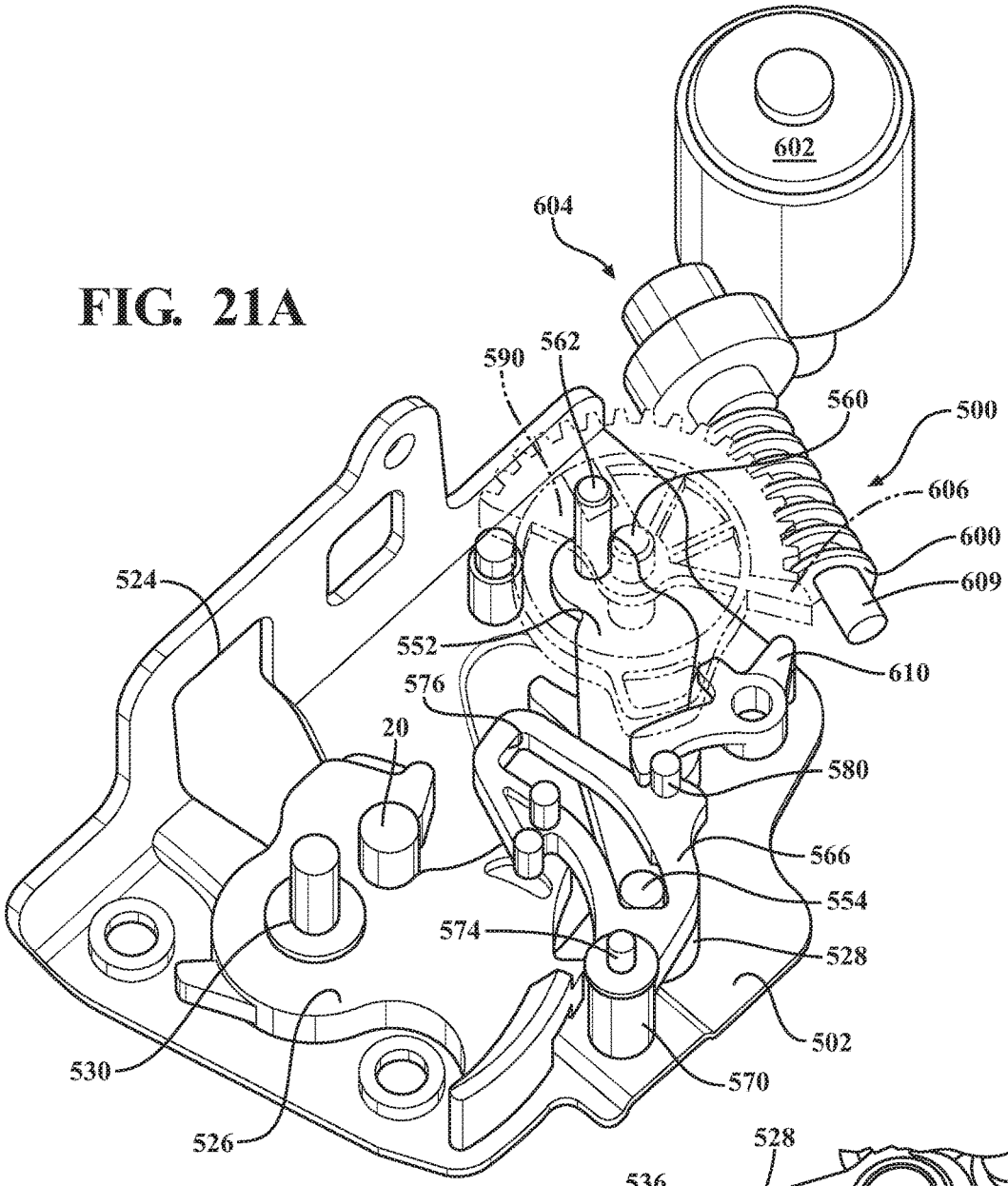
Figure 21B:
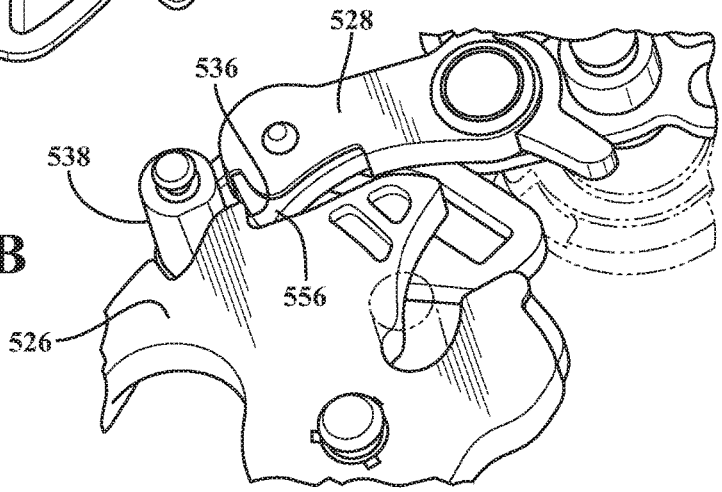
Figure 21C:
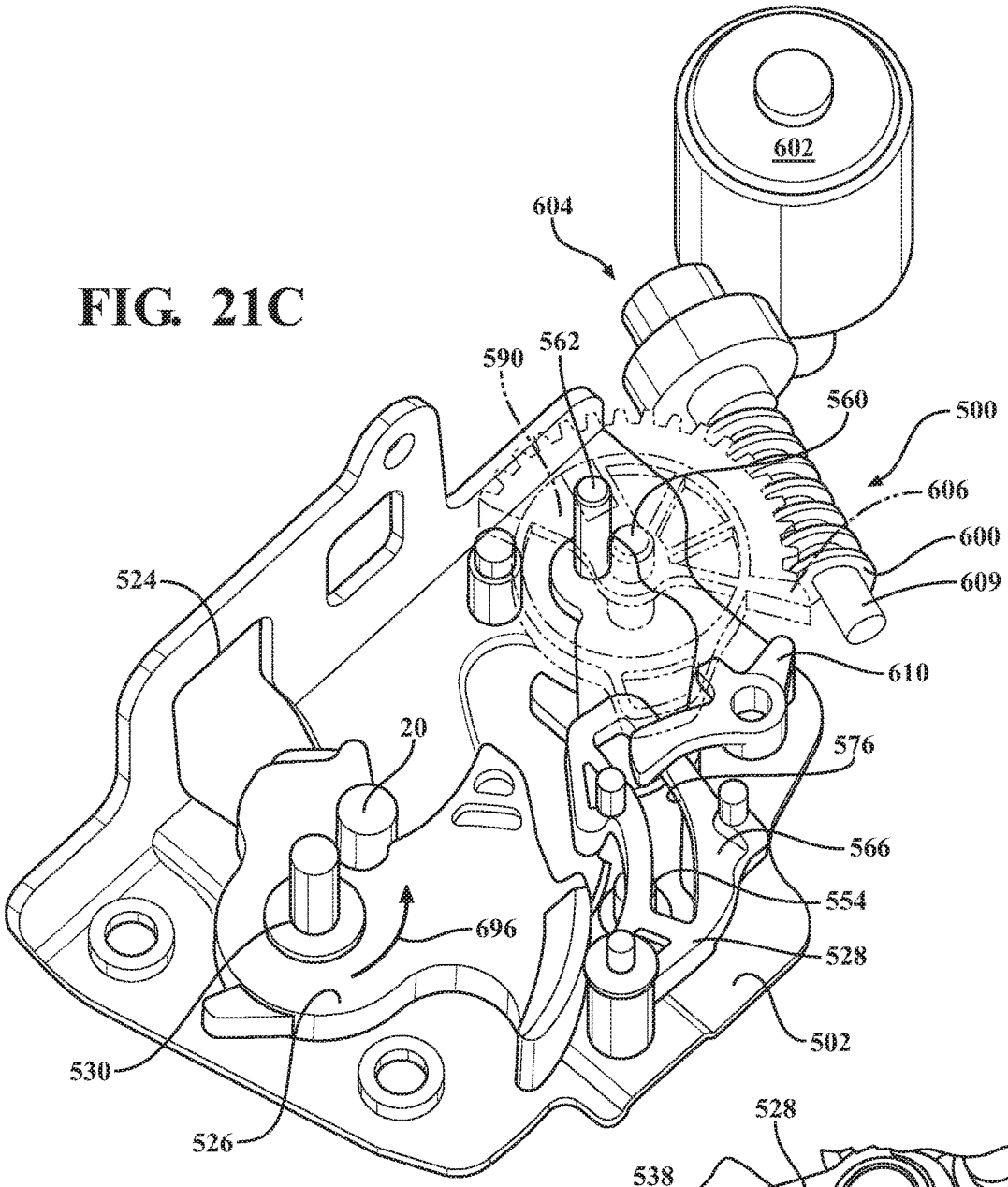
Figure 21D:
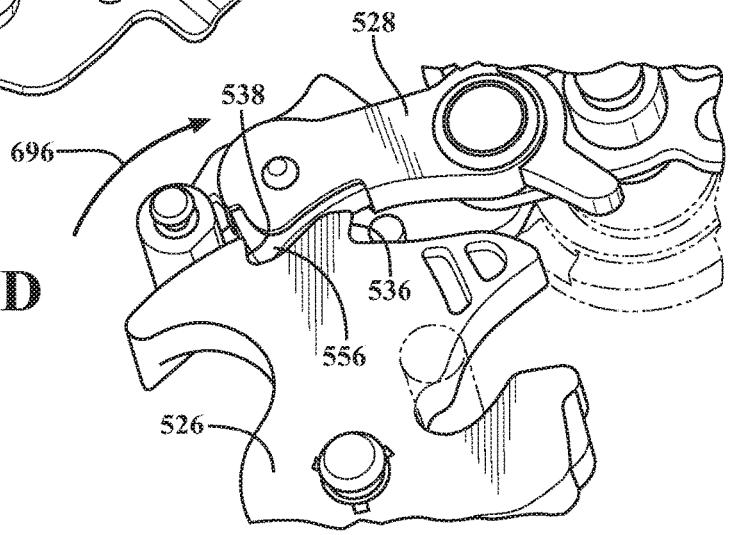
Figure 22A:
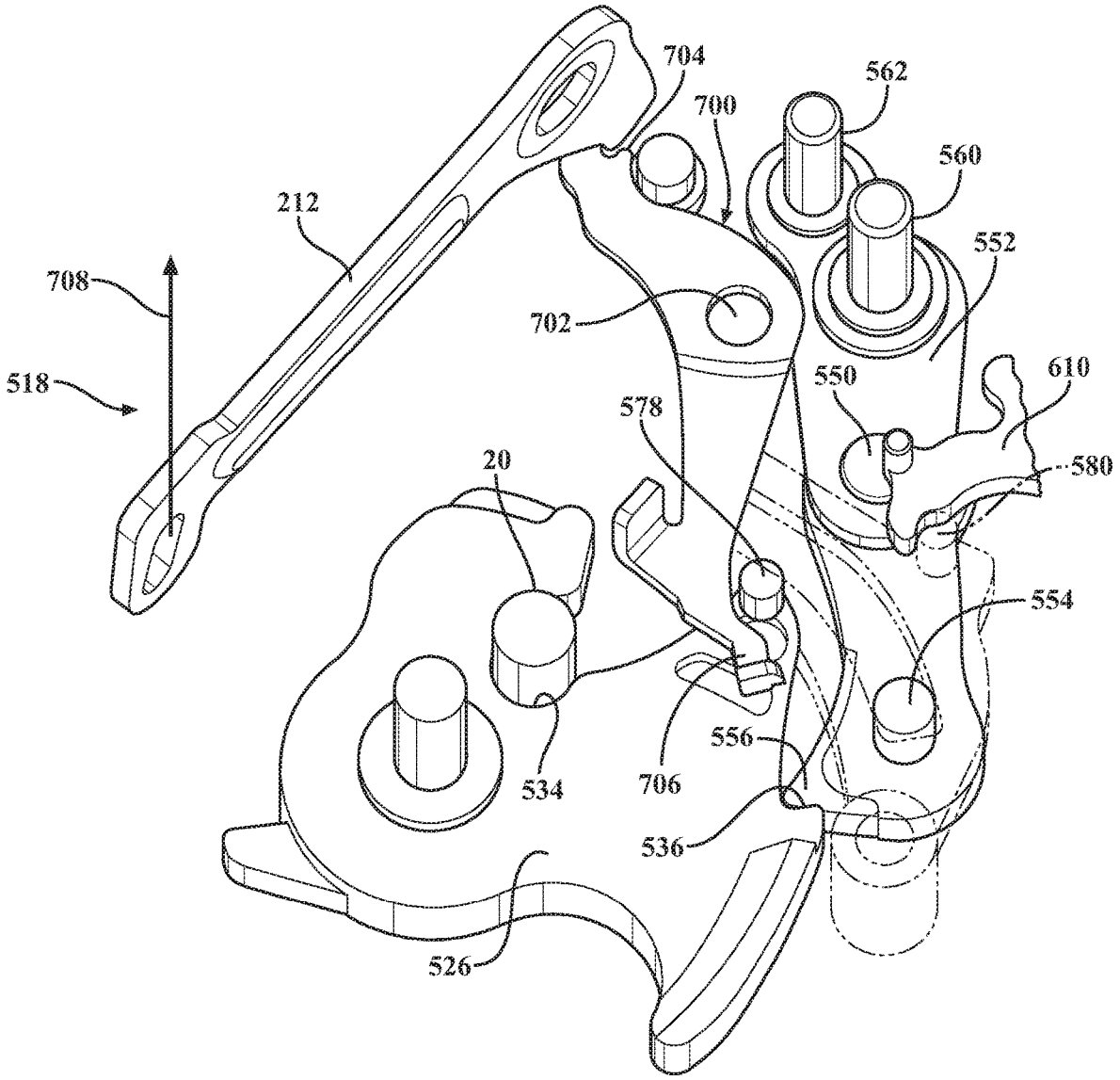
Figure 22B:
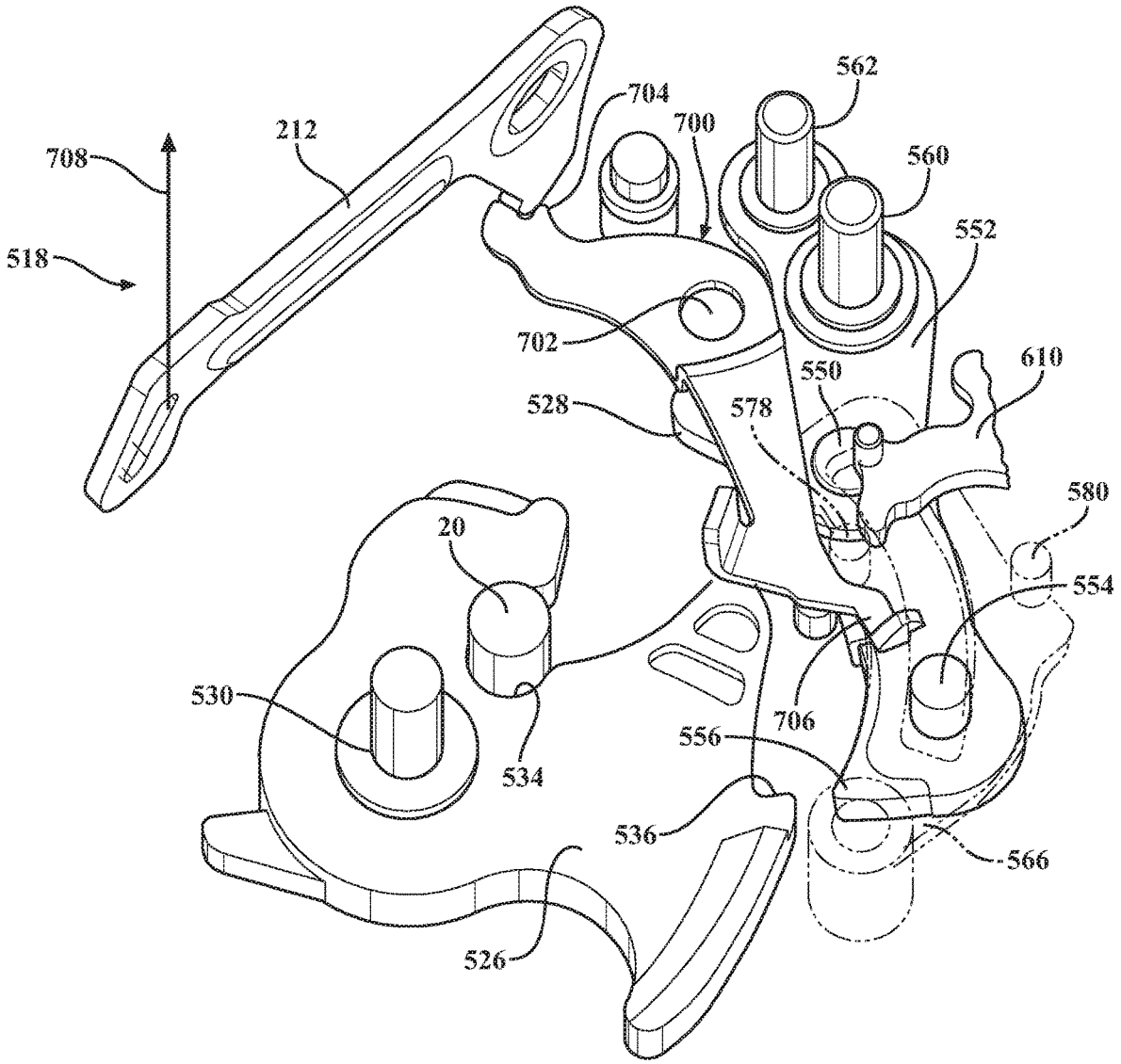
Figure 22C:
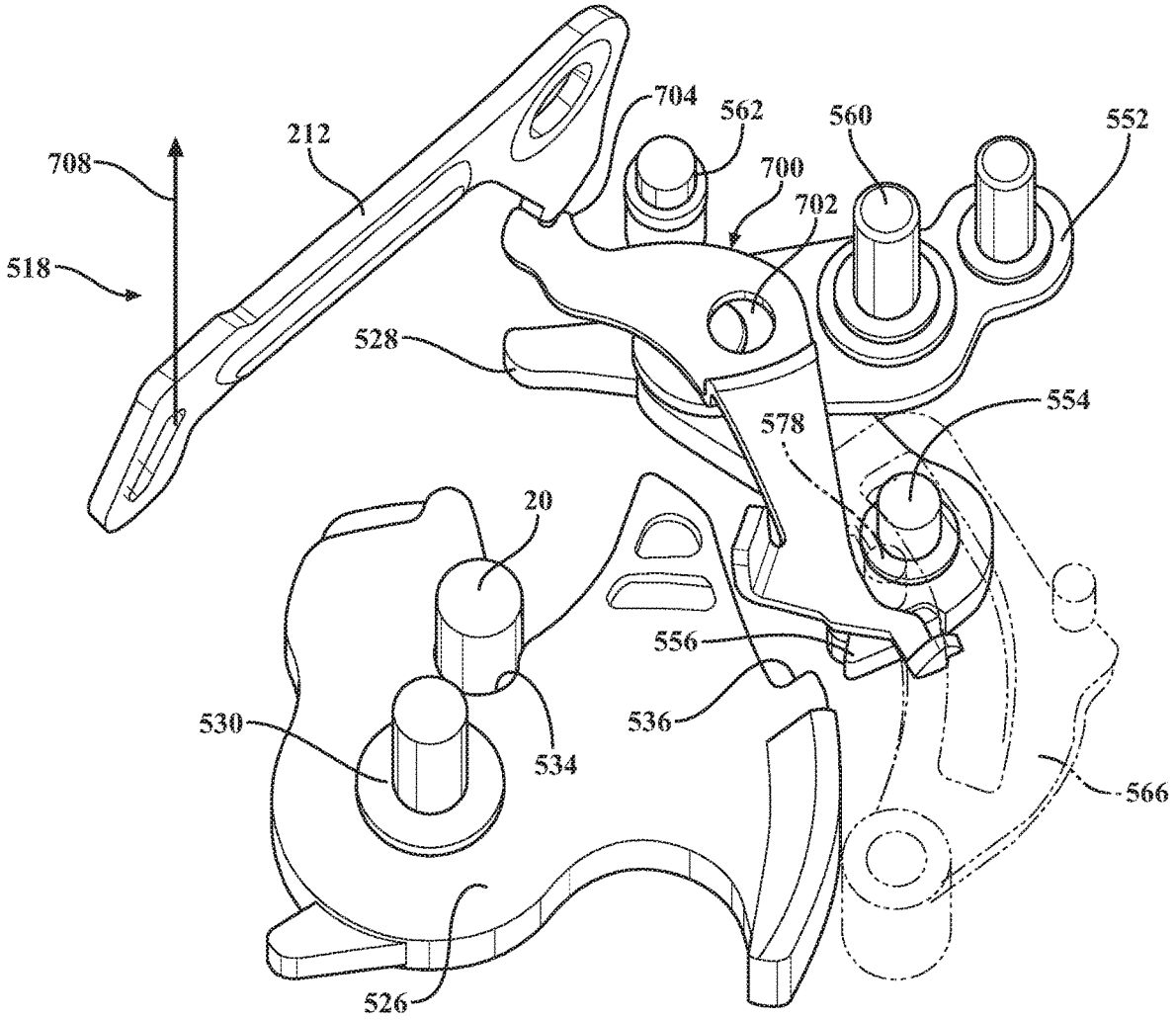
Figure 23A:
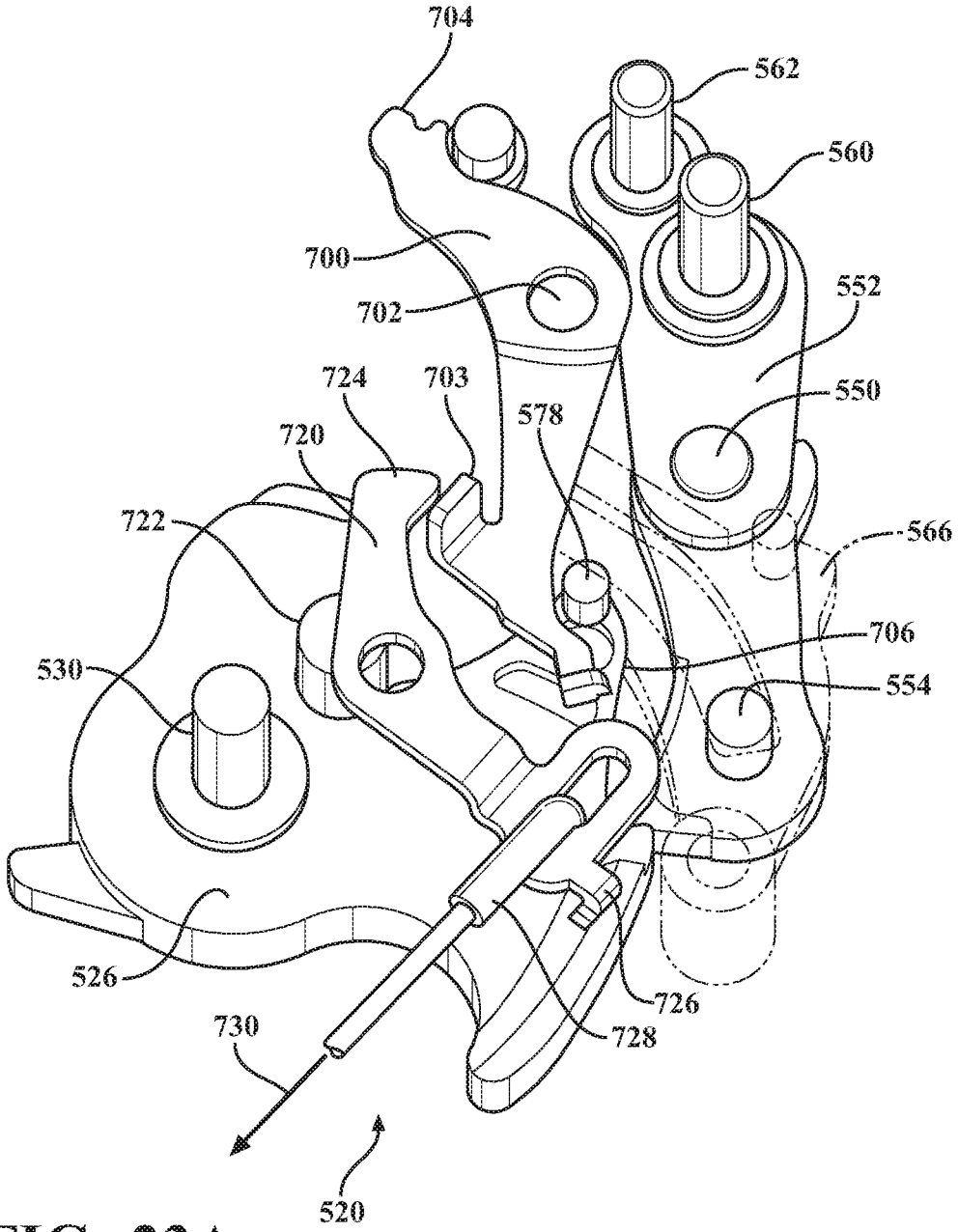
Figure 23B:
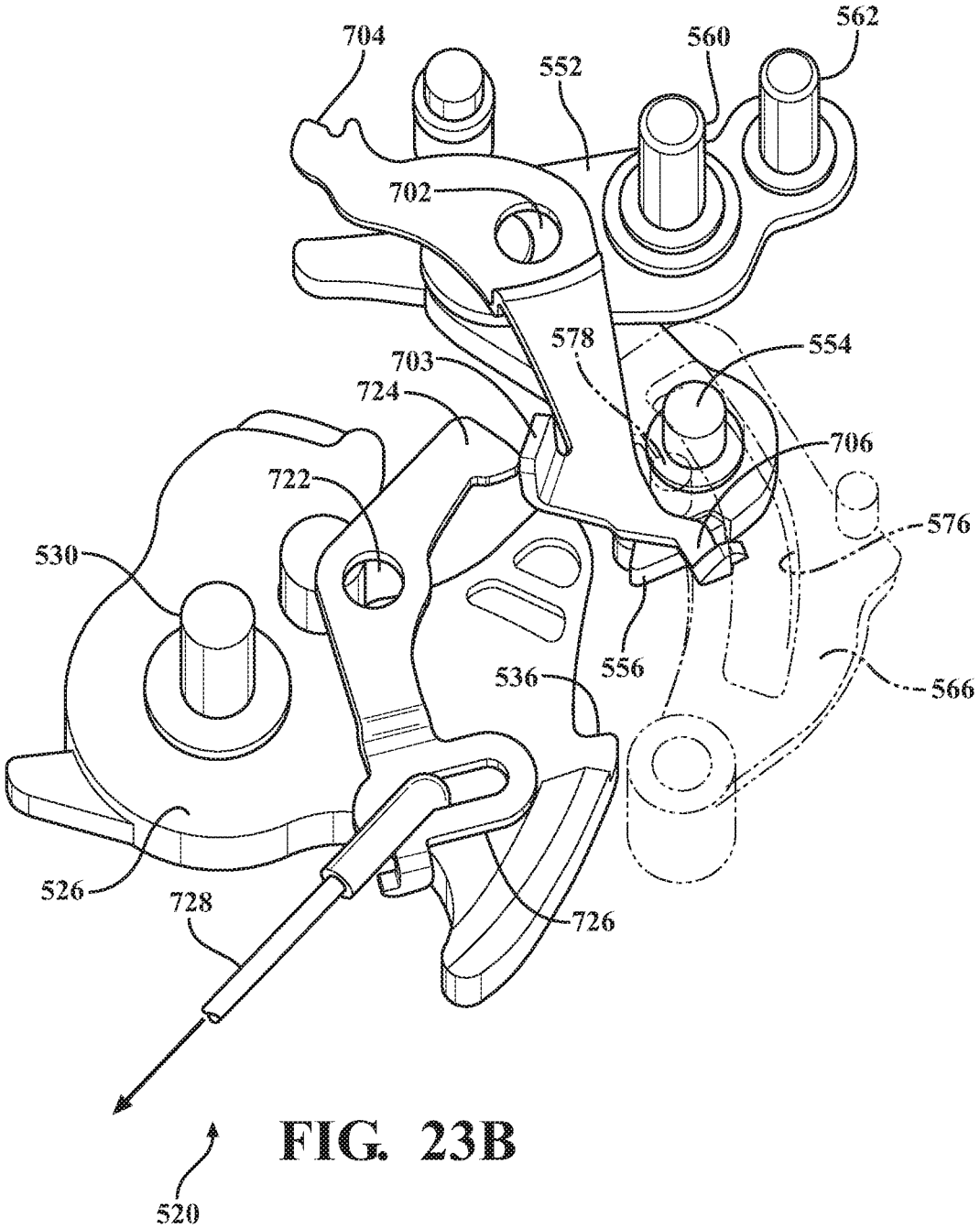
Figure 23C:
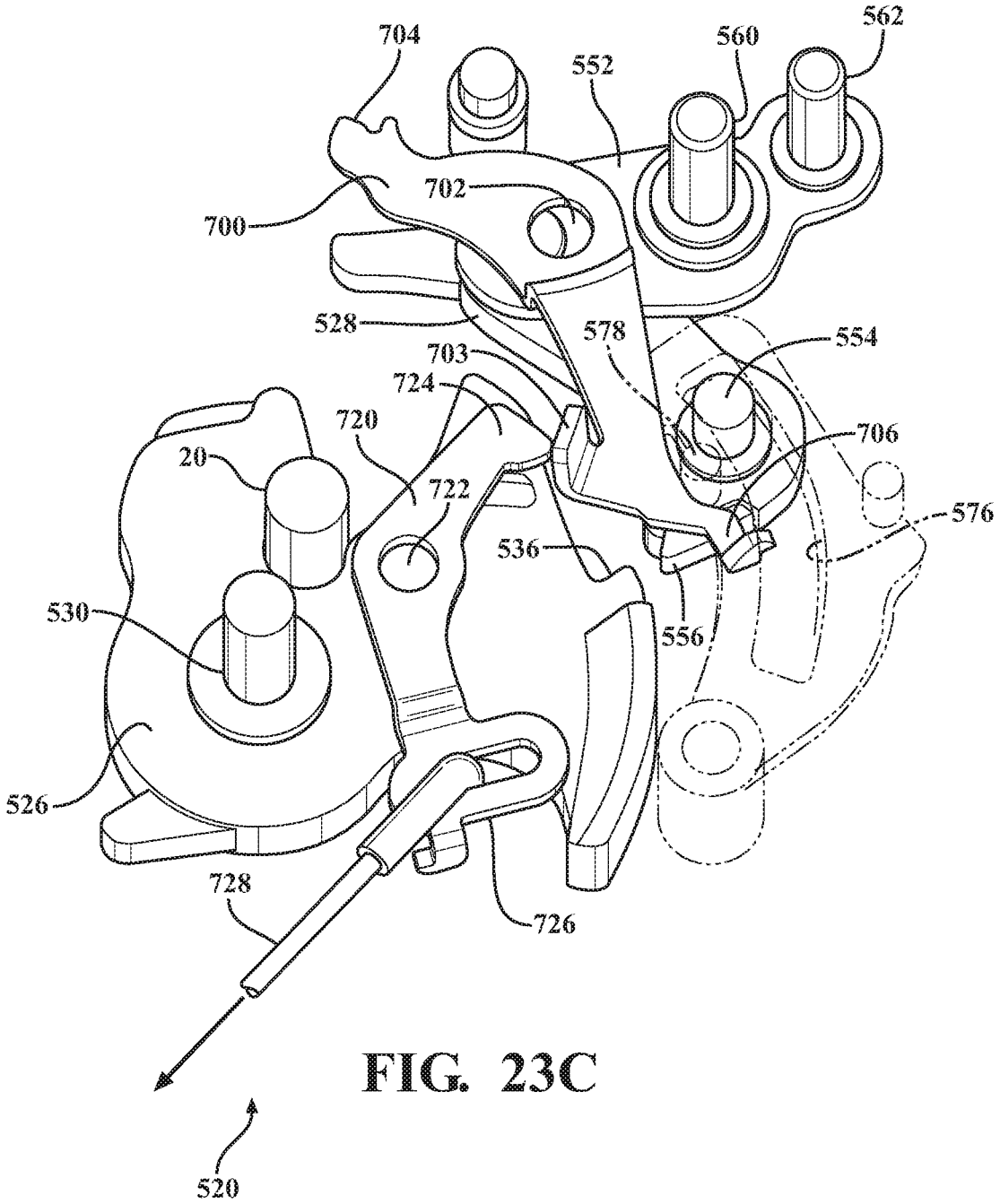

FIGS. 8A through 8C illustrate a series of sequential top elevational view showing the interaction and relative movement between various components of the one-motor power latch assembly upon movement of the closure panel from its open position into its closed position while FIGS. 8D through 8F illustrate a similar series of sequential top elevational views showing the interaction and relative movement between various components of the one-motor power latch assembly upon movement of the closure panel from its closed position into its cinched closed position via operation of a power cinching feature provided in accordance with the present disclosure;

FIGS. 9A through 9F are a series of sequential bottom elevational views corresponding to FIGS. 8A through 8F and which further illustrate the power cinching feature;

FIGS. 10A and 10B are top elevational views sequentially illustrating the interaction and relative movement between various components of the one-motor power latch assembly upon movement of the closure panel from its cinched closed position into its open position via operation of the power release feature which provides a soft opening function in accordance with the present disclosure;

FIGS. 11A and 11B are bottom elevational views corresponding to FIGS. 10A and 10B and which further illustrate the power release feature of the present disclosure;

FIGS. 12A and 12B are additional views of various components of the latch mechanism when the closure panel is located in its closed position which show the lines of force acting thereon and also show a supplementary reinforcement mechanism provided by the one-motor power latch assembly of the present disclosure;

FIG. 13 is a bottom elevational view of components of the latch mechanism and the cinch mechanism when the closure panel is located in its cinched closed position and showing the over-center ratchet retention configuration provided by the present disclosure;

FIGS. 14A and 14B are isometric views illustrating the interaction and orientation between various components of the latch mechanism and the cinch mechanism when the closure panel is located in its cinched closed position;

FIGS. 15A through 15D illustrate the orientation and interaction of various components of the one-motor power latch assembly when the closure panel is located in its open position;

FIGS. 16A through 16D illustrate the orientation and interaction of various components of the one-motor power latch assembly when the closure panel is located in its closed position and immediately prior to initiation of the power cinching operation;

FIGS. 17A through 17D illustrate the orientation and interaction of various components of the one-motor power latch assembly when the closure panel is located in its cinched closed position immediately following completion of the power cinching operation;

FIGS. 18A through 18D illustrate the orientation and interaction of various components of the one-motor power latch assembly when the closure panel is located and maintained in its cinched closed position;

FIGS. 19A through 19D illustrate the orientation and interaction of various components of the one-motor power latch assembly following an uncinching and release operation provided by the power release feature of the present disclosure;

FIGS. 20A through 20D illustrate various components of the one-motor power latch assembly upon completion of the uncinching and release operation provided by the power release feature for permitting the closure panel to subsequently move to its open position;

FIGS. 21A and 21B illustrate engagement of the pawl with a primary closing notch formed in the ratchet of the latch mechanism when the closure panel is located in its cinched closed position while FIGS. 21C and 21D correspondingly illustrate engagement of the pawl with a safety closing notch formed in the ratchet provided for locating and retaining the closure panel in a safety closed position;

FIGS. 22A through 22C illustrate the orientation and interaction of various components associated with an inside release mechanism used with the one-motor power latch assembly shown in FIGS. 2A and 2B;

FIGS. 23A through 23C illustrate the orientation and interaction of various components associated with an outside release mechanism used with the one-motor power latch assembly; and FIGS. 24A through 24F illustrate the interaction between the actuator gear of the actuation mechanism and the release lever of the latch release mechanism upon rotation of the actuator gear between a Rest position and a Cinch position.

Corresponding reference numerals are used to indicate corresponding components throughout the several views of the drawings.

DETAILED DESCRIPTION

Example embodiments will now be described more fully with reference to the accompanying drawings. To this end, the example embodiments are provided so that this disclosure will be thorough, and will fully convey its intended scope to those who are skilled in the art. Accordingly, numerous specific details are set forth such as examples of specific components, devices, and methods, to provide a thorough understanding of embodiments of the present disclosure. However, it will be apparent to those skilled in the art that specific details need not be employed, that example embodiments may be embodied in many different forms, and that neither should be construed to limit the scope of the present disclosure. In some example embodiments, well-known processes, well-known device structures, and well-known technologies are not described in detail.

In the following detailed description, the expression "power latch assembly" will be used to generally indicate any power-operated latch device adapted for use with a vehicle closure panel to provide a power cinch feature in combination with a soft opening function with or without a power release feature. Additionally, the expression "closure panel" will be used to indicate any element moveable between an open position and at least one closed position, respectively opening and closing an access to an inner compartment of a motor vehicle and therefore includes, without limitations, decklids, tailgates, liftgates, bonnet lids, and sunroofs in addition to the sliding or pivoting side passenger doors of a motor vehicle to which the following description will make explicit reference, purely by way of example.

Figure 1:
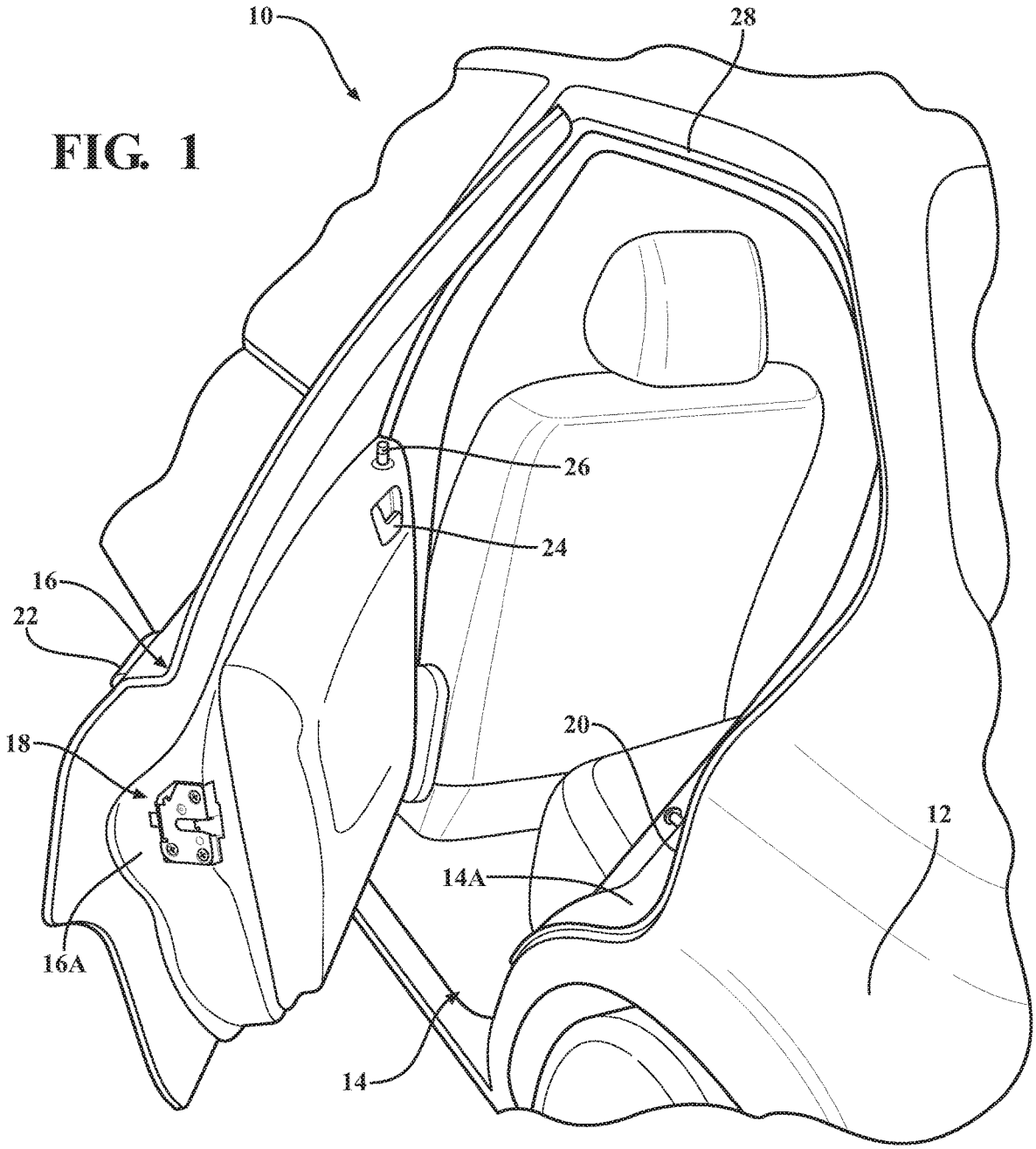
FIG. 1 is a partial perspective view of a motor vehicle having a closure panel equipped with a power latch assembly that is constructed in accordance with the teachings of the present disclosure.

Referring initially to FIG. 1 of the drawings, a motor vehicle 10 is shown to include a vehicle body 12 defining an opening 14 to an interior passenger compartment. A closure panel 16 is pivotably mounted to body 12 for movement between an open position (shown) and a fully closed position to respectively open and close opening 14. A power latch assembly 18 is rigidly secured to closure panel 16 adjacent to an edge portion 16A thereof and is releasably engageable with a striker 20 that is fixedly secured to a recessed edge portion 14A of opening 14. As will be detailed, power latch assembly 18 is operable to engage striker 20 and releaseably move closure panel 16 into its fully closed position. An outside handle 22 and an inside handle 24 are provided for actuating power latch assembly 18 to release striker 20 and permit subsequent movement of closure panel 16 to its open position. An optional lock knob 26 is shown which provides a visual indication of the locked state of latch assembly 18 and which may also be operable to mechanically change the locked state of latch assembly 18. A weather seal 28 is mounted on edge portion 14A of opening 14 in vehicle body 12 and is adapted to be resiliently compressed upon engagement with a mating sealing surface of closure panel 16 when closure panel 16 is held by latch assembly 18 in its closed position so as to provide a sealed interface therebetween which is configured to prevent entry of rain and dirt into the passenger compartment while minimizing audible wind noise. For purpose of clarity and functional association with motor vehicle 10, the closure panel is hereinafter referred to as passenger door 16.

Referring now to FIGS. 2 through 24 of the drawings, a one-motor power latch assembly to be described in detail hereinafter is generally identified by reference numeral 500. Generally speaking, power latch assembly 500 is adapted for use with motor vehicle 10 shown in FIG. 1 and can be secured to closure panel 16 and operable to releaseably engage a striker 20 secured to edge portion 14A of opening 14 in vehicle body 12. It is also contemplated that power latch assembly 500 can be used in association with any type of latch control system.

FIGS. 2A and 2B illustrate power latch assembly 500 to generally include a multi-piece structural framework and housing arrangement comprised of a rigid frame plate 502, a latch housing 504, a controller enclosure 506, a motor housing 507, and motor end cap 508. The operational components of power latch assembly 500 are enclosed and/or mounted to one or more of these structural/housing components and will be described hereinafter to generally include a latch mechanism 510, a latch cinch mechanism 512, a latch release mechanism 514, an actuation mechanism 516, an inside latch release mechanism 518, and an outside latch release mechanism 520. These mechanisms interact to establish a plurality of distinct operative modes for power latch assembly 500. Specifically, a "released" mode is established when door 16 is located in an open position, a "latched" mode is established when door 16 is located in a closed position, and a "cinched" mode is established when door 16 is located in a cinched closed position following operation of the power cinching feature. Power latch assembly 500 is further operable to establish an "uncinched/released" mode as part of an uncinching/soft opening function provided by the power release feature which facilitates movement of door 16 from its cinched closed position to a released position.

Figure 4B:
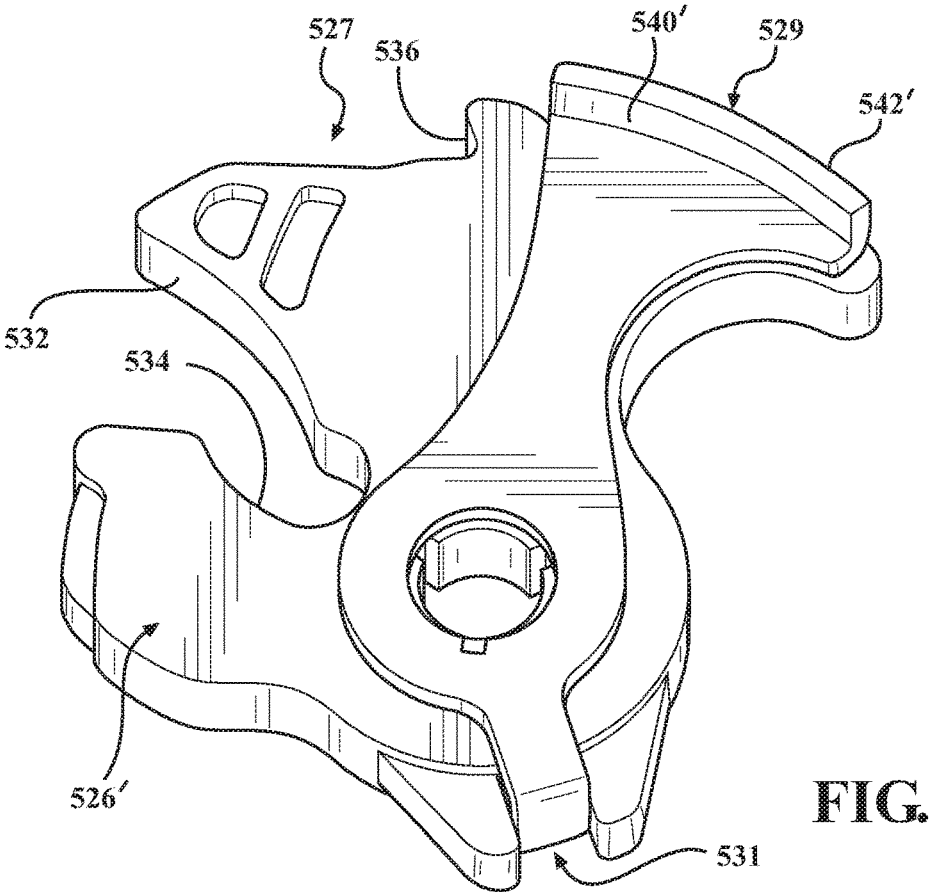
FIGS. 4A and 4B illustrate an alternative two-piece construction for the ratchet shown in FIGS. 3A through 3C.
Figure 4A:
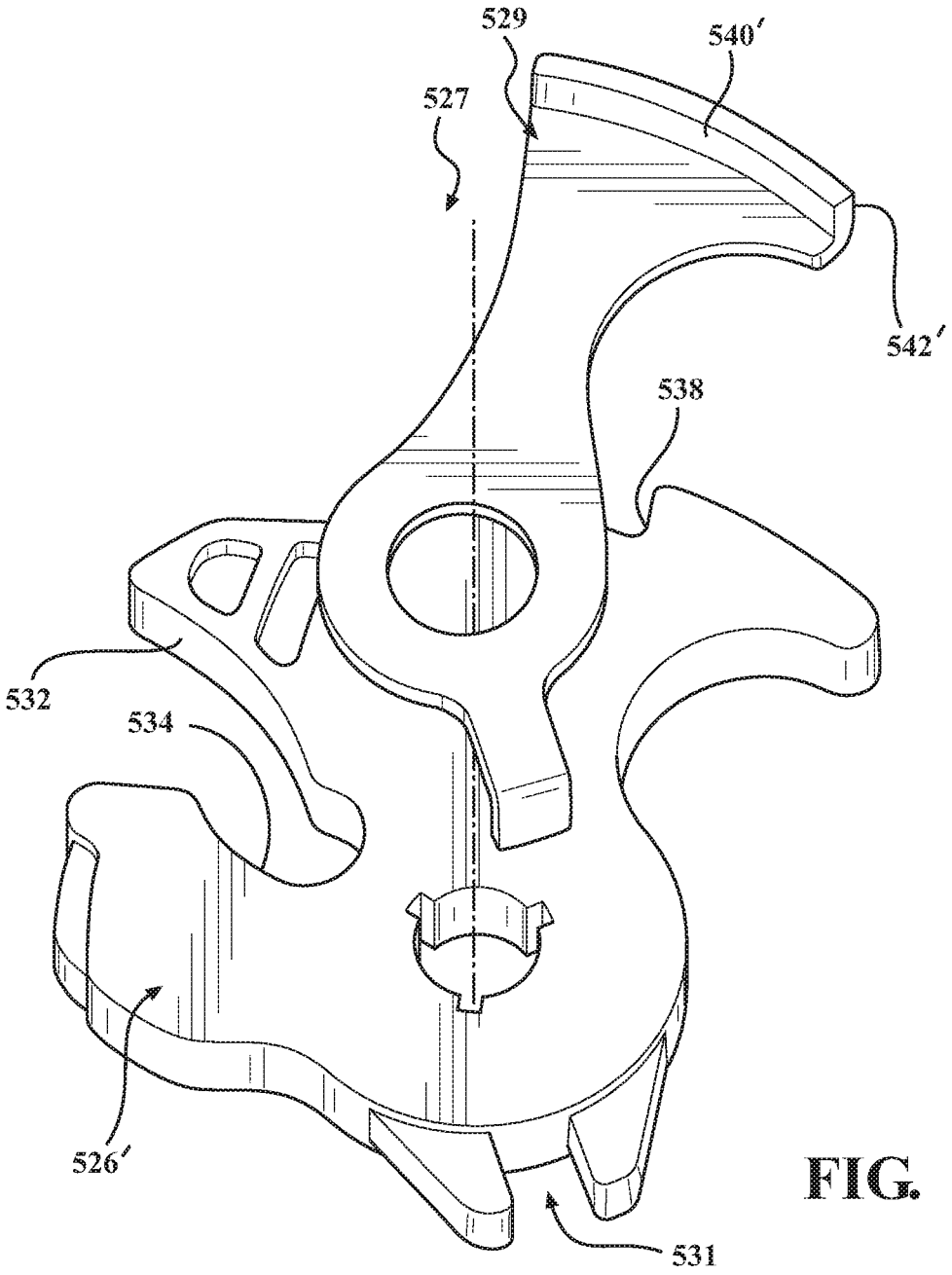

Frame plate 502 is a rigid component configured to be fixedly secured to edge portion 16A of door 16 and defines an entry aperture 524 through which striker 20 travels upon movement of door 16 toward and way from its closed position relative to vehicle body 12. Latch mechanism 510 is shown, in this non-limiting example, as a single pawl arrangement including a ratchet 526 and a pawl 528. Ratchet 526 is supported for pivotal movement on a ratchet pivot pin 530 that is fixed to frame plate 502. Ratchet 526 is configured to include a contoured striker guide channel 532 which terminates in a striker capture pocket 534, a primary closing notch 536, a safety closing notch 538, and a raised projection 540 defining a non-closing profile surface 542. As an alternative to the one-piece version of ratchet 526 shown in FIGS. 3A and 3B, a two-piece ratchet assembly 527 is shown in FIGS. 4A and 4B to include a ratchet 526' and a profile plate 529 that are attached via a link connector 531, such as the tab and groove arrangement shown. Profile plate 529 has raised projection 540' and its profile surface 542' formed thereon.

A ratchet biasing member, shown schematically by arrow 544 (See FIG. 18A), is adapted to normally bias ratchet 526 to rotate about pivot pin 530 in a first or releasing direction so as to permit striker 20 to be released from retention within striker capture pocket 534 and allow movement of door 16 from its released position toward its open position. In contrast, ratchet 526 can be rotated in a second or latching direction, in opposition to the biasing of ratchet biasing member 544, to permit latch mechanism 510 to retain striker 20 in striker capture pocket 534 and hold door 16 in one of its closed positions. Ratchet 526 can be rotated between a plurality of distinct ratchet positions including a first or "striker release" position, a second or "primary striker capture" position, and a third or "cinched striker capture" position. A fourth or "uncinched striker capture" position for ratchet 526 is also provided and is located between the primary and cinched striker capture positions. The striker release position of ratchet 526 is established when striker 20 is released from guide channel 532. The primary striker capture position of ratchet 526 is established upon closure and initial mechanical latching of door 16 in its closed position. The cinched striker capture position of ratchet 526 is established upon completion of the power cinching operation for moving door 16 into its cinched closed position. Finally, the uncinched striker capture position is established by the power releasing operation for allowing door 16 to move from its cinched closed position to its released position.

Figure 5A:
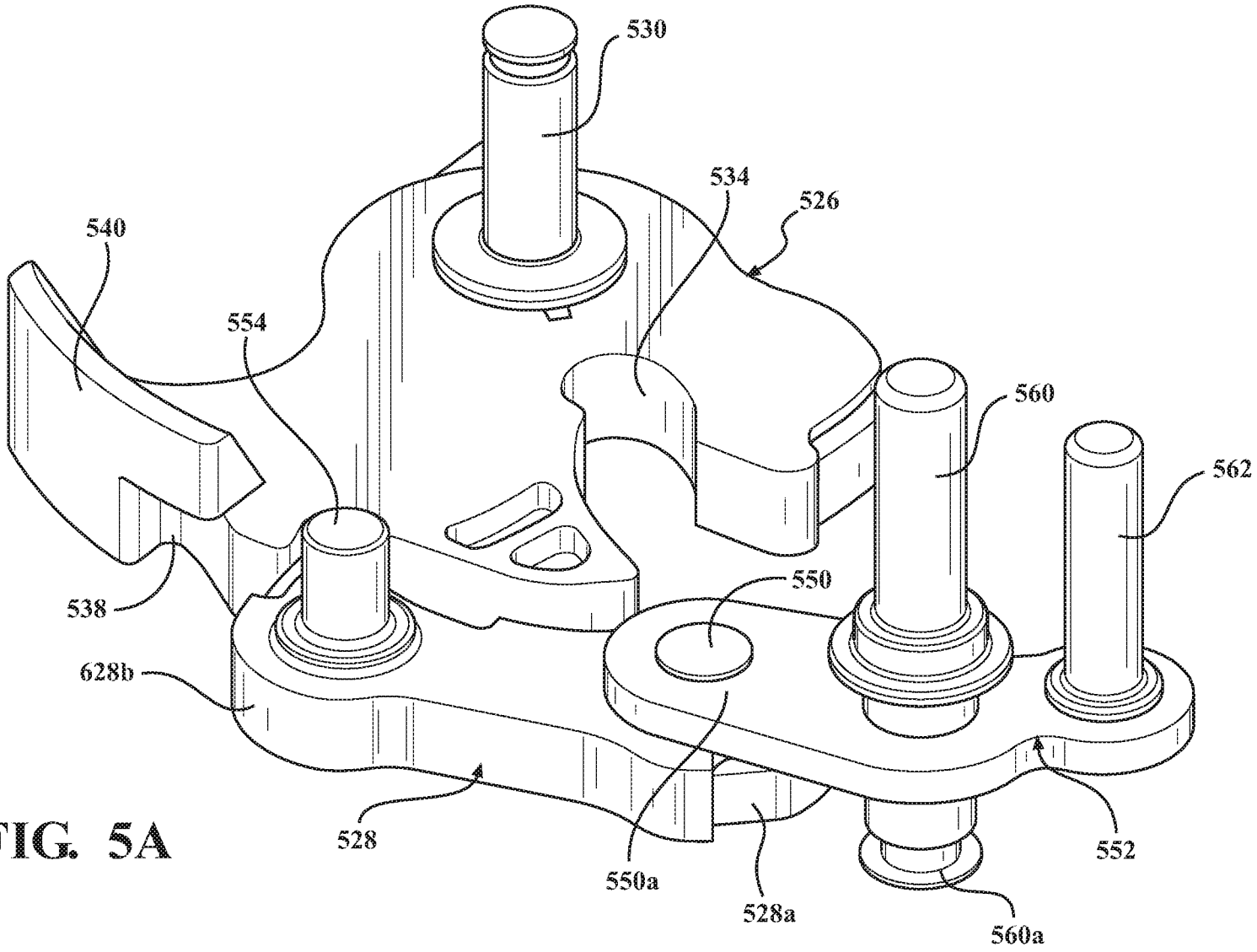
FIGS. 5A and 5B illustrate the orientation and interaction of a pawl associated with the latch mechanism and a cinch lever associated with a latch cinch mechanism used in the one-motor power latch assembly shown in FIGS. 2A and 2B.
Figure 5B:
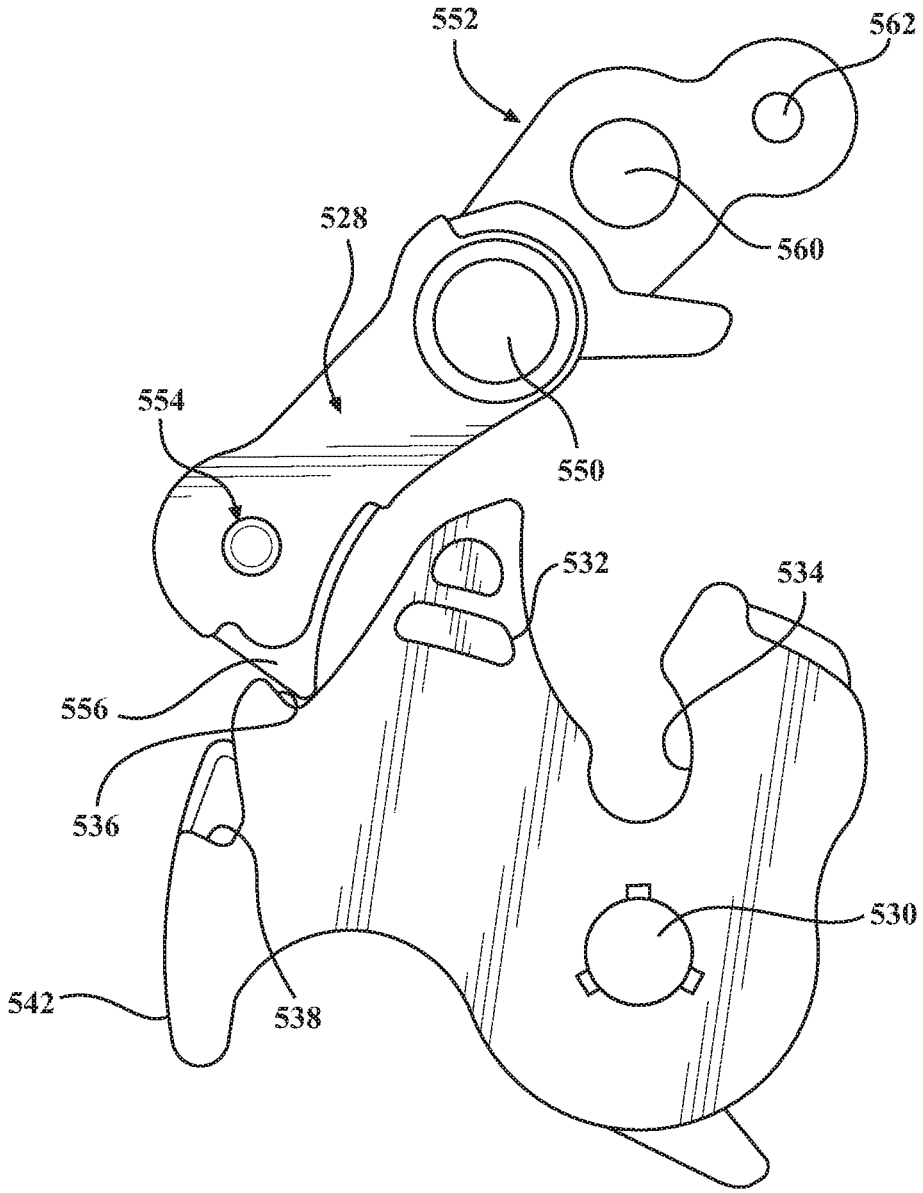

Pawl 528 is best shown in FIGS. 5A and 5B to be configured as an elongated component having a first end segment 528*a* that is pivotably fixed via a pawl pivot pin 550 to a first end segment 552*a* of a cinch lever 552 associated with latch cinch mechanism 512. A pawl follower pin 554 extends outwardly from a second end segment 528*b* of pawl 528. Second end segment 528*b* of pawl 528 also defines an engagement projection or flange 556 configured to selectively engage primary closing notch 536 on ratchet 526 when pawl 528 is located in a first or "ratchet checking" position after ratchet 526 has been forcibly rotated to its primary striker capture position via engagement with striker 20. Cinch lever 552 is further shown to be supported for pivotal movement about a cinch lever pivot pin 560 which, in turn, is fixedly secured via a rivet portion 560*a* to frame plate 502. In addition, a gear link drive pin 562 extends outwardly from a second end segment 552*b* of cinch lever 552. As will be detailed, pawl 528 is pivotably moveable with respect to ratchet 526 between its ratchet checking position and a second or "ratchet release" position whereat its engagement flange 556 is disengaged from primary closing notch 536 on ratchet 526. As will also be detailed, pawl 528 is also adapted to translate between a first or "cinch start" pawl position and a second or "cinch stop" pawl position in response to pivotal movement of cinch lever 552 about pivot pin 560 caused by the power cinching operation. Thus, the pivotal connection established between first end segment 528*a* of pawl 528 and first end segment 552*a* of cinch lever 552 by pivot post 550 establishes a "moveable" pawl axis which permits both pivotal and translational movement of pawl 528 relative to ratchet 526.

Figure 6A:
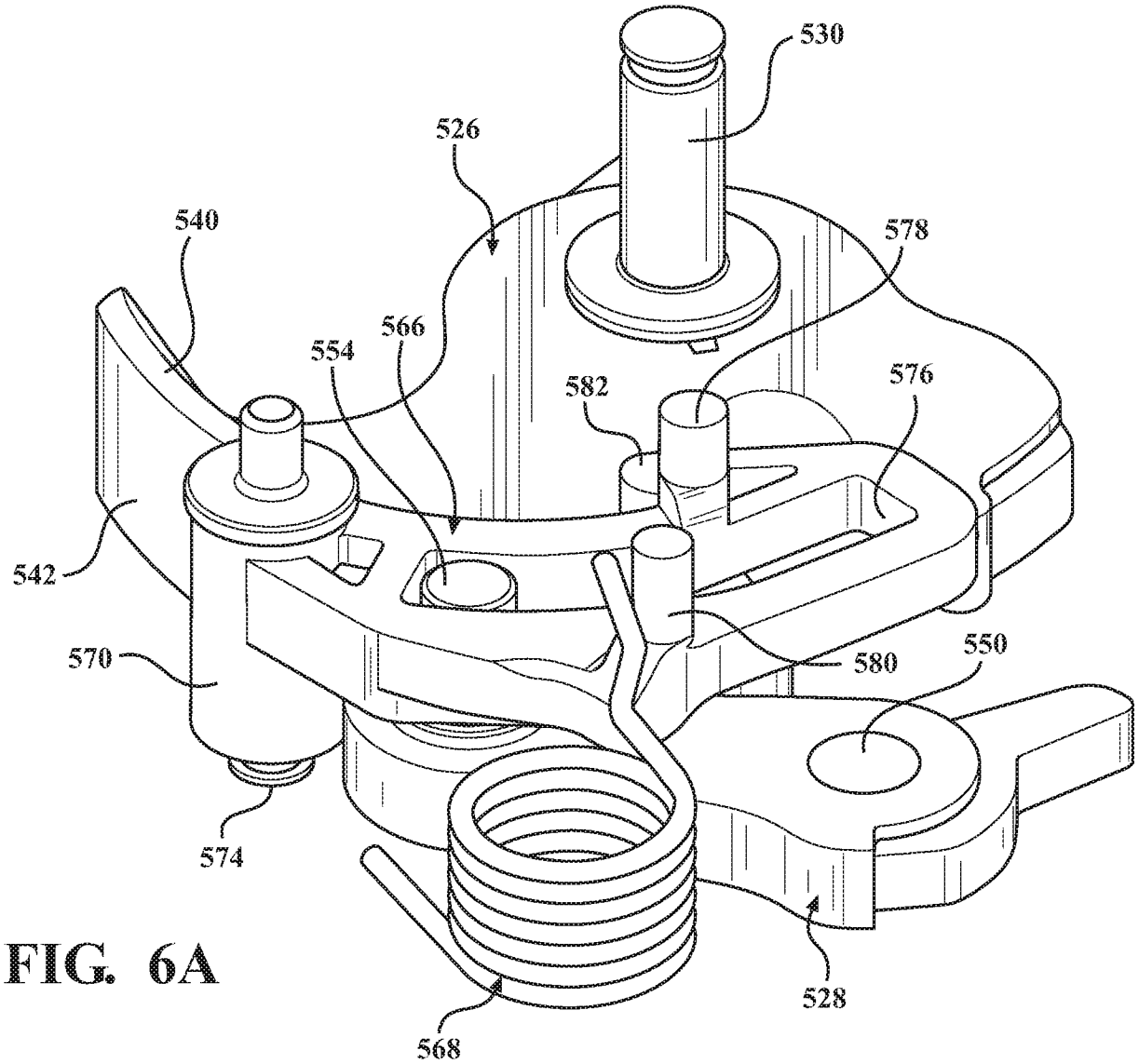
FIGS. 6A and 6B illustrate the orientation and interaction of a pawl lever and pawl lever biasing spring associated with the latch cinch mechanism used in the one-motor power latch assembly shown in FIGS. 2A and 2B.
Figure 6B:
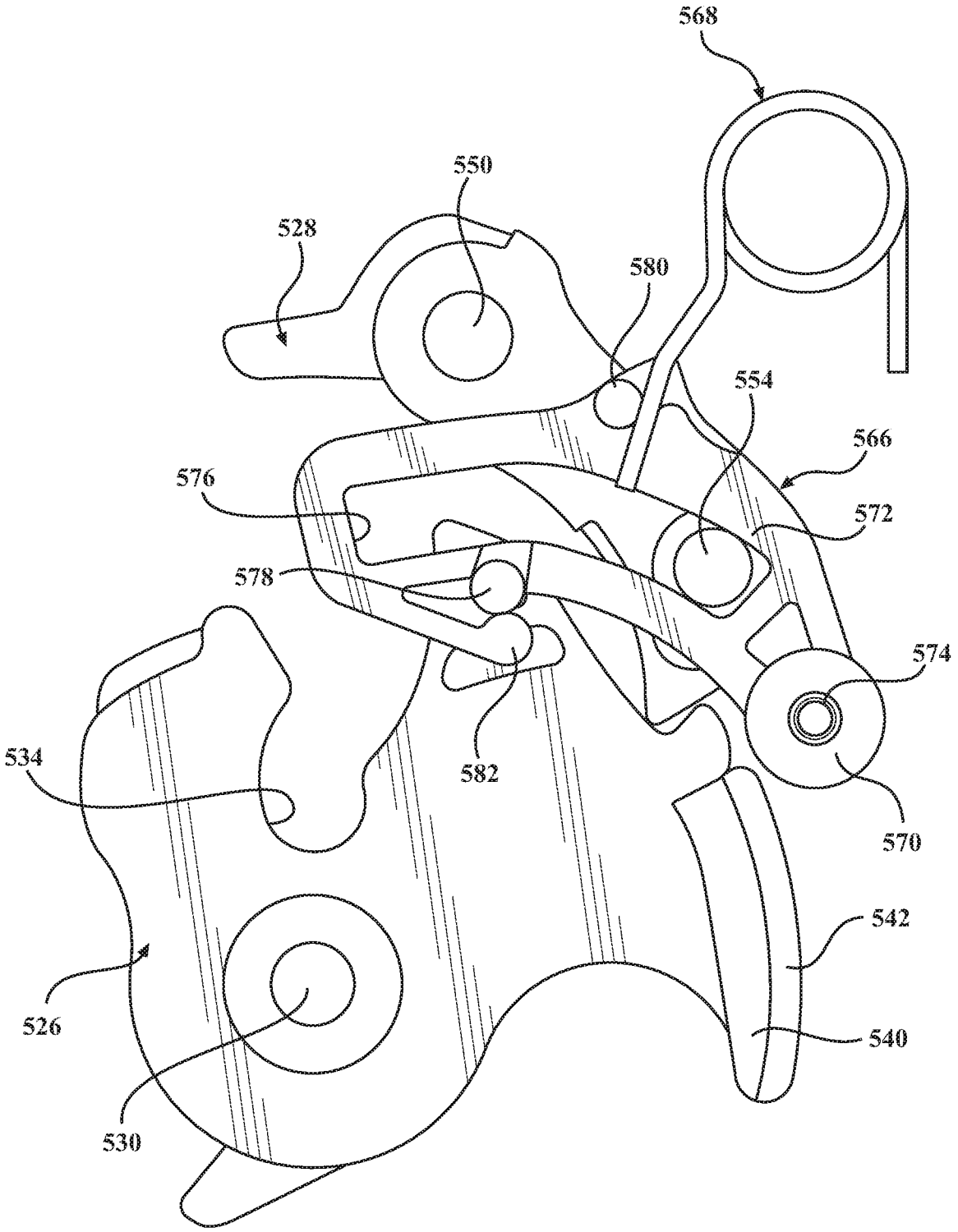

Referring now primarily to FIGS. 6A and 6B, a pawl lever 566 and a closing spring 568 are shown in association with pawl 528 of latch cinch mechanism 512. Pawl lever 566 is configured to include a cylindrical boss segment 570 and an elongated lever segment 572. Boss segment 570 is rigidly fixed via a rivet pin or pivot post 574 to frame plate 502 to establish a fixed pivot axis for pawl lever 566. As will be detailed, pawl lever 566 is pivotable relative to ratchet 526 between a first or "Open" pawl lever position and a second or "Closed" pawl lever position. Lever segment 572 is configured to include an elongated guide slot 576 within which pawl follower pin 554 is slidingly retained. A pair of engagement lugs 578 and 580 extend from opposite sides of lever segment 572. One end of closing spring 568 engages a fixed portion of frame plate 502 and the other end of closing spring 568 engages lug 580 on lever segment 572 of pawl lever 566. As such, closing spring 568 applies a directed biasing load on pawl lever 566 for normally biasing pawl lever 566 toward its Closed pawl lever position. Due to retention of pawl follower pin 554 within contoured guide slot 576, closing spring 568 also applies a directed biasing load on pawl 528 for normally biasing pawl 528 toward its ratchet checking position. As an alternative, closing spring 568 could act on pawl 528 for providing the same type of coordinated biasing arrangement. Lever segment 572 of pawl lever 566 is also configured to include a cam projection 582 that is adapted to selectively engage and disengage profiled surface 542 formed on raised projection 540 of ratchet 526, based on the rotated position of ratchet 526, thereby facilitating pivotal movement of pawl lever 566 about pivot post 574.

Figure 7A:
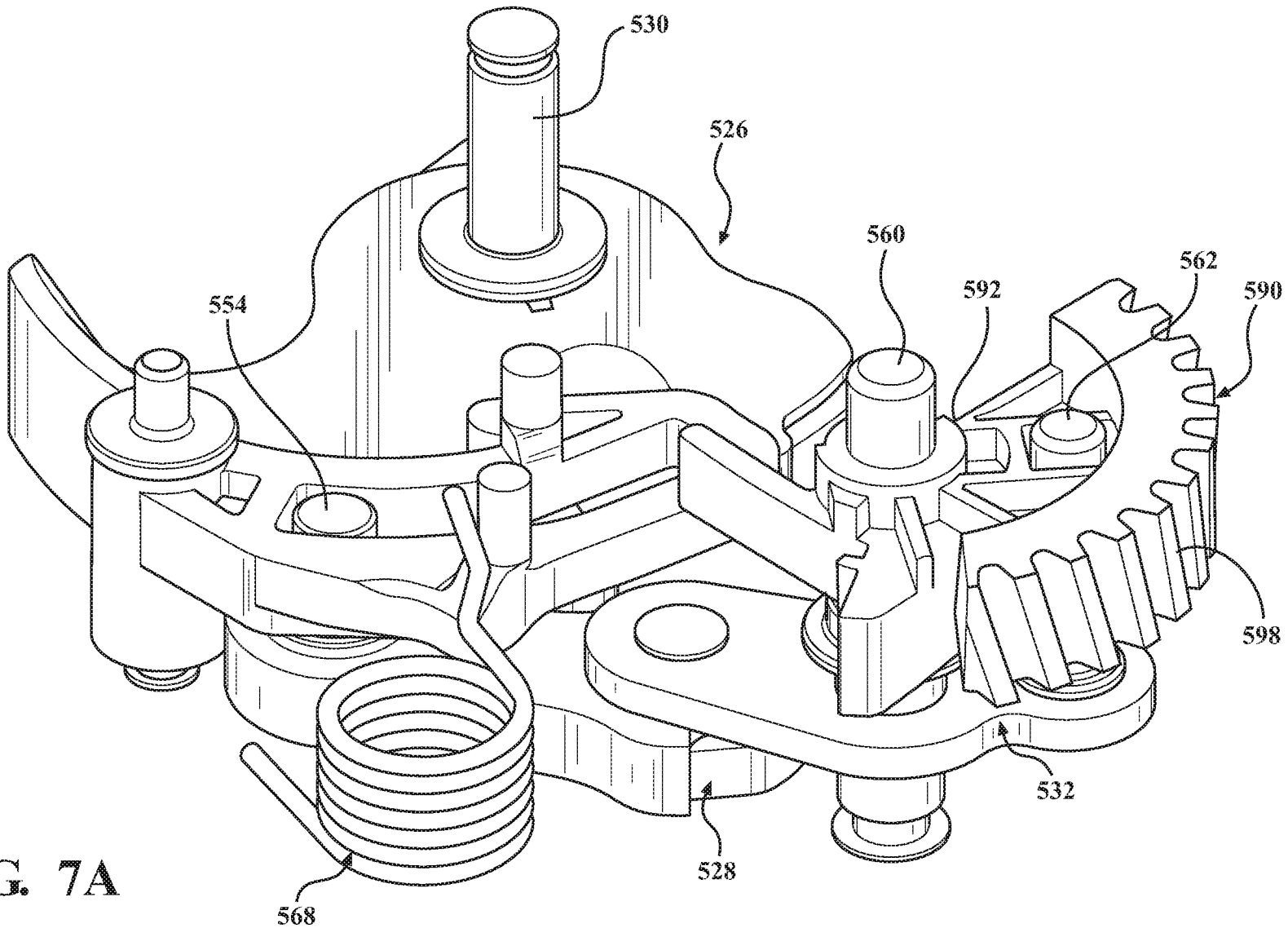
FIGS. 7A through 7D illustrate the orientation and interaction of various components of a latch release mechanism and a power-operated actuation mechanism used in the one-motor power latch assembly shown in FIGS. 2A and 2B.
Figure 7B:
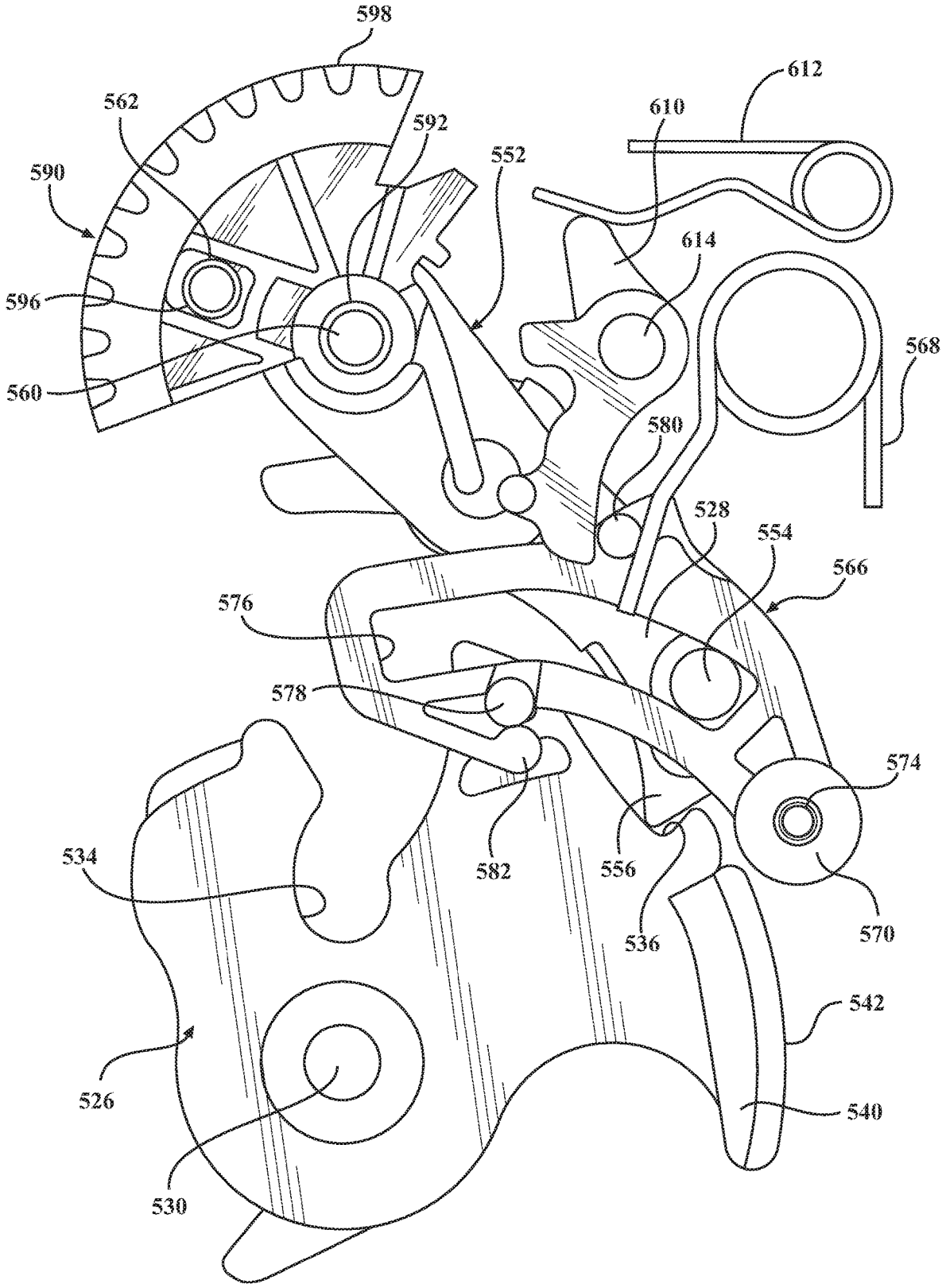
Figure 7C:
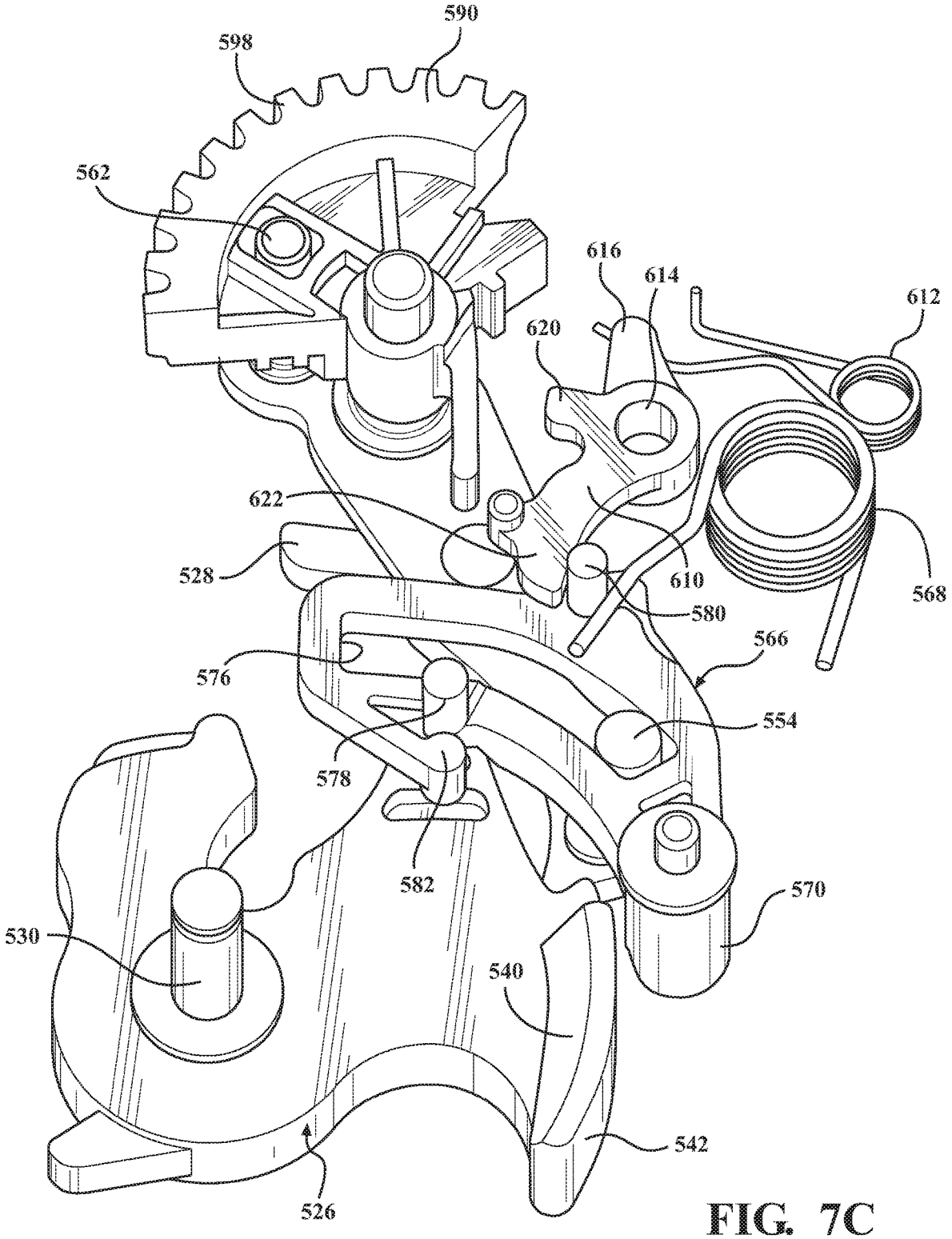
Figure 7D:
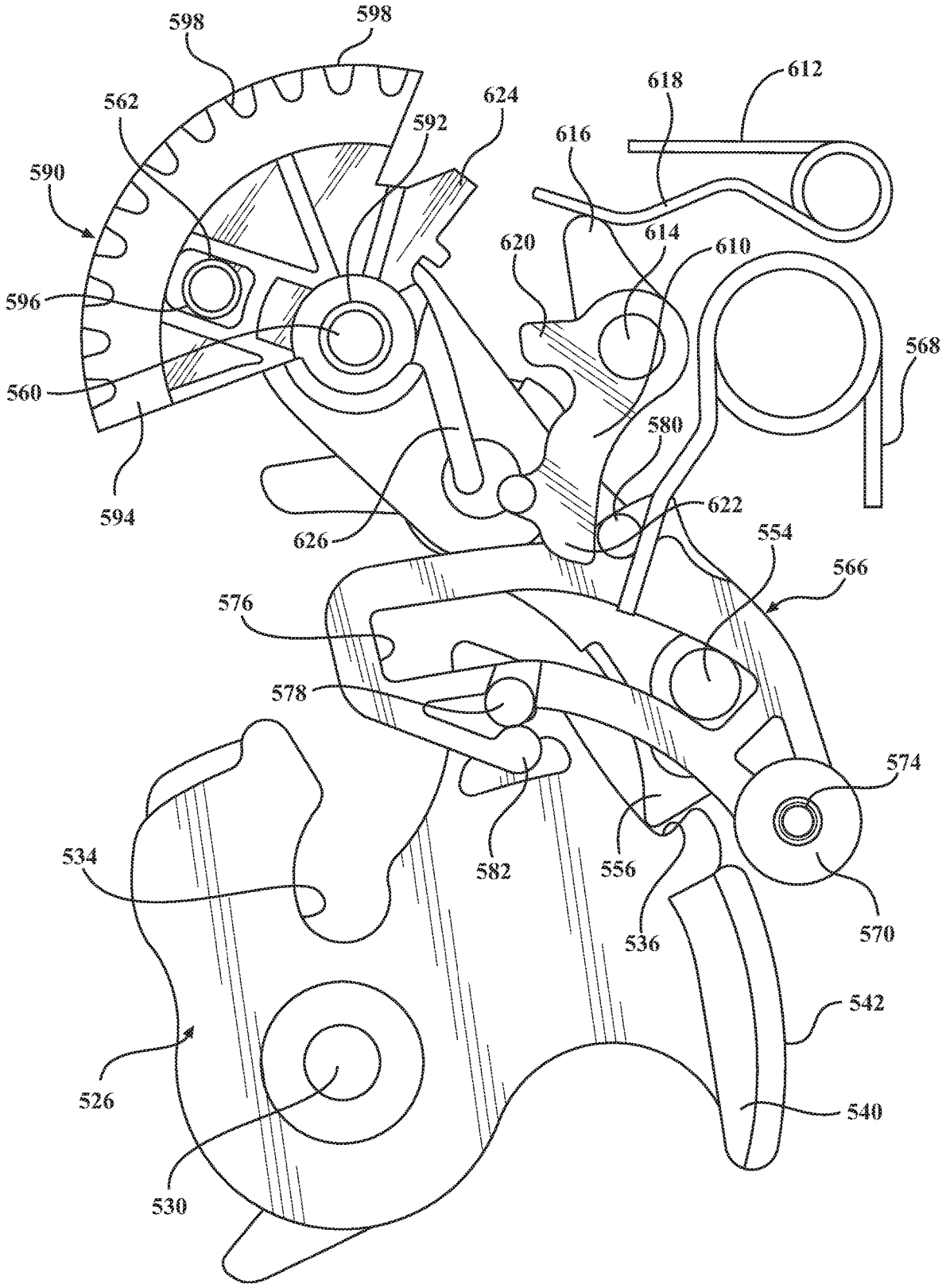

Various components of latch release mechanism 514 and actuation mechanism 516 are shown in FIGS. 7A-7C as being "built-up" on the components already described up through FIGS. 6A and 6B. Specifically, actuation mechanism 516 is shown to include an actuator gear 590 having a tubular boss segment 592 rotatably mounted on cinch lever pivot pin 560. Actuator gear 590 also includes a gear segment 594 having a drive aperture 596 within which gear link drive pin 562 is retained. As previously noted, gear link drive pin 562 is fixed to second end segment 552*b* of cinch lever 552. Based on this arrangement, actuator gear 590 and cinch lever 552 are coupled for common rotation about pivot point 560. Gear segment 594 of actuator gear 590 includes gear teeth 598 that are meshed, in this non-limiting example, with threads of a worm gear 600. A power-operated device, such as an electric motor 602, has a rotary output component configured to drive a first stage reduction gearset 604 which, in turn, drives a second stage reduction gearset 606. First stage gearset 604 includes a first worm gear 605 fixed for rotation with the rotary output of electric motor 602 and which is in constant mesh with a transfer gear 607 fixed for rotation with a drive shaft 609. As best seen from FIG. 2B, the rotary output of electric motor 602 is aligned to extend transversely to driveshaft 609. Second stage gearset 606 includes second worm gear 600 that is fixed for rotation with drive shaft 609 and, as noted, in constant mesh with gear teeth 598 on activator gear 590. This dual-stage double-worm arrangement provides a compact gear arrangement and, in the non-limiting configuration shown, provides a "square" or 90° orientation between the motor shaft and activator gear 590. In operation, bi-directional control of the rotation of the motor output component results in controlled bi-directional rotation of actuator gear 590 in concert with pivotal movement of cinch lever 552 about pivot axis 560.

Latch release mechanism 514 is best shown in FIGS. 7A-7D to include a pivotal release lever 610 and a release lever biasing spring 612. Release lever 610 is pivotable about a release lever pivot post 614 that is rigidly secured to frame plate 502. Release lever 610 is configured to include a first projection 616 adapted to engage a bent or "toggle" segment 618 of release lever biasing spring 612, a second projection 620 engageable with one or more profiled segments of actuator gear 590, and a third projection 622 engageable with engagement lug 580 on pawl lever 566. The profiled segments formed on actuator gear 590 may include a release segment 624 and a reset segment 626, the function of which will be detailed hereinafter. As will also be detailed, release lever biasing spring 612 is configured as a toggle spring to positively locate release lever 610 in one of three distinct release lever positions.

Referring primarily now to all the drawings associated with FIGS. 8, 9 and 15 through 17, various sequential series of views are provide to illustrate the interaction and movement of the components of power latch assembly 500 required to move ratchet 526 in its latching direction from its striker release position (power latch assembly 500 in its released mode), into its primary striker capture position (power latch assembly 500 in its latched mode), and finally into its cinched striker capture position (power latch assembly 500 in its cinched mode). Specifically, FIGS. 8A, 9A, and 15A-15D illustrate power latch assembly 500 in its released mode with ratchet 526 located in its striker release position and ready to receive striker 20 as it enters through entry aperture 524 of frame plate 502 upon door 16 moving toward its closed position. These particular drawings also illustrate pawl lever 566 located in its Open pawl lever position such that its cam projection 582 is in engagement with profiled surface 542 formed on raised projection 540 of ratchet 526. With pawl lever 566 located in its Open pawl lever position, follower pin 554 on pawl 528 is positioned in proximity to a first terminal end of guide slot 576. Actuator gear 590 is shown positioned in a first or "Rest" position. Since cinch lever 552 is pinned to rotate in concert with actuator gear 590, cinch lever 552 is also shown pivoted about pivot axis 560 to a first or "uncinched" position. As such, the combination of the moveable connection established between cinch lever 552 and pawl 528 via pivot post 550 and the location of follower pin 554 within guide slot 576 functions to locate and hold pawl 528 in its ratchet release position such that its engagement flange 556 is displaced from engagement with ratchet 526. Pawl 528 is also shown positioned in its cinch start pawl position. FIG. 9A also illustrates cinch lever 552 abutting or in close proximity to a first mechanical stop 630 when cinch lever 552 is located in its uncinched position. While not specifically shown, a first position sensor can be provided for detecting when actuator gear 590 is located in its Rest position and for providing a position signal indicative of this positioning to the latch control system.

Figure 9A:
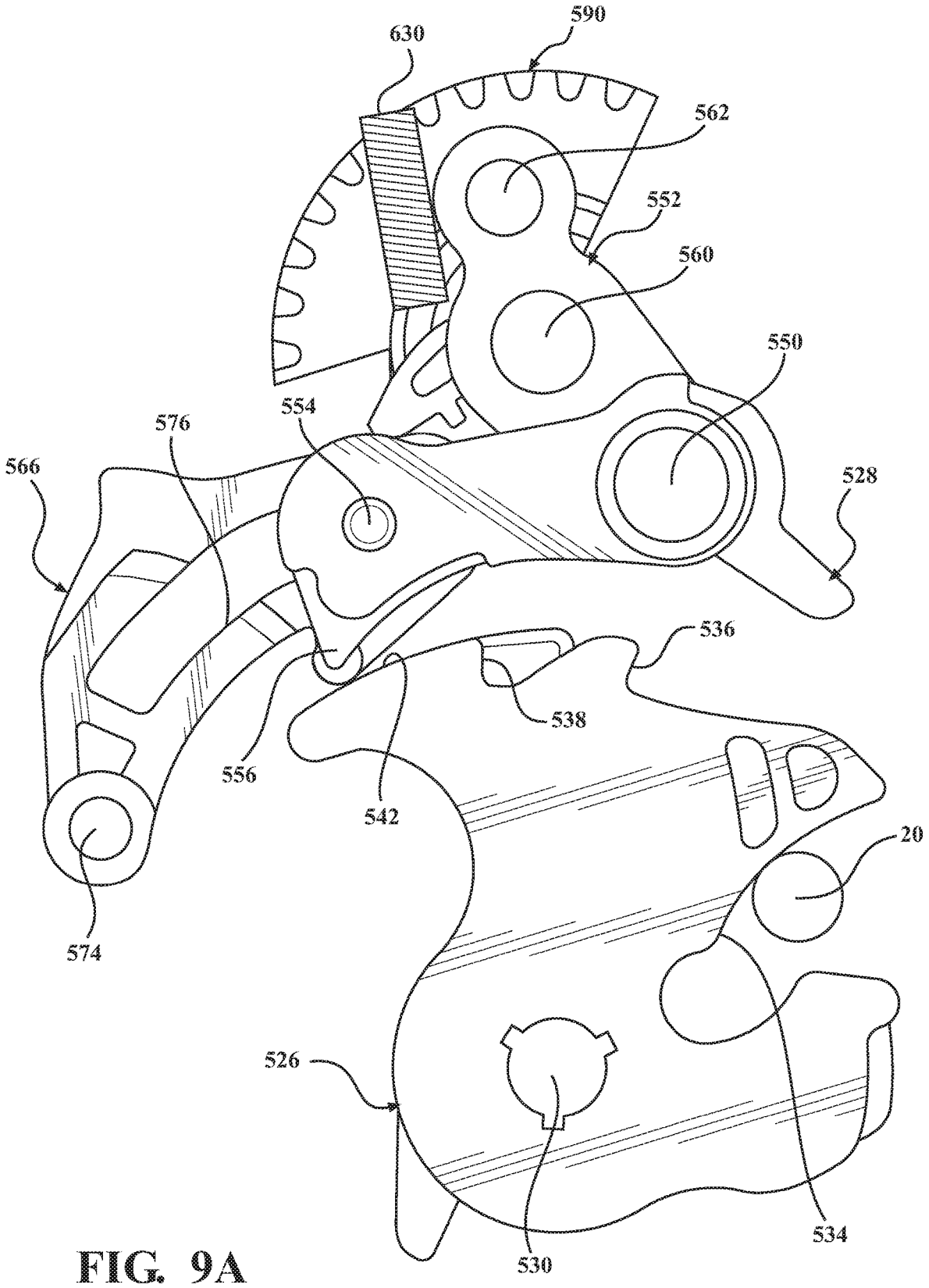
Figure 9B:
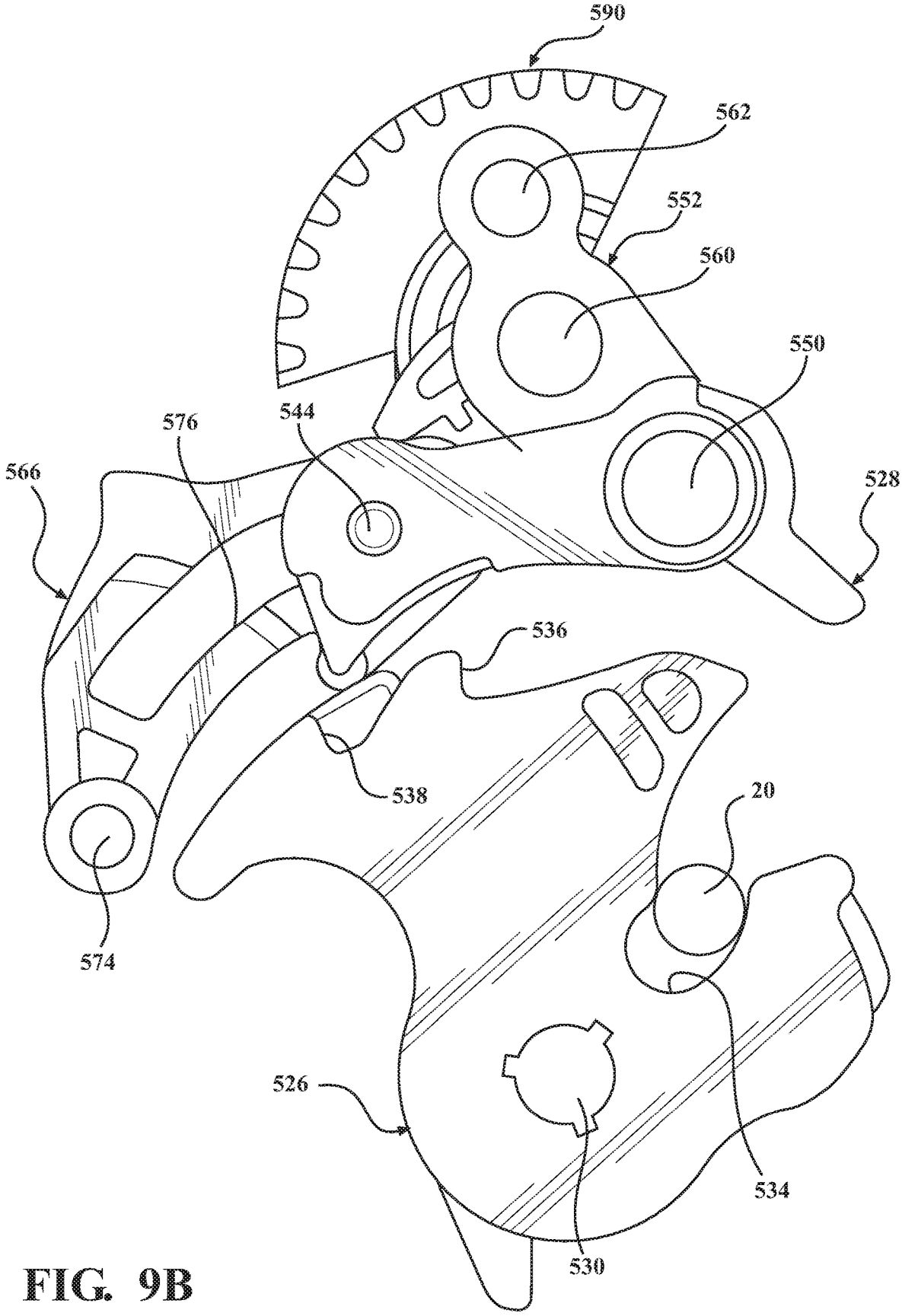
Figure 9C:
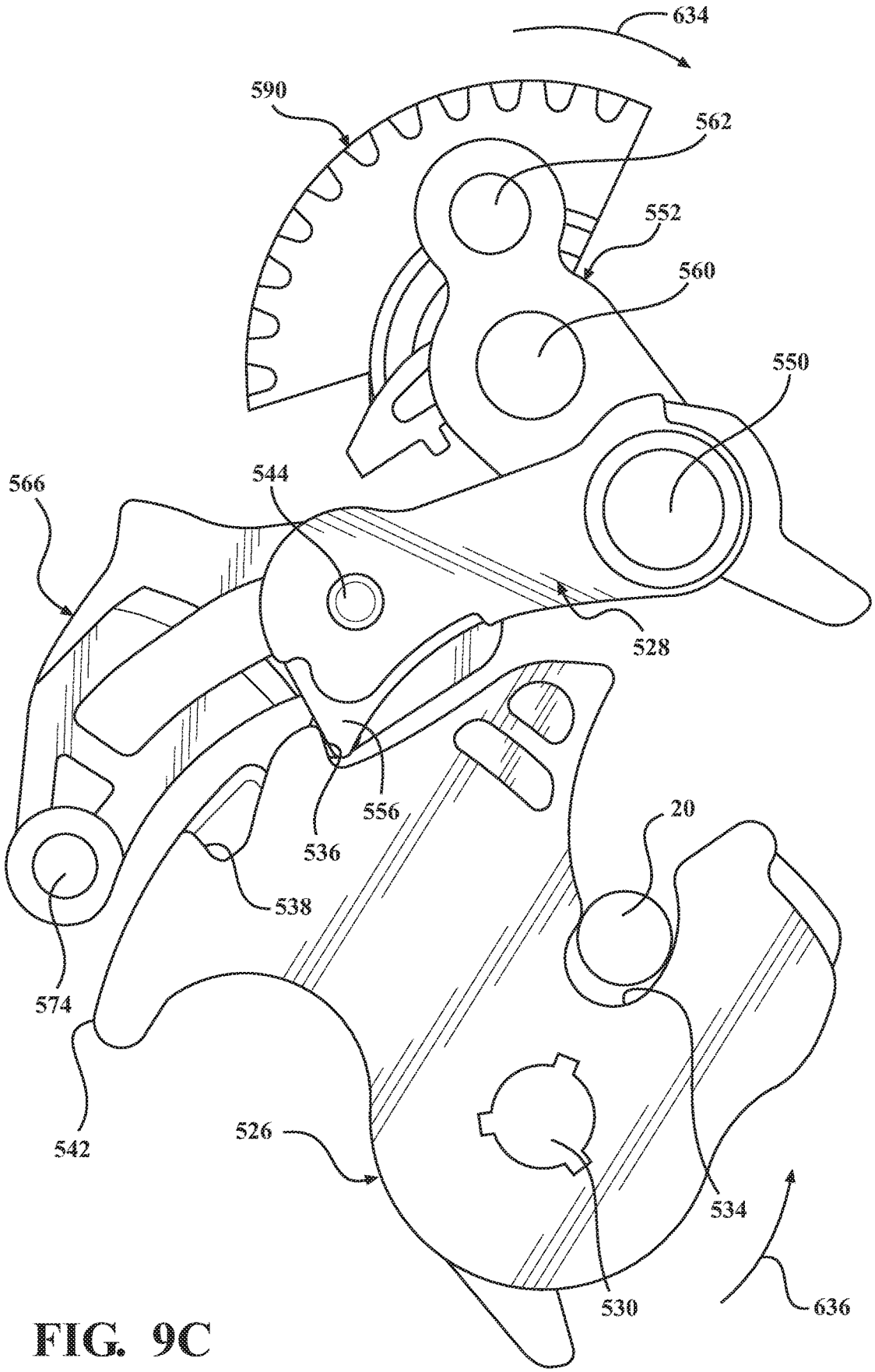
Figure 9D:
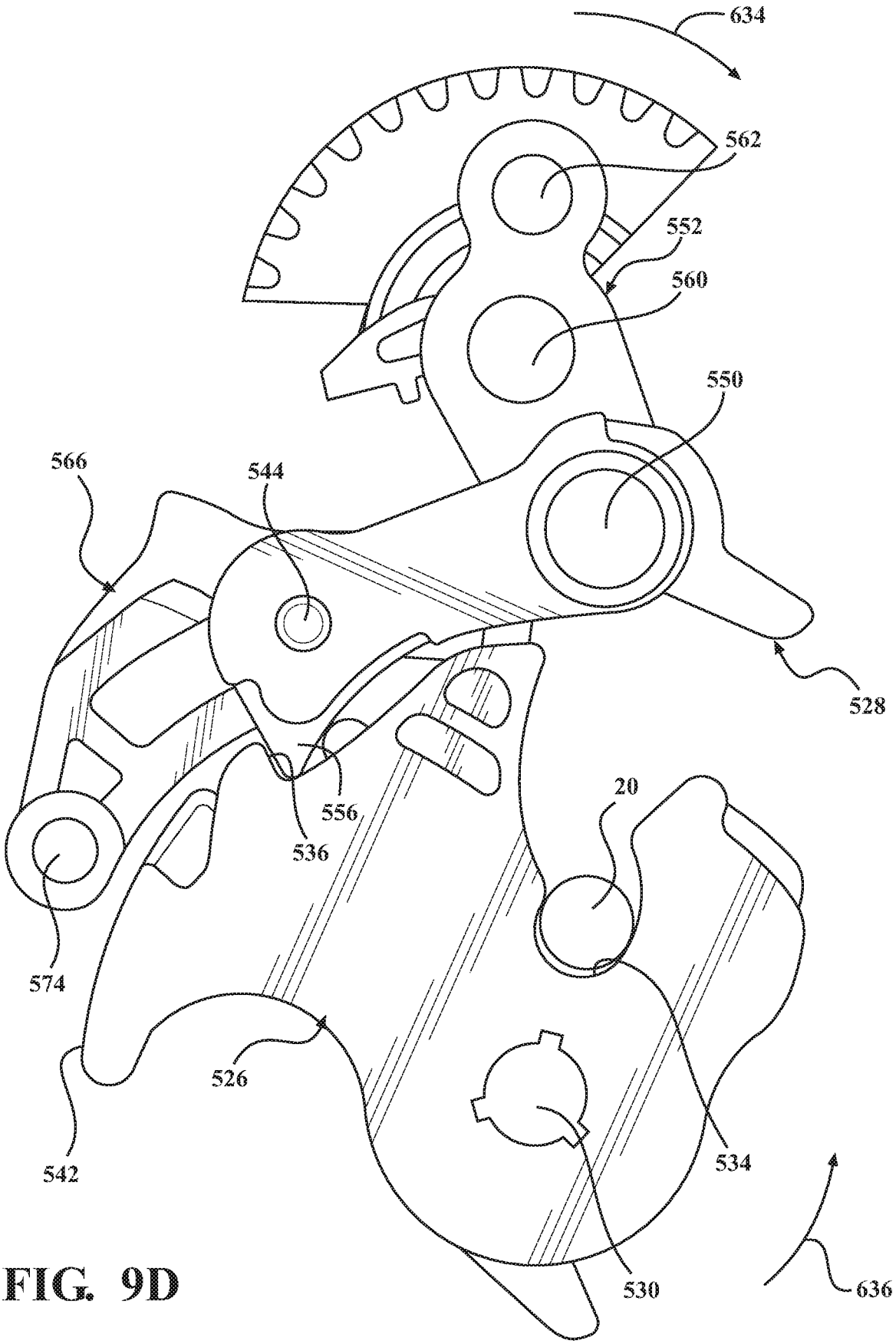
Figure 9E:
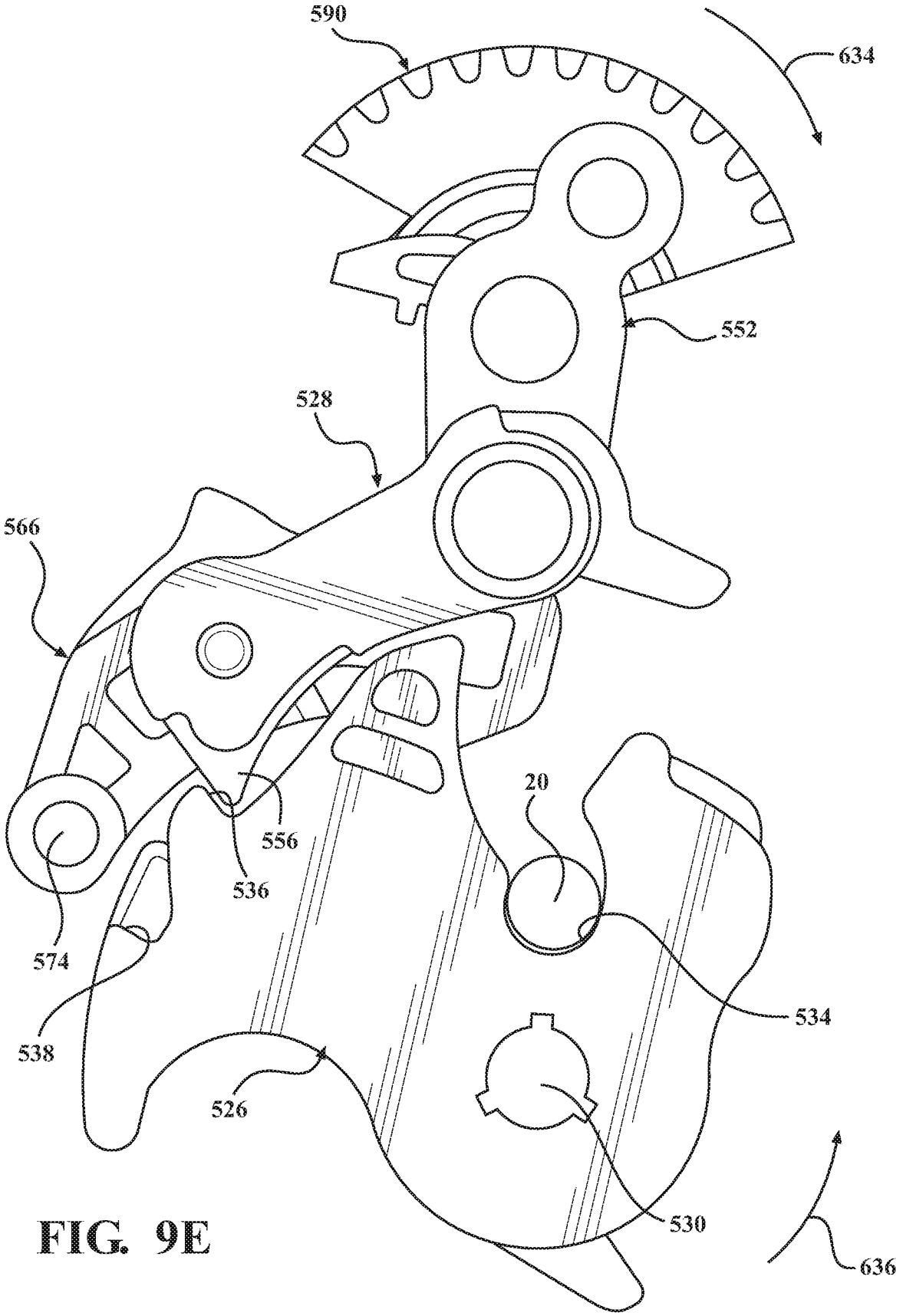

FIGS. 8B and 9B illustrate that engagement of striker 20 with guide channel 532 (caused by closure of door 16) has caused initial rotation of ratchet 526 in the latching direction. It will be noted that these illustrations indicate that pawl lever 566 is still located in its Open pawl lever position with its cam projection 582 maintained in contact with ratchet profile surface 542 so as to mechanically hold pawl 528 in its ratchet release position and its cinch start pawl position. However, upon continued rotation of ratchet 526 in the latching direction, pawl lever cam projection 582 disengages (i.e., falls off) profiled surface 542 on raised ratchet projection 540 while cinch lever 552 and actuator gear 590 are maintained in their respective uncinched and Rest positions so as to cause pawl lever 566 to pivot about pivot axis 574 with closing spring 568 forcibly pivoting pawl lever 566 from its Open pawl lever position to its Closed pawl lever position. This pivotal movement of pawl lever 566 causes pawl 528 to pivot about pivot axis 550 from its ratchet release position into its ratchet checking position due to retention of pawl follower pin 554 within guide slot 574. Additionally, pawl 526 is still positioned in its cinch start position. As noted, with pawl 528 in its ratchet checking position, engagement flange 556 moves into contact with primary closing notch 536 on ratchet 526, thereby establishing the latched mode of power latch assembly 500. This latched mode is established mechanically via closing of door 16 to its closed position for locating ratchet 526 in its primary striker capture position.

FIGS. 8C, 9C and 16A-16D illustrate initiation of the power cinching operation once ratchet 526 is retained in its primary striker capture position. Specifically, Arrow 634 indicates the direction of rotation of actuator gear 590 in a first or "cinching" direction from its Rest position toward a second or "Cinch" position caused by energization of electric motor 602. Such initial rotation of actuator gear 590 in the cinching direction causes concurrent rotation of cinch lever 552 about pivot axis 560 from its uncinched position toward a second or "cinched" position which, in turn, causes pawl 528 to also move with respect to pivot axis 550. This pivotal movement of cinch lever 552 results in translational movement of pawl 528 from its cinch start pawl position toward its cinch stop pawl position. Specifically, pawl follower pin 554 moves within guide slot 576 in pawl lever 566 as pawl lever 566 is maintained in its Closed pawl lever position. The contour of guide slot 576 is configured to move pawl 528 along a path coordinated with the continued rotation of ratchet 526. Accordingly, pawl 528 acts as a "drive link" with respect to ratchet 526 such that its engagement flange 556 continues to engage primary closing notch 536 and forcibly rotate ratchet 526 in the latching direction from its primary striker capture position toward its cinched striker capture position, as indicated by Arrow 636.

Figure 9F:
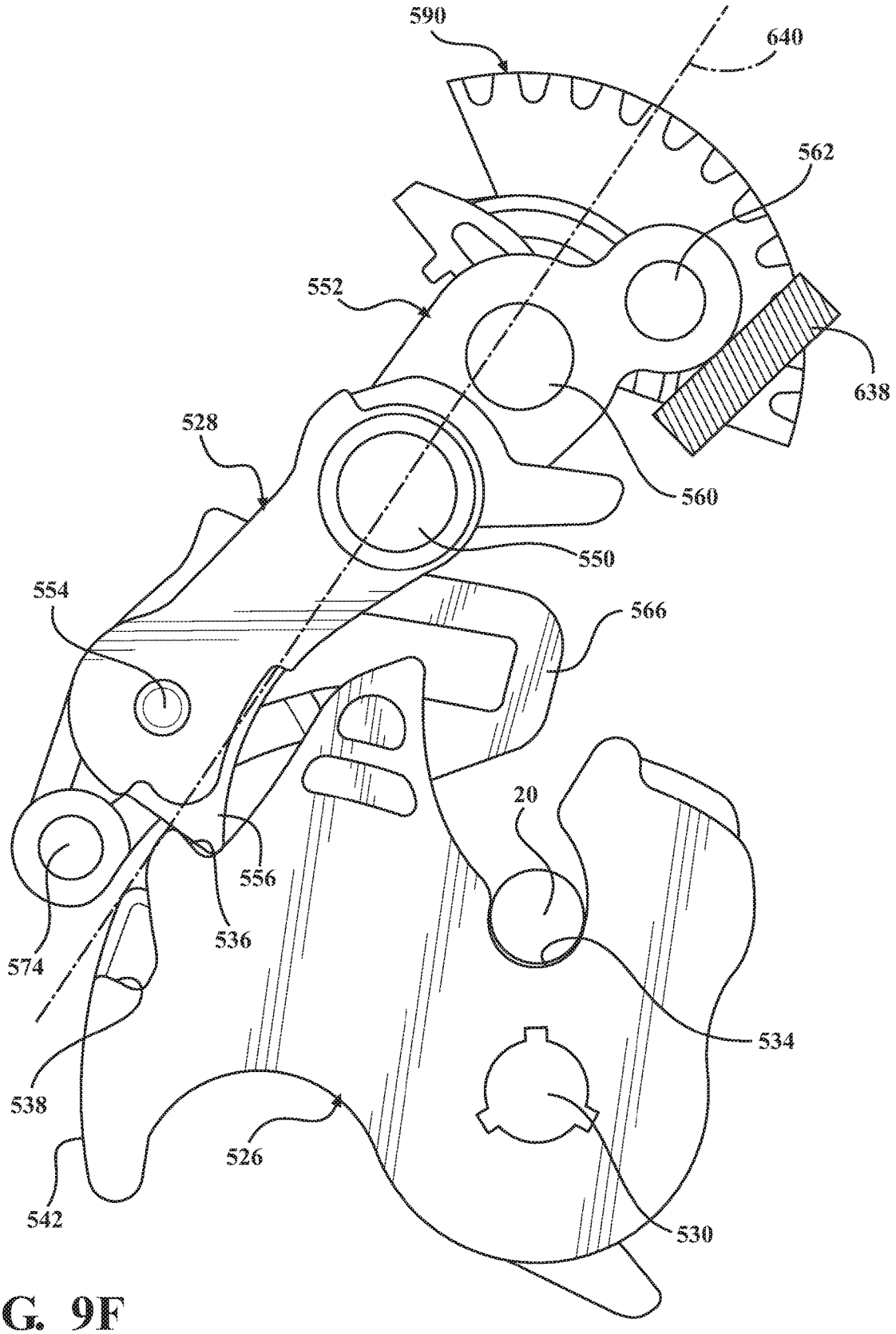
Figure 17A:
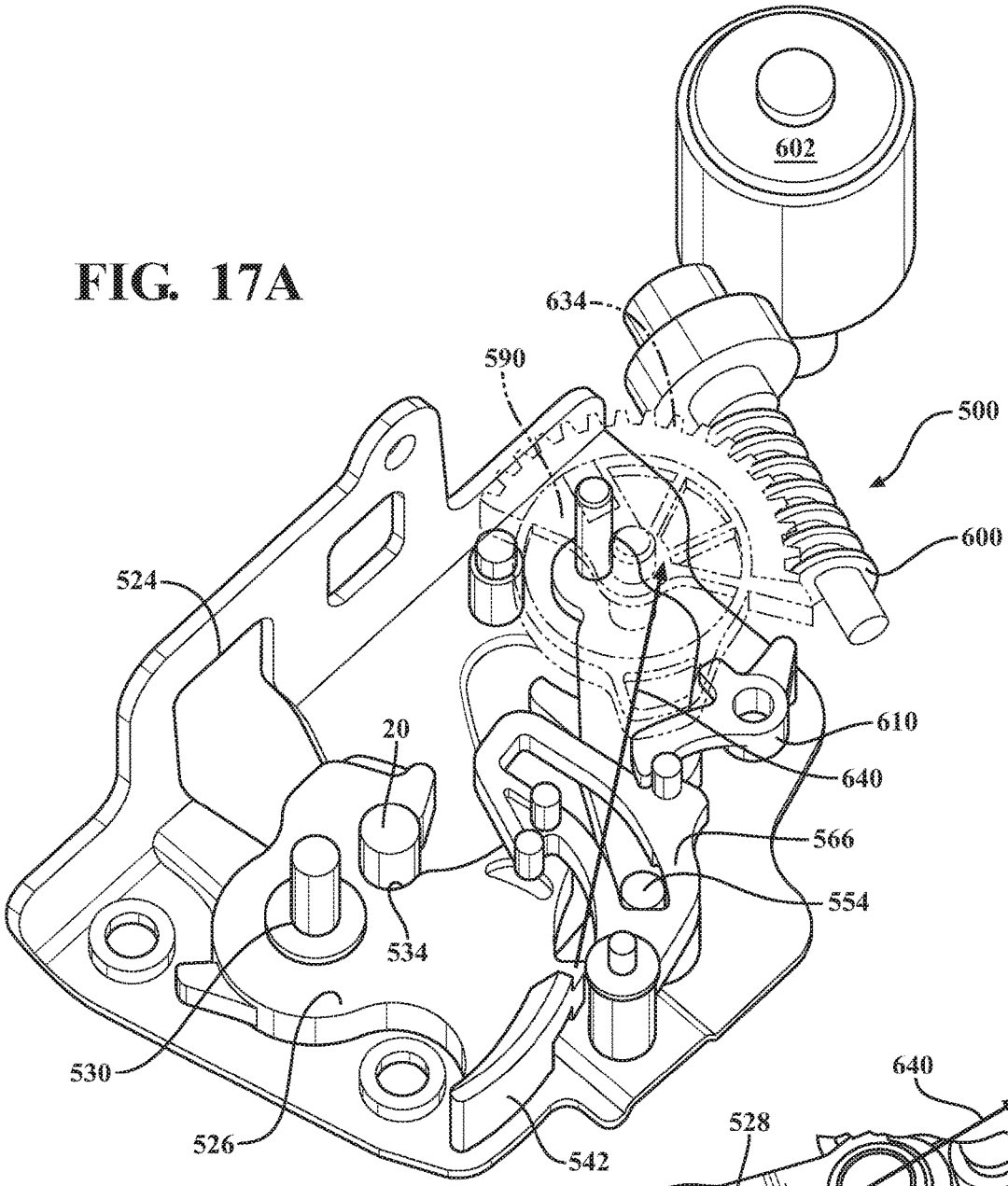
Figure 17B:
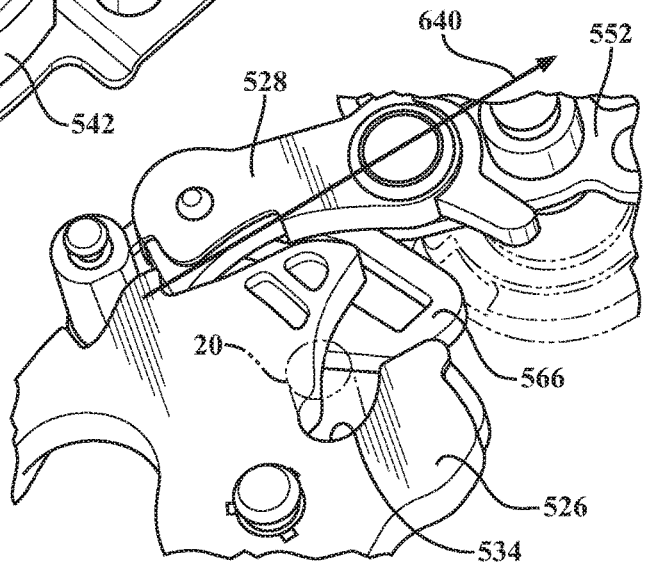
Figure 17C:
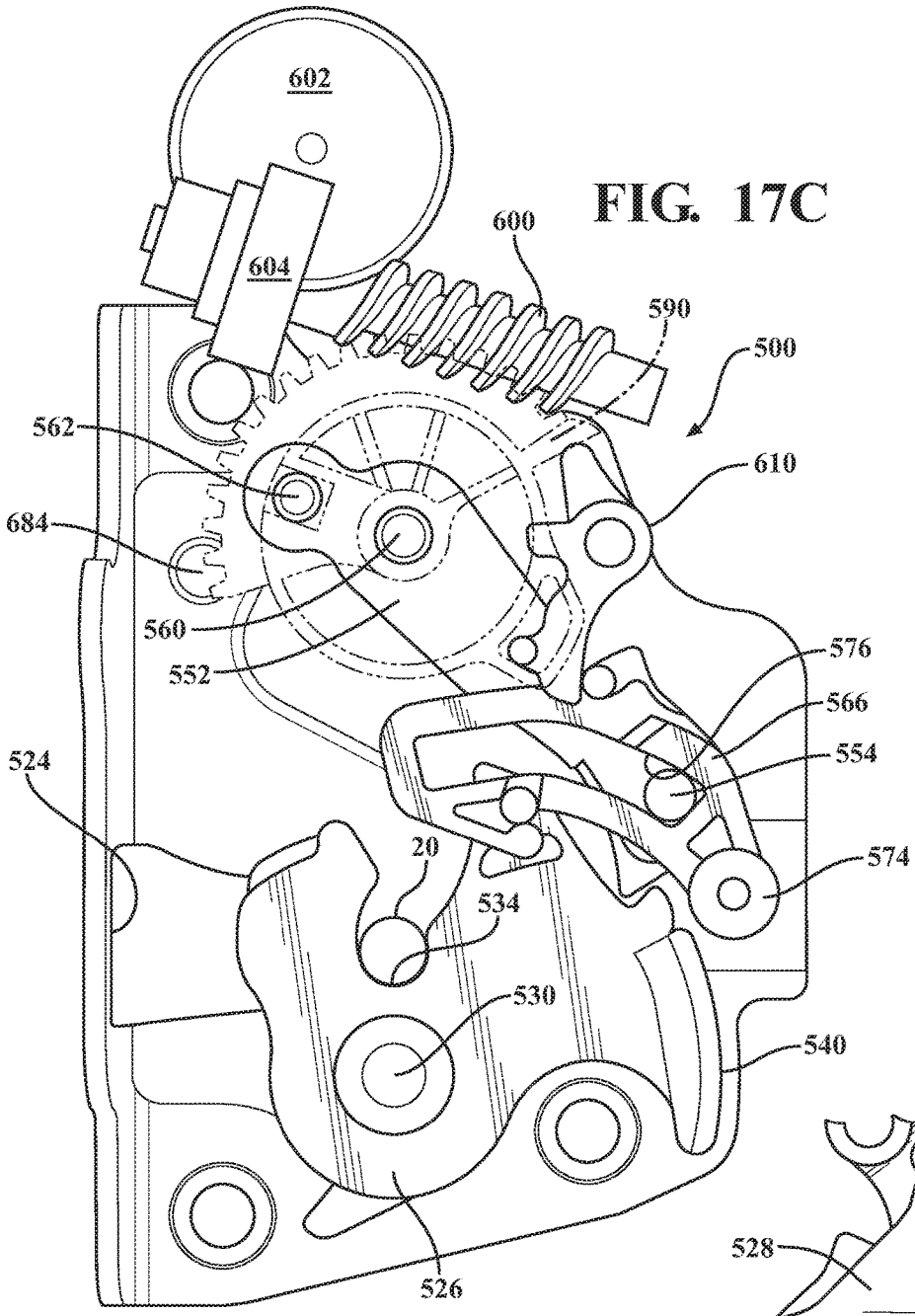
Figure 17D:
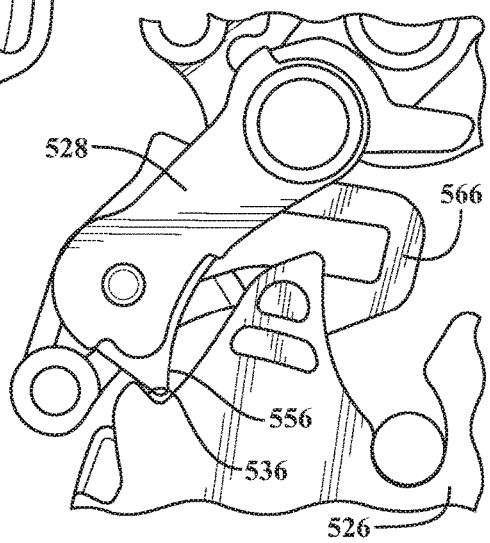
Figure 18A:
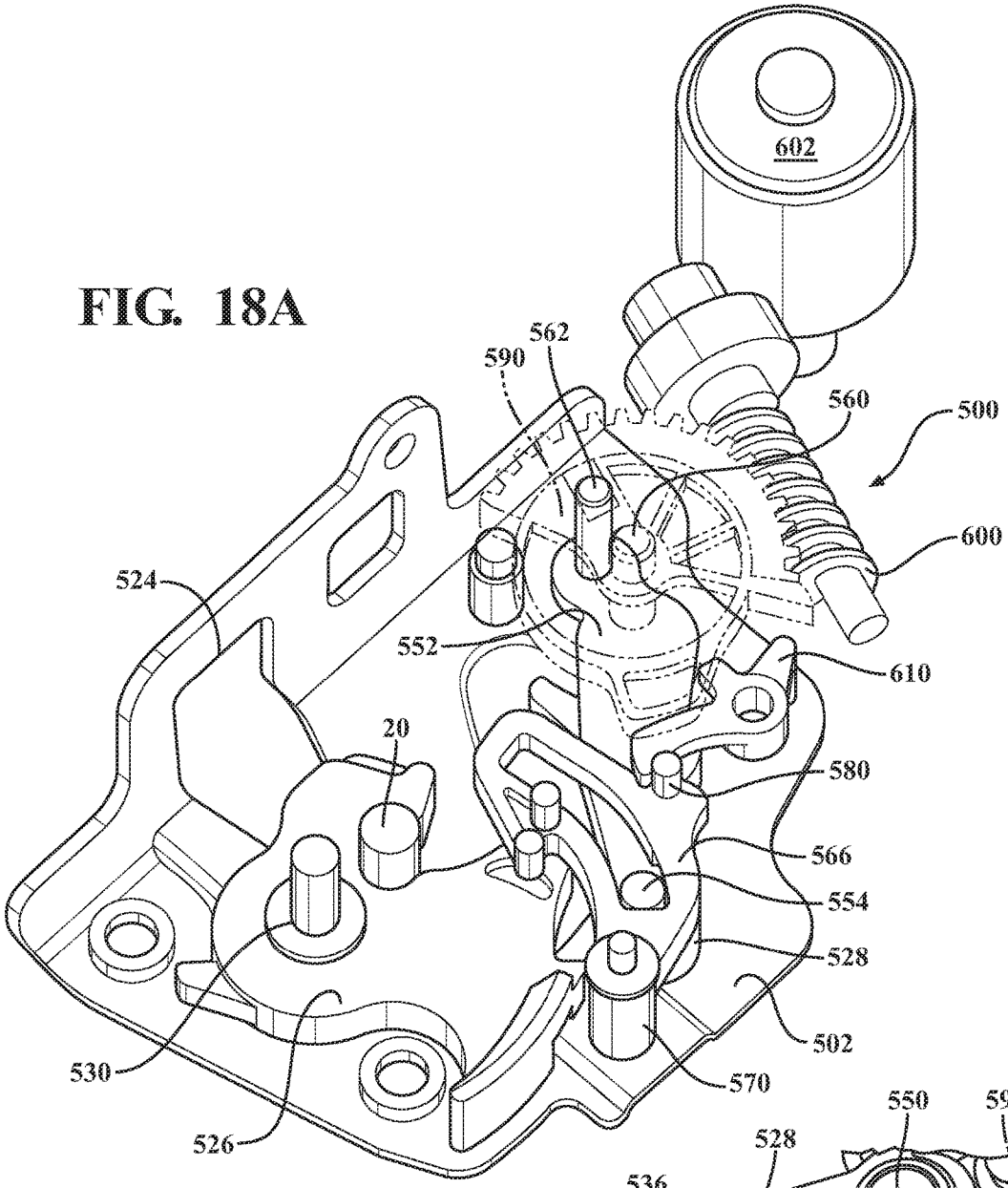
Figure 18B:
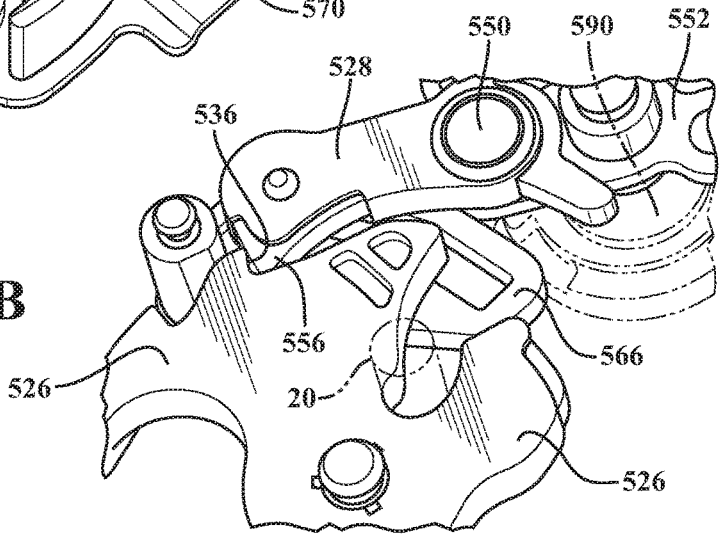
Figure 18C:
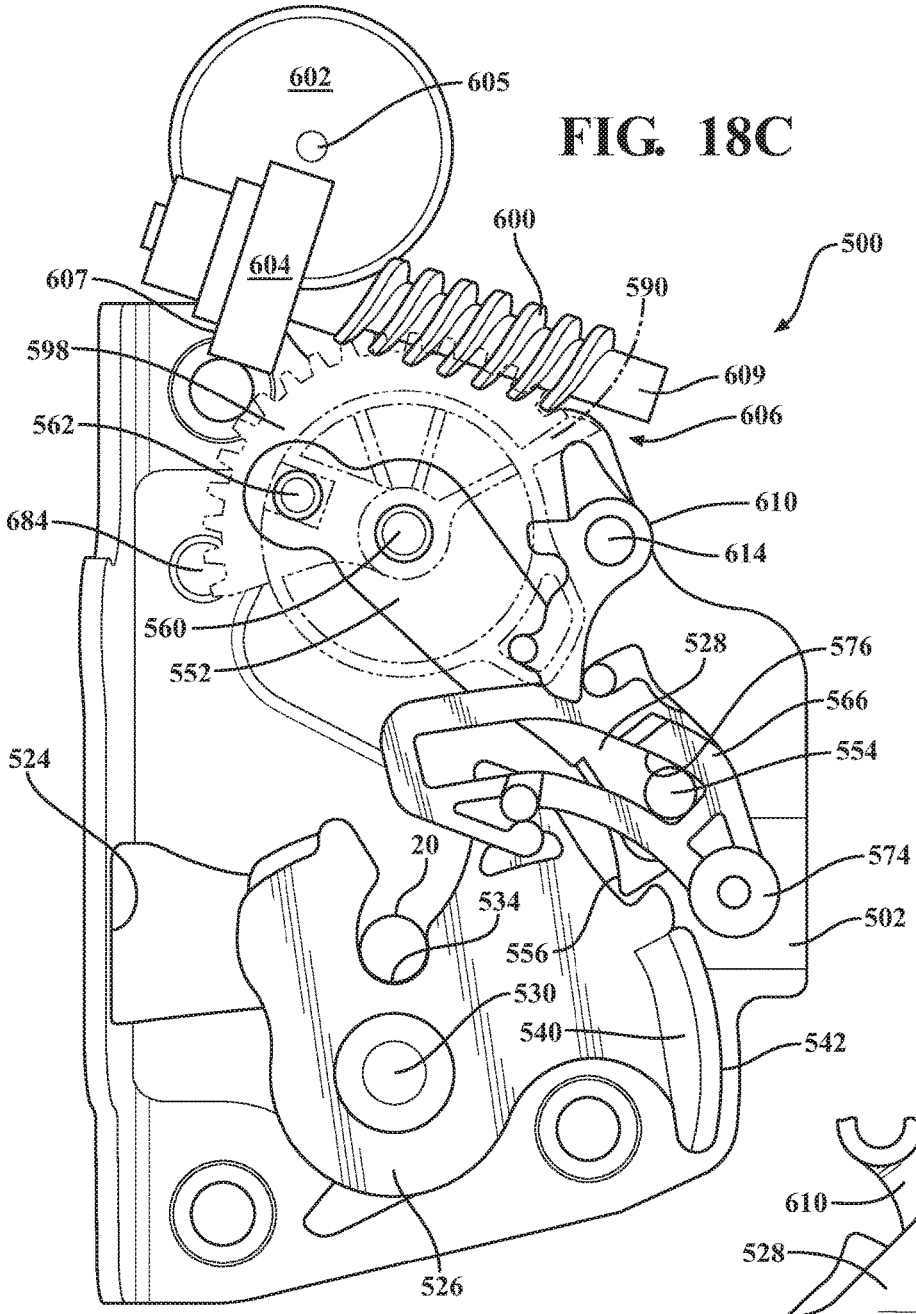
Figure 18D:
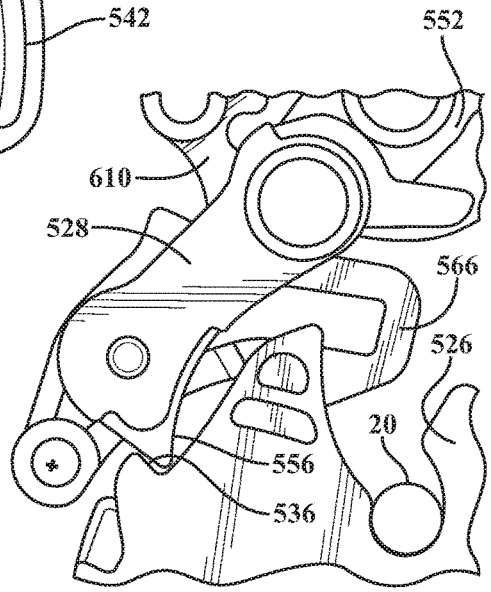
Figure 19A:
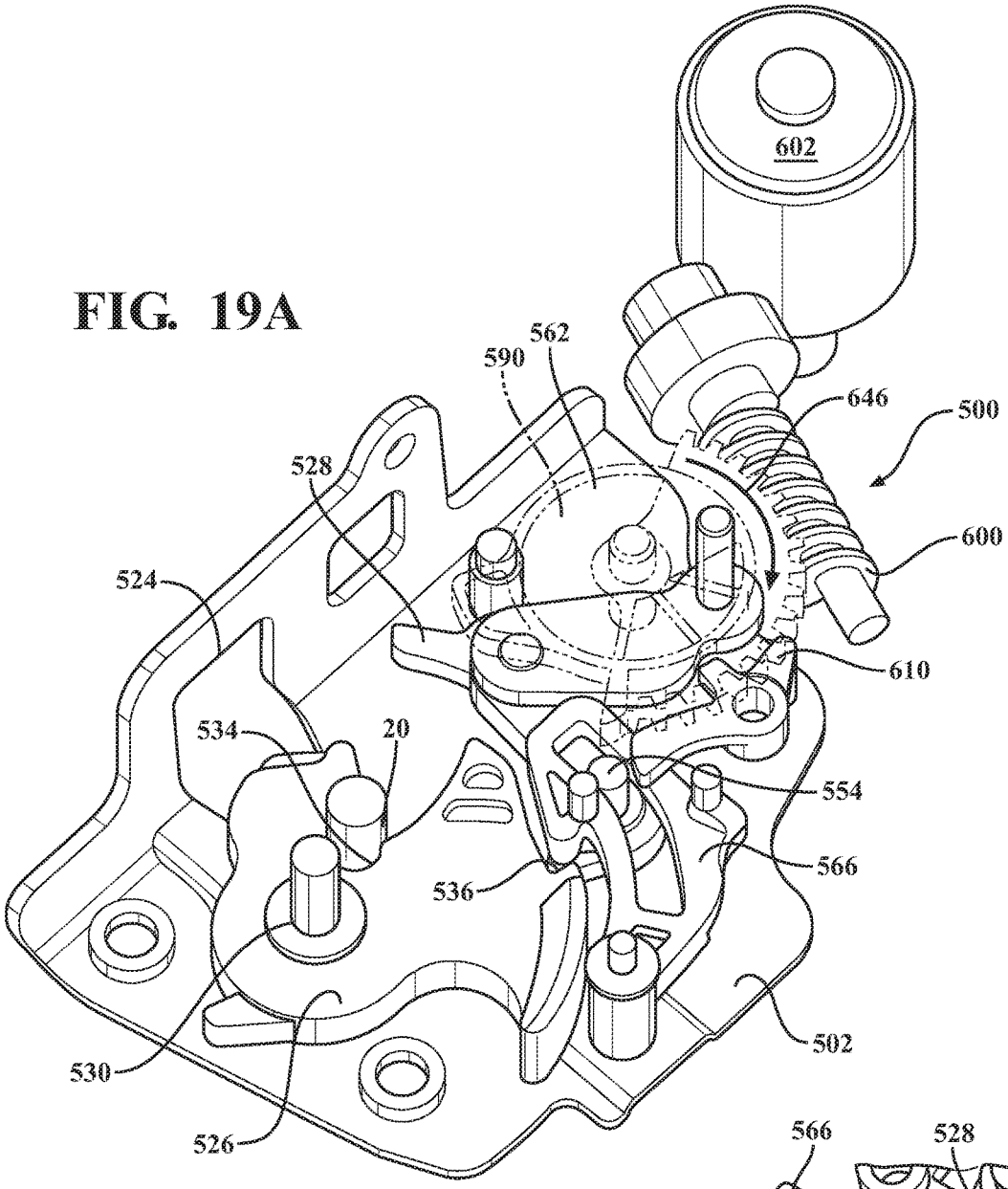
Figure 19B:
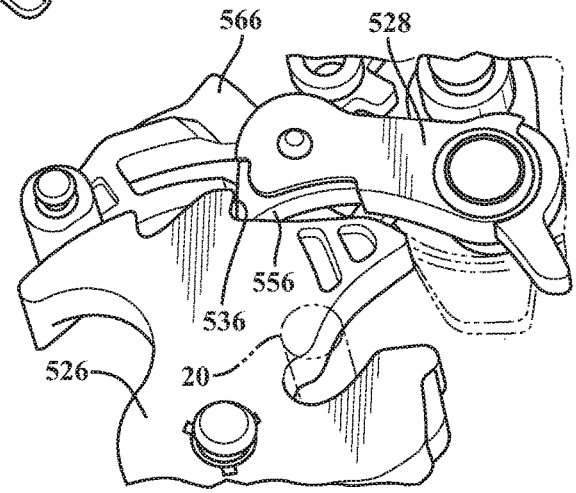
Figure 19C:
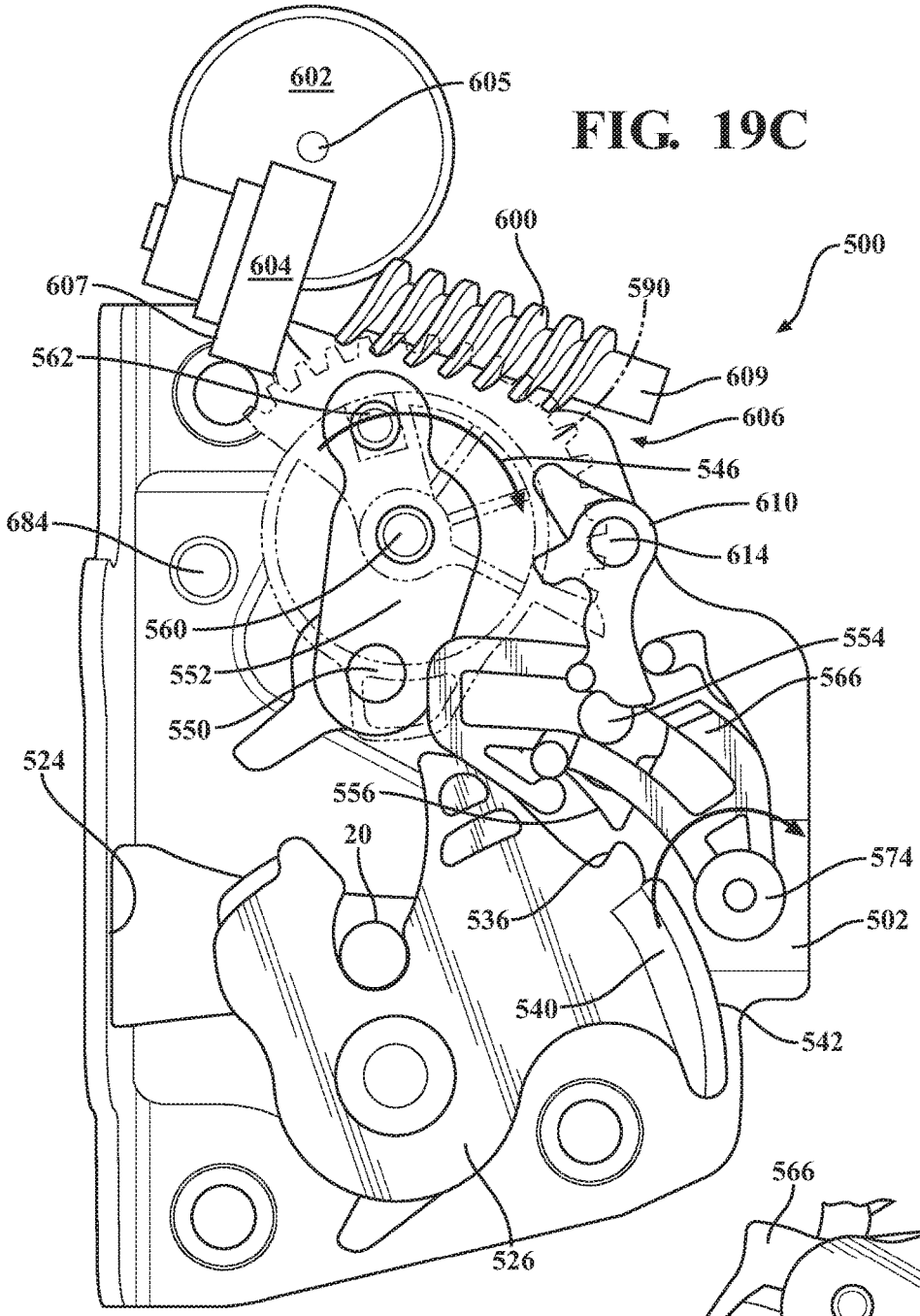
Figure 19D:
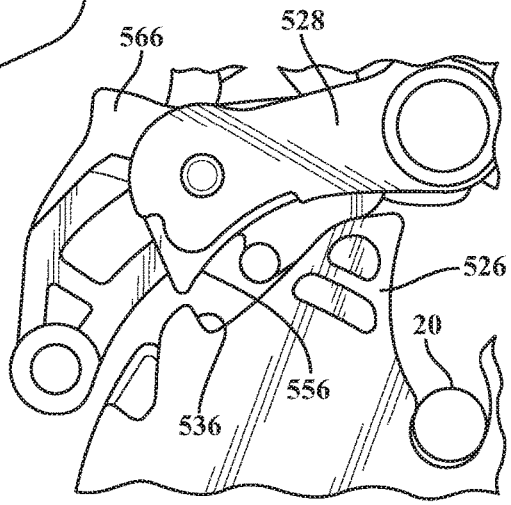
Figure 20C:
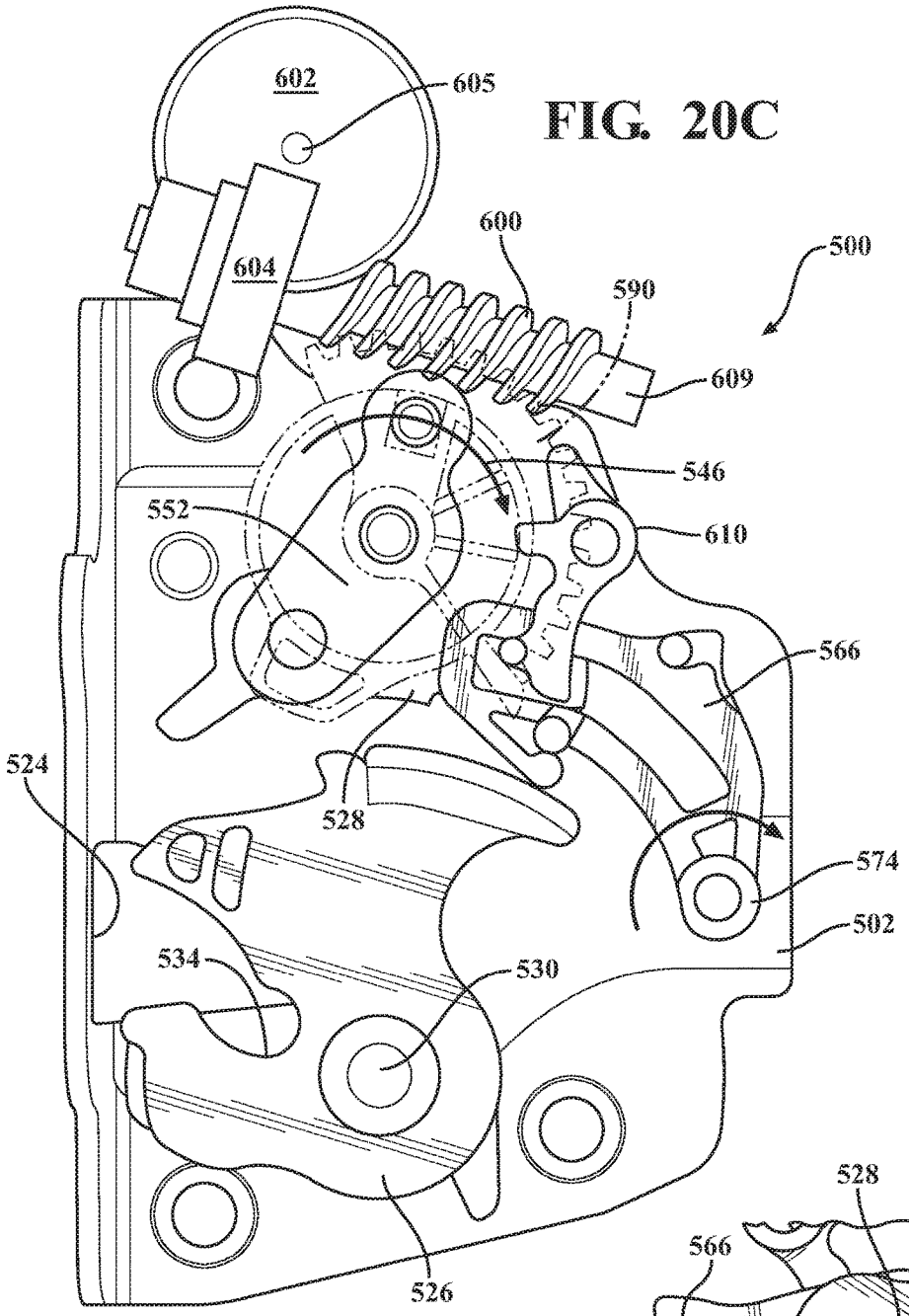
Figure 20D:
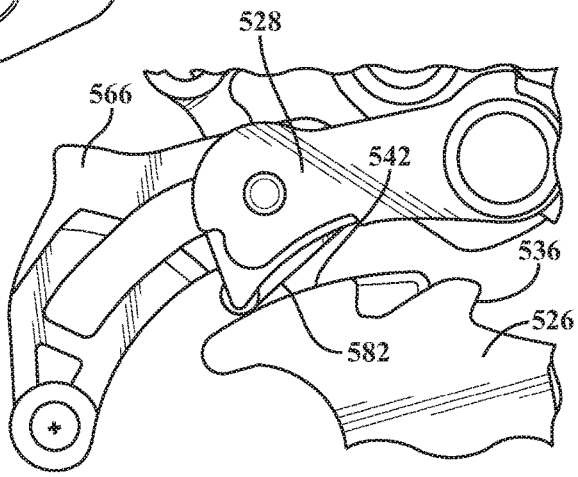

FIGS. 8D-8F, 9D-9F and 17A-17D illustrate continued driven rotation of actuator gear 590 in the cinching direction until it reaches its Cinch position which, in turn, locates cinch lever 552 in its cinched position. Such movement of cinch lever 552 to it cinched position acts to move pawl 528 into its cinch stop pawl position which, in turn, moves ratchet 526 into its cinched striker capture position. At this position, cinch lever 552 engages a second mechanical stop 638, as best shown in FIG. 9F, and the power cinching operation is completed. It will also be noted that pawl follower pin 554 is now located in close proximity to a second terminal end of guide slot 576. Thus, the arcuate contour of guide slot 576 is configured to ensure that engagement flange 556 on pawl 528 maintains continued engagement with primary closing notch 536 on ratchet 526 as pawl 528 forcibly rotates ratchet 526 into its cinched striker capture position. A second position sensor can be provided for detecting when actuator gear 590 is located in its Cinch position and for providing such a position signal to the latch control system. Once actuator gear 590 is located in its Cinch position, motor 602 is deenergized such that pawl 528 now functions to mechanically hold ratchet 526 in its cinched striker capture position. FIGS. 9F, 17A, and 17B show a directional force line, indicated by reference numeral 640, which clearly illustrates an "over-center" retention arrangement established between the pawl/ratchet point of contact, pawl pivot point 550 and pivot axis 560 of actuator gear 590 when pawl 526 is located in its cinch stop pawl position, whereby no back drive of actuator gear 590 and the power-operated cinch actuator occurs.

As noted, power latch assembly 500 also provides a power release feature that is configured to initially provide an uncinching function prior to release of ratchet 526 so as to provide a "soft open" of door 16 that is intended to eliminate or significantly reduce the "pop-off" noise associated with abrupt release of the compressed door seals. Accordingly, prior to initiation of the power release operation, the components of power latch assembly 500 are oriented and located as shown in FIGS. 8F, 9F and 18A-18D. Specifically, ratchet 526 is held in its cinched striker capture position by pawl 528 located in its ratchet checking position and its cinch stop position, pawl lever 566 is located in its Closed pawl lever position, actuator gear 590 is located in its Cinch position, and cinch lever 552 is located in its cinched positions. When a signal is received to open door 16, motor 602 is energized to rotate actuator gear 590 in a second or "releasing" direction from its Cinch position back to its Rest position. Initial rotation of actuator gear 590 in this releasing direction is shown in FIGS. 10A and 11A and indicated by Arrow 646. This initial rotation of actuator gear 590 causes cinch lever 552 to pivot about axis 560 which, in turn, causes pivotal movement of pawl 528 about axis 550 and sliding movement of follower pin 554 within guide slot 476 while pawl lever 566 is held by closing spring 568 in its Closed pawl lever position. As such, ratchet 526 is permitted to rotate in its releasing direction from its cinched striker capture position toward its uncinched striker capture position. As seen, engagement flange 556 on pawl 528 is maintained in contact with primary closing notch 536 during this initial limited range of "uncinching" rotation of ratchet 526. Also seen is initial engagement of release segment 624 on actuator gear 590 with second projection 620 on release lever 610 which is shown in its first or Rest position.

FIGS. 19A-19D illustrate the "release point" established when ratchet 526 is rotated to its uncinched striker capture position. Specifically, continued rotation of actuator gear 590 in the releasing direction causes release lever 610 to pivot about axis 614 from its Rest position into a second or Release position due to release segment 624 on actuator gear 590 engaging second projection 620 on release lever 610. Such rotation of release lever 610 from its Rest position to its Release position causes third projection 622 on release lever 610 to engage lug 580 on pawl lever 556 and forcibly pivot pawl lever 556 about pivot point 574, in opposition to the biasing of closing spring 568, from its Closed pawl lever position to a Release/Open pawl lever position. With pawl lever 566 located in its Release/Open pawl lever position, the interaction between pawl follower pin 554 and guide slot 576 causes pawl 528 to be forcibly pivoted from its ratchet checking position into its ratchet release position such that engagement flange 556 on pawl 528 is now disengaged from primary closing notch 536 on ratchet 526. Thereafter, ratchet 526 is permitted to rotate from its uncinched striker capture position to its striker release position shown in FIGS. 10B, 11B and FIGS. 20A-20D. Following release of ratchet 526, actuator gear 590 continues to rotate back to its Rest position in preparation for the next door closing operation.

Referring now to FIGS. 12 through 14, power latch assembly 500 is shown to further include a supplemental structural component, such as a structural rivet 680, that is fixedly secured to frame plate 502 and which is positioned to assist in containing deformation of pawl 528 during a crash incident occurring when door 16 is initially latched in its closed position (prior to power cinching) with ratchet 526 being held by pawl 528 in its primary striker capture position. The direction of anticipate loads exerted by striker 20 on ratchet 526 during such a crash incident are indicated by Arrow 682 (FIG. 12A). A line of force, indicated by line 684, illustrates that structural rivet 680 is positioned to engage pawl 528 in the event of limited deformation thereof so as to maintain ratchet 526 in its primary striker capture position. FIG. 13 illustrates, via line of force 640, that cinch lever rivet 560 acts to resist deformation of pawl 526 when ratchet 526 is located in its cinched striker capture position following completion of the power cinching operation. In addition to the reinforcement arrangements shown, FIGS. 14A and 14B also indicate installation of a cylindrical bushing 690 on cinch lever pivot post 560. The function of bushing 690 is to maintain the distance between frame plate 502 and cinch lever 552, contain deformation of cinch mechanism 512 during a collision situation, and rotate with pawl 528 in order to avoid friction during normal operation.

Power latch assembly 500 is constructed and operable to rely on and utilize a single closing notch, namely primary closing notch 536, to hold and move ratchet 526 from its primary striker capture position into its cinched striker capture position during the power cinching operation as well as to move ratchet 526 from its cinched striker capture position into its uncinched striker capture position during the power releasing operation. However, ratchet 526 is also provided with a safety closing notch 538 which is located to be engaged by engagement flange 556 of pawl 528 in its ratchet checking position in the event that an unintended disengagement between engagement flange 556 and primary closing notch 536 occurs. This secondary latching configuration is best shown in FIGS. 21A through 21D. Specifically, Arrow 696 illustrates rotation of ratchet 526 from its cinched striker capture position (shown in FIGS. 21A, 21B) into a safety striker capture position (shown in FIGS. 21C, 21D). However, this additional safety latching provision will only provide a failsafe latching function as safety closing notch 538 is not used to provide any type of primary latching functions. Power latch assembly 500 is distinguished by use of a single closing notch (primary closing notch 536) and the use of pawl 528 (instead of a distinct cinch link lever) to mechanically hold ratchet 528 in its primary striker capture and cinched striker capture positions.

Referring primarily to FIGS. 22A through 22C, inside latch release mechanism 518 is shown to include a pivotal release lever or handle 212 and a pivotal inside release link 700 that is pivotal about an axis 702. Inside release link 700 has a tabbed first end segment 704 selectively engageable with pivotal handle 212 and a second end segment 706 arranged to selectively engage lug 578 on pawl lever 566. Upward lifting movement of handle 212, as indicated by arrow 708, associated with actuation of inside door handle 24 causes a drive end segment of handle 212 to engage first end segment 704 and cause pivotal movement of release link 700 about axis 702 from a "non-actuated" position (FIG. 22A) to an "actuated" position (FIGS. 22B and 22C). With release link 700 in its non-actuated position, second end segment 706 does not engage and/or interfere with engagement of pawl 528 with ratchet 526. In contrast, FIG. 22B illustrates that movement of release link 700 to its actuated position causes its second end segment 706 to forcibly act on lug 578 and cause pawl lever 566 to pivot about its axis 574 to its Release/Open pawl lever position where engagement flange 556 on pawl 528 is disengaged from primary closing notch 536 on ratchet 526, thereby permitting ratchet 526 to subsequently rotate to its released position. FIG. 22B illustrates the release of ratchet 526 from its cinch striker capture position (post-cinch). The arrangement shown in FIG. 22C is virtually identical to that shown in FIG. 22B except that release link 700 is releasing ratchet 526 from its primary striker capture position (pre-cinch).

FIGS. 23A through 23C illustrate the components associated with outside latch release mechanism 520. Outside release mechanism 520 is interactively associated with inside release mechanism 518, and particularly, with inside release link 700 for moving it between the non-actuated (FIG. 23A) position and the non-actuated (FIGS. 23B and 23C) position. Outside release mechanism 520 includes an outside release link 720 that is supported for pivotal movement about a fixed pivot post 722. Outside release link 720 includes a first end segment 724 positioned in engagement with an intermediate segment 703 of inside release link 700, and a second end segment 726 acted upon via cable 728 for causing movement along a direction indicated by line 730 in response to actuation of outside door handle 22. In FIG. 23A, outside release link 720 is shown in a non-actuated position so as to maintain inside release link 700 in its non-actuated position. In contrast, FIG. 23B illustrates outside release link 720 moved to an actuated position such that its first end segment 726 forcibly acts on intermediate segment 703 and pivots inside release link 700 to its actuated position, whereby inside release link 700 moves pawl lever 566 to its Release/Open pawl lever position for releasing pawl engagement flange 556 from engagement with primary closing notch 536 on ratchet 526. Again, FIG. 23B illustrates release of ratchet 526 from its cinched striker capture position (post-cinch) while FIG. 23C illustrates release of ratchet 526 from its primary striker capture position (pre-cinch). While not specifically shown, one or both of inside release link 700 and outside release link 720 can be biased by a suitable return spring to normally be located in its/their non-actuated position.

Figure 24A:
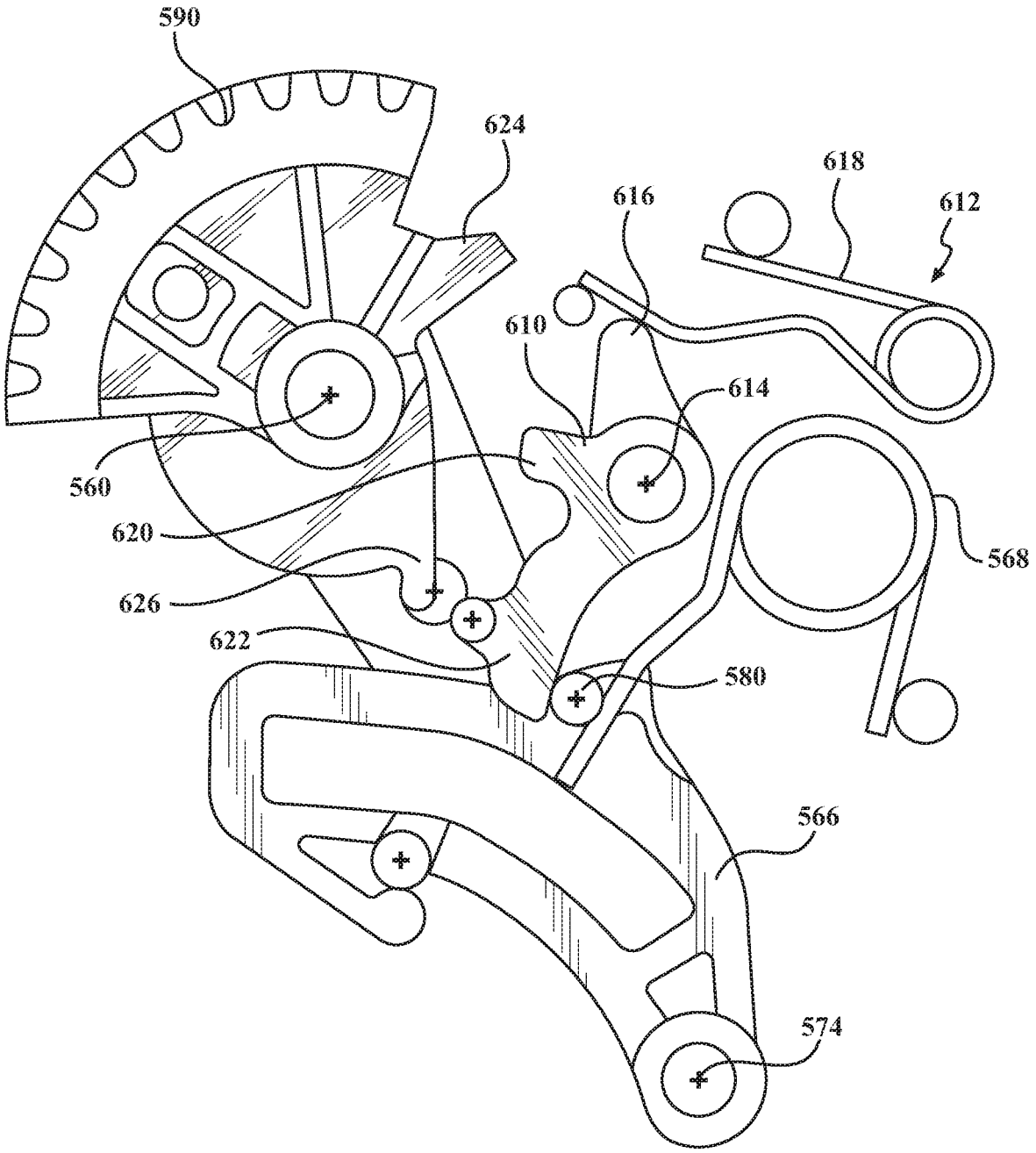
Figure 24B:
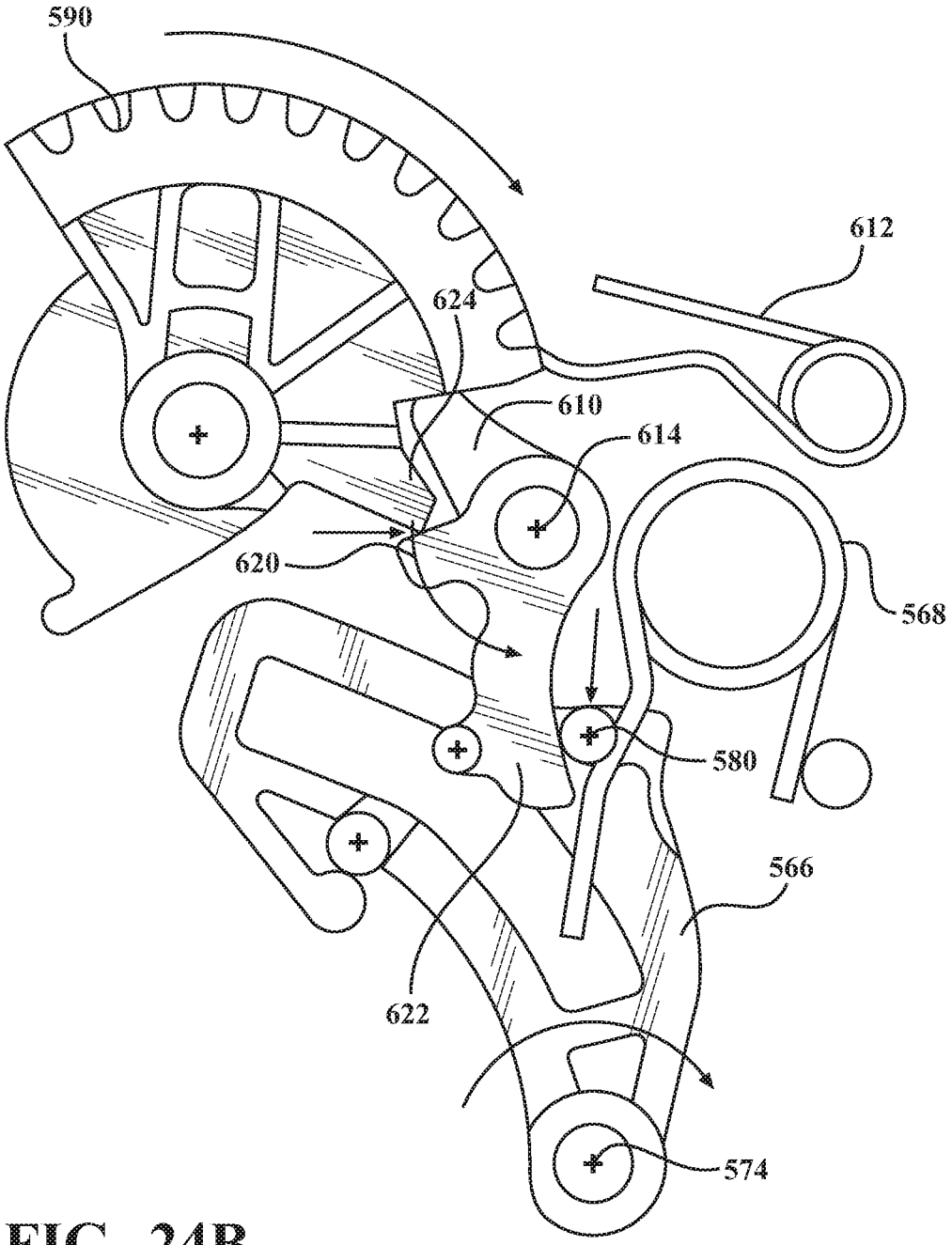
Figure 24C:
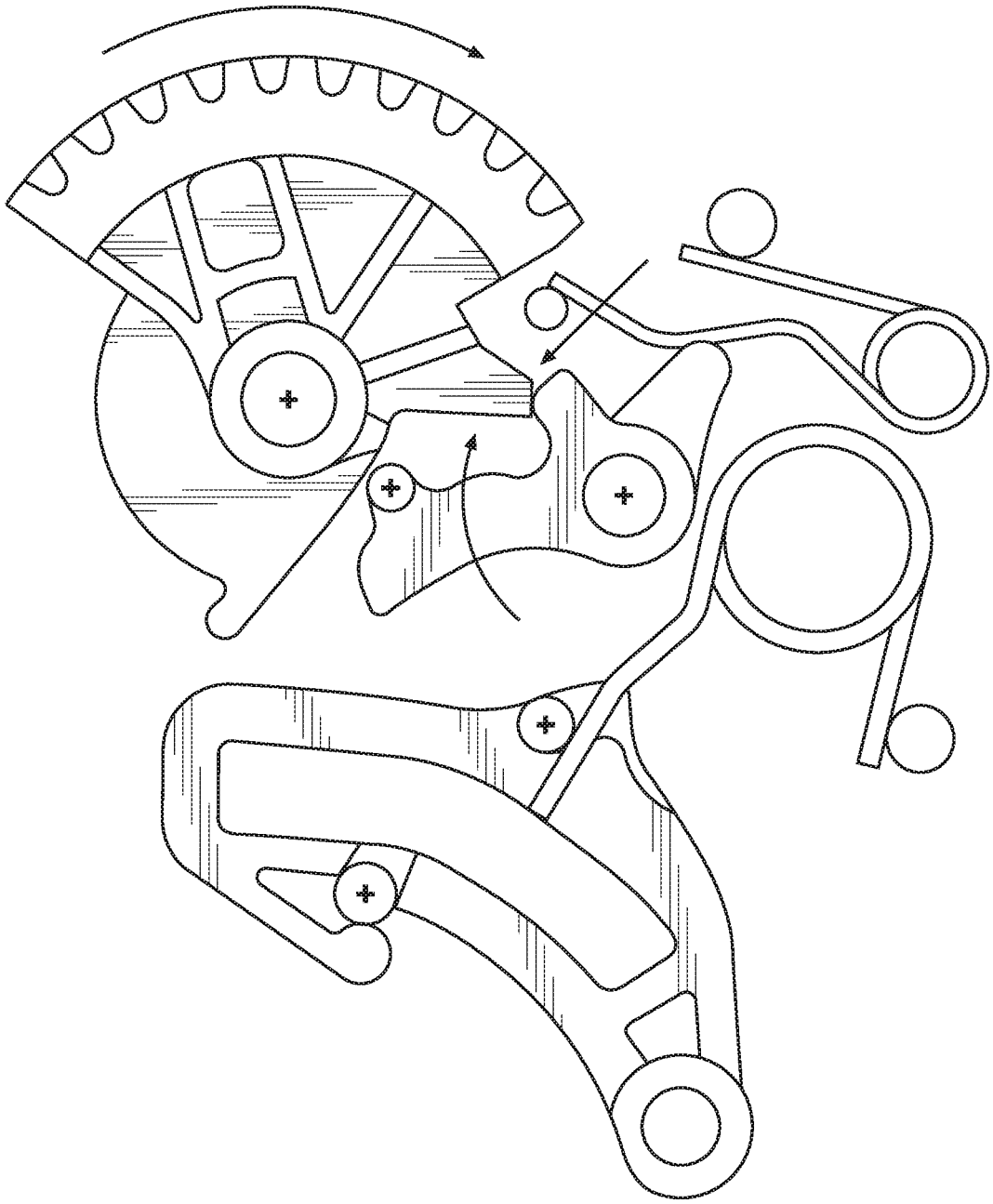
Figure 24D:
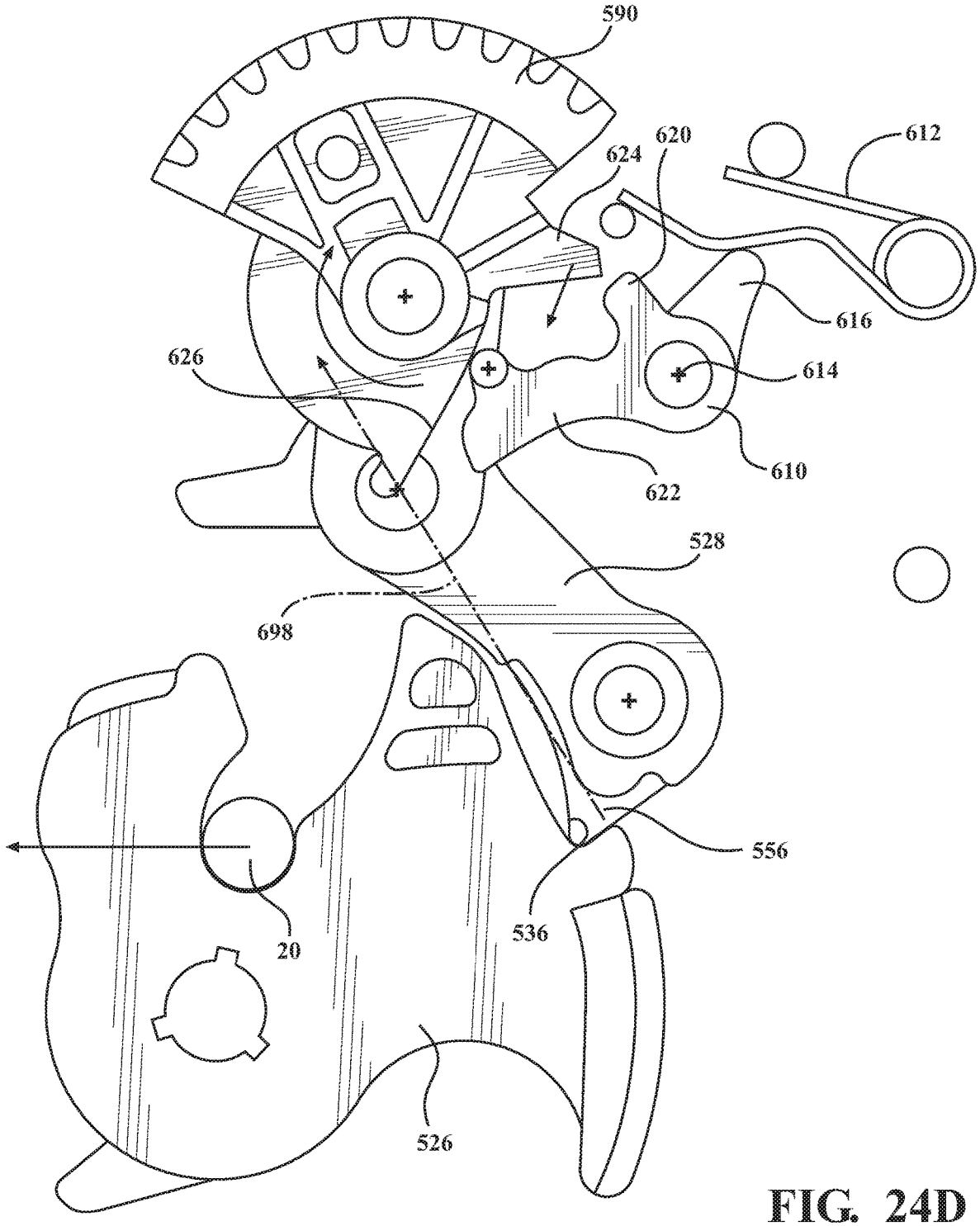
Figure 24E:
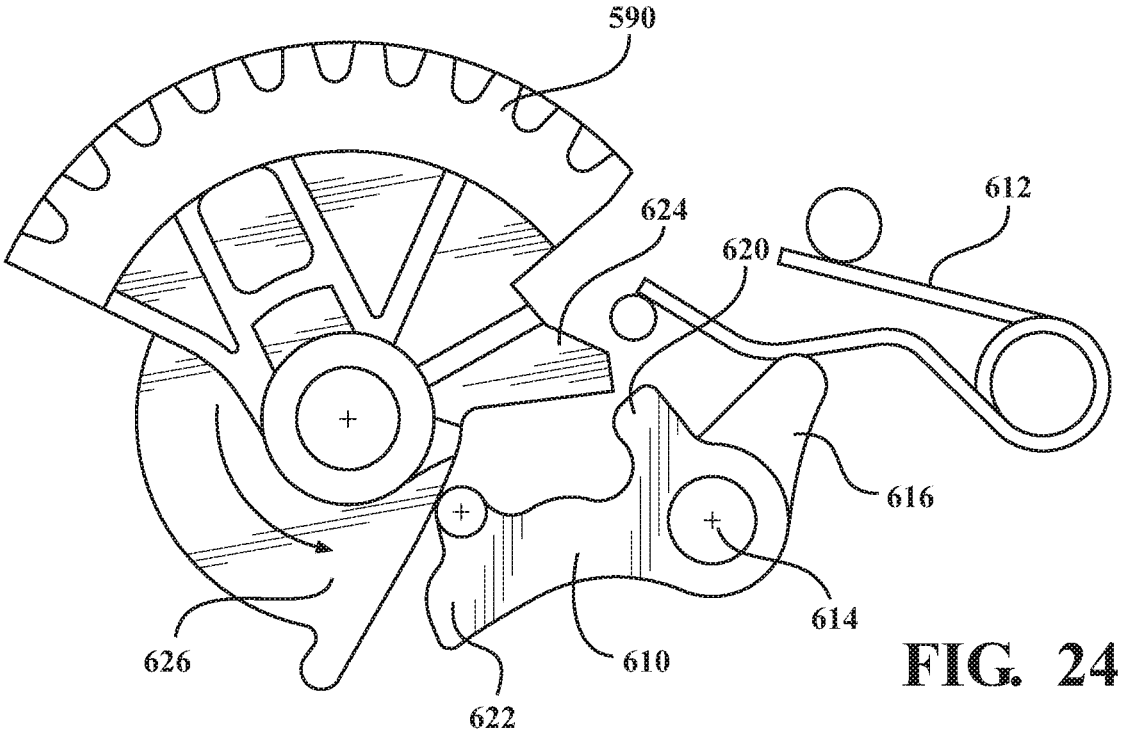
Figure 24F:
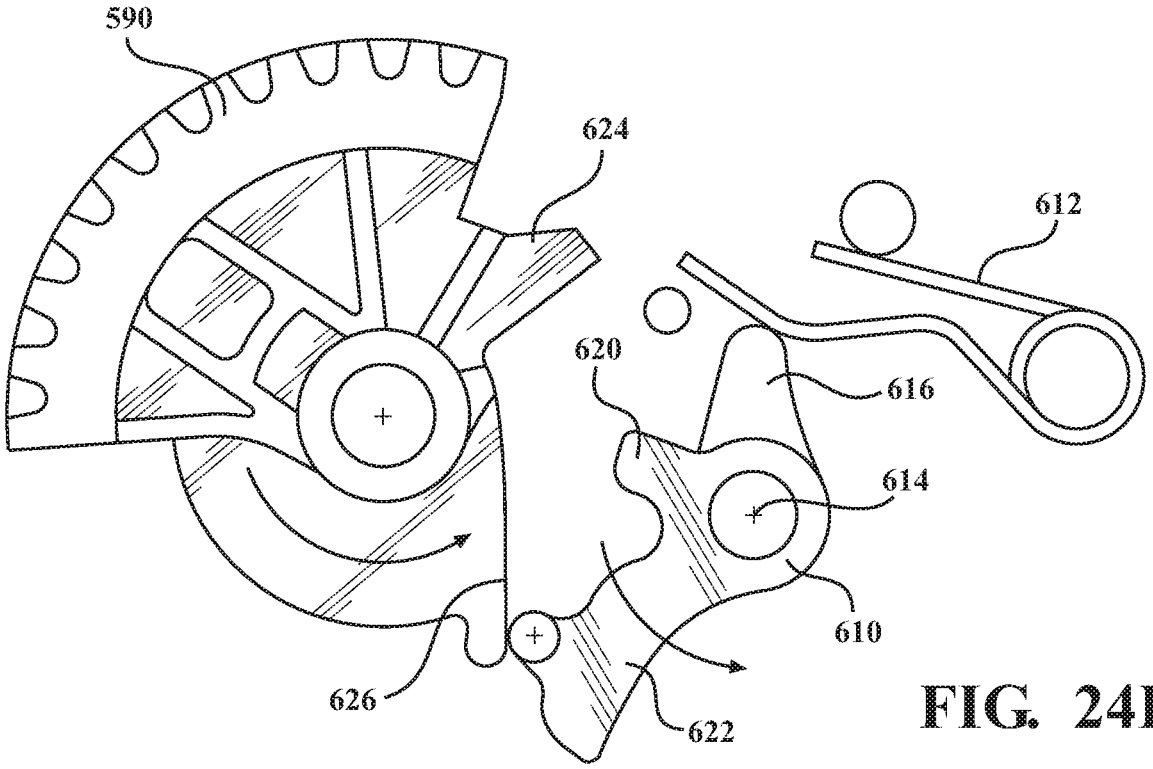

Referring now primarily to FIGS. 24A through 24F, the three (3) distinct operational positions associated with release lever 610 are shown and will now be described. FIG. 24A shows release lever 610 in its middle or Rest position that is established when actuator gear 590 is located in its Cinch position. This middle position is defined and established by the interaction of release lever biasing spring 612 acting on release lever projection 616 and closing spring 568 acting to bias lug 580 on pawl lever 566 into engagement with release lever projection 622. FIG. 24B illustrates rotation of actuator gear 590 in its uncinching direction during the power release operation which, as previously noted, cause gear profile segment 624 to engage release lever segment 620 and forcibly rotate release lever 610 to its Release position which, in turn, causes pawl lever 566 to pivot about axis 574 and release pawl 528 from engagement with ratchet 526. FIGS. 24C and 24E illustrate that rotation of actuator gear 590 from its Rest position toward its Cinch position during the power cinching operation with release lever 610 located in a Safety position. As best shown in FIG. 24D, the Safety position is configured to prevent unintended release of ratchet (via actuation of release lever 610) in the event of motor failure during the power cinching operation. Specifically, rotation of actuation gear 590 in its releasing direction due to forces exerted through ratchet 526 (see line of force 698) will not cause gear segment 624 to engage any portion of release lever 610 so as to maintain pawl lever 566 in its Closed position. FIG. 24F illustrates that second gear segment 626 functions to move release lever 610 from its Safety position back into its Rest position upon completion of the power cinching operation.

The power latch assembly described above is adapted to overcome acknowledged shortcomings of conventional power latch devices including the elimination of the audible "pop" sound generated upon quick release of the seal loads and use of the cinch actuator to always assist in completing the door closing function independently of the closing energy applied to the door. The cinch actuator associated with the power latch assembly of the present disclosure is configured to drive the ratchet slowly in a release direction from its cinched striker capture position to its uncinched striker capture position to provide a predetermined amount of striker travel selected to significantly reduce the seal load prior to complete release of the ratchet. A latch control system having a controller and various sensors configured to provide input signals to the controller that are used to control coordinated control of electric motor 602 in one-motor version of power latch assembly and 500.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A latch assembly for a motor vehicle, comprising:

a ratchet moveable between a striker release position whereat said ratchet is positioned to retain a striker and at least two distinct striker capture positions whereat said ratchet is positioned to retain the striker, wherein said at least two striker capture positions include a primary striker capture position and a cinched striker capture position;

a ratchet biasing member for normally biasing said ratchet toward its the striker release position;

a pawl moveable between a ratchet checking position whereat said pawl engages and holds said ratchet in one of the primary striker capture position and the cinched striker capture positions and a ratchet release position whereat said pawl is released from engagement with said ratchet so as permit movement of said ratchet to the striker release position;

a latch cinch mechanism having a cinch lever pivotably coupled to said pawl; and an actuation mechanism operably moveable in a cinching direction from a cinch start position to a cinch stop position to provide a power cinching function when said ratchet is rotated by the striker into the primary striker capture position and said pawl is located in the ratchet checking position, wherein movement of said actuation mechanism from the cinch start position to the cinch stop position causes pivotal movement of said cinch lever which causes said pawl to forcibly rotate said ratchet from the primary striker capture position into the cinched striker capture position, and wherein said pawl holds said ratchet in the cinched striker capture position; and a frame for securing to the motor vehicle, wherein the ratchet is directly mounted to the frame, wherein movement of said actuation mechanism from the cinch start position to the cinch stop position causes pivotal movement of said cinch lever which causes said pawl to forcibly rotate said ratchet relative to the frame from the primary striker capture position into the cinched striker capture position;

wherein the pawl and the cinch lever are pivotally coupled at a pivot point and define a collapsed state and an expanded state that is elongated relative to the collapsed state;

wherein the pawl and the cinch lever move from the collapsed state to the expanded state when the pawl and the cinch lever forcibly rotate the ratchet from the primary striker capture position into the cinched striker capture position; and wherein the cinch lever pivots about a pivot axis in response to movement of the actuation mechanism, wherein, in the cinched striker capture position, a line of force is defined from a point of contact between the ratchet and the pawl through the pivot point between the pawl and the cinch lever, and the pawl and cinch lever define an over-center retention arrangement between said point of contact, said pivot point, and said pivot axis, where said pivot axis is offset relative to the line of force in a direction away from collapsed state.

2. The latch assembly of claim 1 wherein movement of said actuation mechanism from the cinch start position to the cinch stop position causes said cinch lever to pivot from an uncinched position to a cinched position, and wherein movement of said cinch lever from the uncinched position to the cinched position causes said pawl to move from a first pawl position to a second pawl position while being maintained in the ratchet checking position, wherein movement of said pawl from the first pawl position to the second pawl position causes said ratchet to move from the primary striker capture position into the cinched striker capture position, and wherein said pawl is maintained in the second pawl position for holding said ratchet in the cinched striker capture position.

3. The latch assembly of claim 2 wherein said latch cinch mechanism further includes a pawl lever moveable relative to said ratchet between an Open position when said ratchet is positioned in the striker release position and a Closed position when said ratchet is positioned in one of the primary striker capture position and the cinched striker capture position, and a biasing spring for normally biasing said pawl lever toward the Closed position, wherein said pawl lever includes a guide slot retaining a follower pin that is fixed to said pawl, said guide slot configured to guide movement of said pawl between the first pawl position and the second pawl position while said pawl lever is positioned in the Closed position.

4. The latch assembly of claim 3 wherein said ratchet includes a closing notch, wherein said pawl includes an engagement flange adapted to engage said closing notch when said pawl is located in the ratchet checking position and is further adapted to disengage said closing notch when said pawl is located in the ratchet release position, wherein said engagement flange on said pawl maintains engagement with said closing notch on said ratchet during movement of said pawl from the first pawl position to the second pawl position, and wherein movement of said pawl lever from the Closed position to the Open position causes said pawl to move from the ratchet checking position to the ratchet release position.

5. The latch assembly of claim 4 wherein a power releasing function is provided by moving said actuation mechanism in a releasing direction from the cinch stop position toward the cinch start position which causes said pawl lever to move from the Closed position to the Open position for releasing said engagement flange from said closing notch, whereby said ratchet is permitted to rotate to the striker release position.

6. The latch assembly of claim 5 wherein said power releasing function includes a soft opening feature operable for uncinching said ratchet prior to release of said pawl engagement flange from said ratchet closing notch, said soft opening feature provided by moving said actuation mechanism in said releasing direction from the cinch stop position toward the cinch start position for moving said ratchet from the cinched striker capture position into an uncinched striker capture position before said pawl is moved into the ratchet release position.

7. The latch assembly of claim 6 further comprising a latch release mechanism operable for moving said pawl lever from the Closed position into the Open position upon rotation of said ratchet to the uncinched striker capture position, wherein movement of said pawl lever to the Open position causes said pawl to move from the ratchet checking position into the ratchet release position for disengaging said pawl engagement flange from said ratchet closing notch.

8. The latch assembly of claim 7 wherein said latch release mechanism includes a release lever configured to move from a Rest position into a Release position in response to movement of said actuation mechanism in the releasing direction from the cinch stop position into a cinch release position, wherein movement of said release lever to the Release position causes said pawl lever to move from the Closed position to the Open position.

9. The latch assembly of claim 1, wherein the cinch lever is directly coupled to the pawl.

10. The latch assembly of claim 1, wherein both the pawl and the cinch lever are in compression when in the expanded state in the cinched striker capture position.

11. The latch assembly of claim 1, wherein the cinch lever and the pawl extend from the pivot point at an acute angle relative to each other in the collapsed state, wherein the cinch lever and the pawl extend from the pivot point at an angle greater than 90 degrees and less than 270 degrees relative to each other in the expanded state.

12. A latch assembly for a motor vehicle, comprising:

a ratchet moveable between a striker release position whereat said ratchet is positioned to retain a striker and at least two distinct striker capture positions whereat said ratchet is positioned to retain the striker, wherein said at least two striker capture positions include a primary striker capture position and a cinched striker capture position;

a ratchet biasing member for normally biasing said ratchet toward the striker release position;

a pawl moveable between a ratchet checking position whereat said pawl engages and holds said ratchet in one of the primary striker capture position and the cinched striker capture positions and a ratchet release position whereat said pawl is released from engagement with said ratchet so as permit movement of said ratchet to the striker release position;

a latch cinch mechanism having a cinch lever pivotably coupled to said pawl; and an actuation mechanism operably moveable in a cinching direction from a cinch start position to a cinch stop position to provide a power cinching function when said ratchet is rotated by the striker into the primary striker capture position and said pawl is located in the ratchet checking position, wherein movement of said actuation mechanism from the cinch start position to the cinch stop position causes pivotal movement of said cinch lever which causes said pawl to forcibly rotate said ratchet from the primary striker capture position into the cinched striker capture position, and wherein said pawl holds said ratchet in the cinched striker capture position;

wherein a power releasing function is provide by moving said actuation mechanism in a releasing direction from the cinch stop position toward the cinch start position which causes said pawl to move from the ratchet checking position into the ratchet release position, whereby said ratchet is permitted to rotate to the striker release position;

wherein the pawl and the cinch lever are pivotally coupled at a pivot point and define a collapsed state and an expanded state that is elongated relative to the collapsed state;

wherein the pawl and the cinch lever move from the collapsed state to the expanded state when the pawl and the cinch lever forcibly rotate the ratchet from the primary striker capture position into the cinched striker capture position; and wherein said power releasing function includes a soft opening feature operable for uncinching said ratchet prior to movement of said pawl to the ratchet release position, said soft opening feature provided by moving said actuation mechanism in said releasing direction from the cinch stop position to a cinch release position so as to move said ratchet from the cinched striker capture position into an uncinched striker capture position prior to movement of said pawl to the ratchet release position.

13. The latch assembly of claim 12 wherein movement of said actuation mechanism from the cinch start position to the cinch stop position causes said cinch lever to pivot from an uncinched position to a cinched position, and wherein movement of said cinch lever from the uncinched position to the cinched position causes said pawl to move from a first pawl position to a second pawl position while being maintained in the ratchet checking position, and wherein said movement of said pawl from the first pawl position to the second pawl position causes said ratchet to move from the primary striker capture position into the cinched striker capture position.

14. The latch assembly of claim 13 wherein said latch cinch mechanism further includes a pawl lever moveable relative to said ratchet between an Open position when said ratchet is positioned in the striker release position and a Closed position when said ratchet is positioned in one of the primary striker capture position and the cinched striker capture positions, and a biasing spring for normally biasing said pawl lever toward the Closed position, wherein said pawl lever includes a guide slot retaining a follower pin that is fixed to said pawl, said guide slot configured to guide movement of said pawl between the first pawl position and the second pawl positions while said pawl lever is positioned in the Closed position.

15. The latch assembly of claim 14 wherein said ratchet includes a closing notch, wherein said pawl includes an engagement flange adapted to engage said closing notch when said pawl is located in the ratchet checking position and further adapted to disengage said closing notch when said pawl is located in the ratchet release position, wherein said engagement flange on said pawl maintains engagement with said closing notch on said ratchet during movement of said pawl from the first pawl position to the second pawl position, and wherein movement of said pawl lever from the Closed position to the Open position causes said pawl to move from the ratchet checking position to the ratchet release position.

16. The latch assembly of claim 15 further comprising a latch release mechanism operable for moving said pawl lever from the Closed position into the Open position in response to movement of said actuation mechanism from the cinch stop position to the cinch release position, wherein movement of said pawl lever to the Open position causes said pawl to move from the ratchet checking position into the ratchet release position.

17. The latch assembly of claim 16 wherein said latch release mechanism includes a release lever configured to move from a Rest position to a Release position in response to movement of said actuation mechanism in the releasing direction from the cinch stop position into the cinch release position.

18. A latch assembly for a motor vehicle, comprising:

a ratchet moveable between a striker release position whereat said ratchet is positioned to retain a striker and at least two distinct striker capture positions whereat said ratchet is positioned to retain the striker, wherein said at least two striker capture positions include a primary striker capture position and a cinched striker capture position;

a ratchet biasing member for normally biasing said ratchet toward the striker release position;

a pawl moveable between a ratchet checking position whereat said pawl engages and holds said ratchet in one of the primary striker capture position and the cinched striker capture position and a ratchet release position whereat said pawl is released from engagement with said ratchet so as permit movement of said ratchet to the striker release position;

a latch cinch mechanism having a cinch lever pivotably coupled to said pawl; and an actuation mechanism operably moveable in a cinching direction from a cinch start position to a cinch stop position to provide a power cinching function when said ratchet is rotated by the striker into the primary striker capture position and said pawl is located in the ratchet checking position, wherein movement of said actuation mechanism from the cinch start position to the cinch stop position causes pivotal movement of said cinch lever which causes said pawl to forcibly rotate said ratchet from the primary striker capture position into the cinched striker capture position, and wherein said pawl holds said ratchet in the cinched striker capture position;

wherein said actuation mechanism includes an actuator gear and an electric motor driving said actuator gear, wherein said cinch lever is coupled to said actuator gear such that movement of said actuation gear in a cinching direction from the cinch start position to the cinch stop position results in pivotal movement of said cinch lever from an uncinched position to a cinched position, wherein said pawl is pivotally coupled to said cinch lever such that movement of said cinch lever from the uncinched position to the cinched position causes said pawl to move from a cinch start pawl position to a cinch stop pawl position while said pawl is maintained in the ratchet checking position relative to said ratchet, and wherein movement of said pawl from the cinch start pawl position to the cinch stop pawl position causes said ratchet to move from the primary striker capture position into the cinched striker capture position;

wherein the pawl and the cinch lever are pivotally coupled at a pivot point and define a collapsed state and an expanded state that is elongated relative to the collapsed state;

wherein the pawl and the cinch lever move from the collapsed state to the expanded state when the pawl and the cinch lever forcibly rotate the ratchet from the primary striker capture position into the cinched striker capture position; and wherein said actuation mechanism includes a dual stage reduction gearing arrangement disposed between said electric motor and said actuator gear having a first stage gearset and a second stage gearset.

19. The latch assembly of claim 18 wherein said latch cinch mechanism further includes a pawl lever moveable relative to said ratchet between an Open position when said ratchet is positioned in the striker release position and a Closed position when said ratchet is positioned in one of the primary striker capture position and the cinched striker capture position, wherein said pawl lever includes a guide slot and said pawl includes a follower pin retained in said guide slot, said guide slot configured to guide movement of said pawl from the cinch start pawl position to the cinch stop pawl position while said pawl lever is positioned in the Closed position.

20. The latch assembly of claim 19 further comprising a latch release mechanism configured to move said pawl lever from the Closed position to the Open position in response to rotation of said actuator gear in a releasing direction from the cinch stop position to a cinch release position, wherein such rotation of said actuator gear in said releasing direction causing said ratchet to move from the cinched striker capture position to an uncinched striker capture position prior to movement of said pawl lever to the Open position.

21. The latch assembly of claim 18 wherein said first stage gearset is a first worm gearset including a first worm gear driven by said electric motor and which is meshed with a transfer gear driving a drive shaft, wherein said second stage gearset is a second worm gearset including a second worm gear driven by said drive shaft and which is meshed with said actuator gear.

* * * * *